US011072171B2

(12) United States Patent
Mizuta et al.

(10) Patent No.: US 11,072,171 B2
(45) Date of Patent: Jul. 27, 2021

(54) LIQUID DISCHARGING HEAD AND LIQUID DISCHARGING APPARATUS

(71) Applicant: SEIKO EPSON CORPORATION, Tokyo (JP)

(72) Inventors: Shohei Mizuta, Nagano (JP); Motoki Takabe, Shiojiri (JP); Shunya Fukuda, Azumino (JP); Yoichi Naganuma, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/828,101

(22) Filed: Mar. 24, 2020

(65) Prior Publication Data

US 2020/0307198 A1 Oct. 1, 2020

(30) Foreign Application Priority Data

Mar. 27, 2019 (JP) ..... JP2019-059864

(51) Int. Cl.
*B41J 2/14* (2006.01)

(52) U.S. Cl.
CPC ..... *B41J 2/14072* (2013.01); *B41J 2/14032* (2013.01); *B41J 2/14233* (2013.01); *B41J 2002/14419* (2013.01); *B41J 2002/14459* (2013.01)

(58) Field of Classification Search
CPC ..... B41J 2/14072; B41J 2/14032; B41J 2/14233; B41J 2002/14419; B41J 2002/14459; B41J 2002/14411; B41J 2202/11; B41J 2/04581; B41J 2/04541; B41J 2/04588; B41J 2002/14491;
(Continued)

(56) References Cited

U.S. PATENT DOCUMENTS

2011/0316918 A1 12/2011 Nagashima
2014/0078224 A1 3/2014 Park et al.
2014/0078225 A1 3/2014 Park et al.
(Continued)

FOREIGN PATENT DOCUMENTS

JP 2012-011585 A 1/2012
JP 2014-061695 A 4/2014
(Continued)

OTHER PUBLICATIONS

IP.com search (Year: 2021).*

*Primary Examiner* — Lisa Solomon
(74) *Attorney, Agent, or Firm* — Workman Nydegger

(57) ABSTRACT

Provided is a liquid discharging head including: a nozzle discharging a liquid; a chamber plate having a plurality of pressure chambers, drive elements provided in correspondence with each pressure chamber, and a plurality of lead electrodes for supplying electric signals to the drive elements; and a circuit substrate having terminals coupled to the lead electrodes. A first pressure chamber and a second pressure chamber communicate with the nozzle in common. A first segment electrode is formed so as to overlap the first pressure chamber and is not to overlap the second pressure chamber in plan view. A second segment electrode is formed so as to overlap the second pressure chamber and is not to overlap the first pressure chamber in plan view. The first segment electrode and the second segment electrode are coupled to the same lead electrode.

12 Claims, 36 Drawing Sheets

(58) Field of Classification Search
CPC ..... B41J 2002/14362; B41J 2202/12; B41J 2/01; B41J 2002/14258
See application file for complete search history.

(56) References Cited

U.S. PATENT DOCUMENTS

| | | | | |
|---|---|---|---|---|
| 2017/0001442 | A1 | 1/2017 | Takabe et al. | |
| 2018/0201019 | A1 | 7/2018 | Seto et al. | |
| 2018/0304619 | A1 | 10/2018 | Barbet | |
| 2019/0329559 | A1* | 10/2019 | Ozawa | B41J 2/04581 |

FOREIGN PATENT DOCUMENTS

| | | | |
|---|---|---|---|
| JP | 2014-061696 | A | 4/2014 |
| JP | 2017-013390 | A | 1/2017 |
| JP | 2018-103418 | A | 7/2018 |
| JP | 2018-114713 | A | 7/2018 |

* cited by examiner

LIQUID DISCHARGING HEAD AND LIQUID DISCHARGING APPARATUS

The present application is based on, and claims priority from JP Application Serial Number 2019-059864, filed Mar. 27, 2019, the disclosure of which is hereby incorporated by reference herein in its entirety.

BACKGROUND

1. Technical Field

The present disclosure relates to a technique of discharging a liquid from a nozzle.

2. Related Art

In related art, a technique for discharging a liquid in a pressure chamber from a nozzle is known (for example, JP-A-2017-13390).

In related art, a technique for causing a larger amount of liquid to be discharged from a nozzle is desired. Here, when a volume of a pressure chamber is simply increased in order to cause a larger amount of liquid to be discharged from a nozzle, rigidity of the pressure chamber is lowered. There is a case where, due to the lowering of the rigidity of the pressure chamber, a transmission of a pressure from the pressure chamber to the liquid is weakened thereby lowering a discharge efficiency of discharging a liquid from a pressure chamber to a nozzle. Further, a resonance frequency of a piezoelectric element and a pressure chamber is lowered due to lowering of rigidity of the pressure chamber. By this, there is a case where a pressure responsiveness of the pressure chamber is lowered.

SUMMARY

According to one aspect of the present disclosure, there is provided a liquid discharging head. The liquid discharging head includes: a nozzle discharging a liquid; a chamber plate having a plurality of pressure chambers, drive elements provided in correspondence with each pressure chamber, and a plurality of lead electrodes for supplying electric signals to the drive elements; and a circuit substrate having terminals coupled to the lead electrodes, where the plurality of pressure chambers include a first pressure chamber and a second pressure chamber, the chamber plate includes a first pressure chamber and a second pressure chamber commonly communicating with one nozzle and a first segment electrode and a second segment electrode constituting the drive element, the first segment electrode being formed so as to overlap the first pressure chamber and not to overlap the second pressure chamber in plan view, and the second segment electrode being formed so as to overlap the second pressure chamber and not to overlap the first pressure chamber in plan view, and the first segment electrode and the second segment electrode are coupled to one common lead electrode.

DESCRIPTION OF EXEMPLARY EMBODIMENTS

A. First Embodiment

Figure 1:
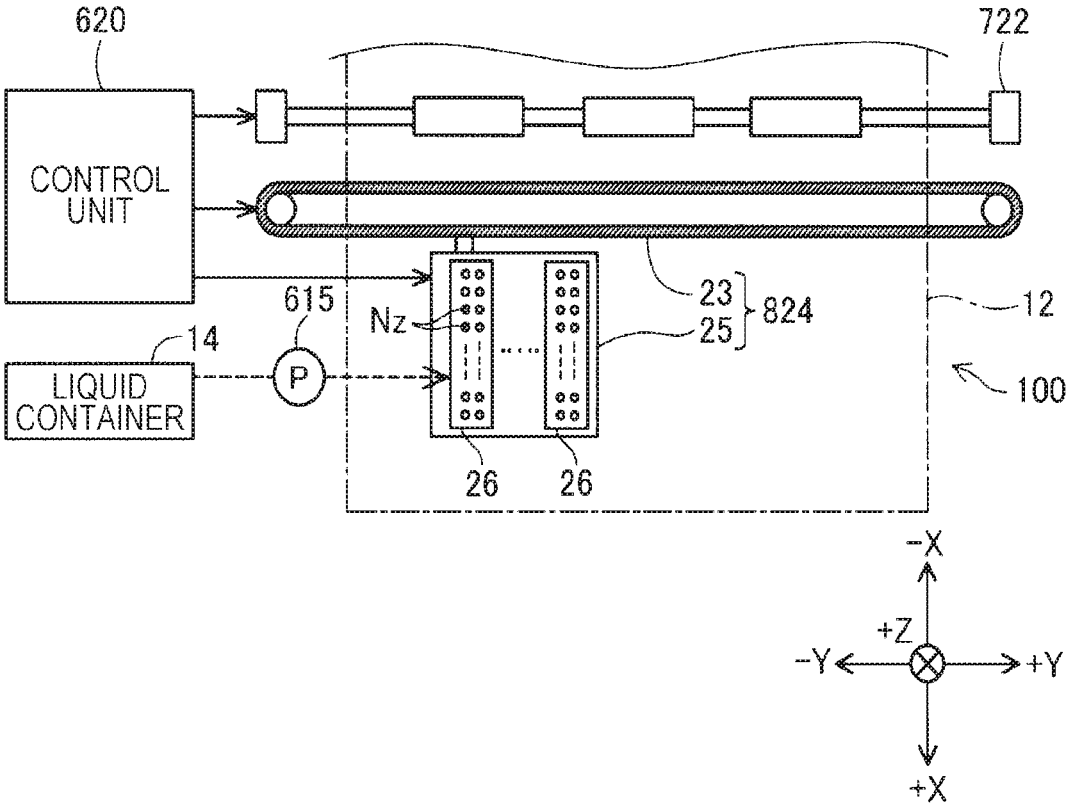
FIG. 1 is an explanatory diagram schematically showing a configuration of a liquid discharging apparatus according to a first embodiment.

FIG. 1 is an explanatory diagram schematically showing a configuration of a liquid discharging apparatus 100 according to a first embodiment of the disclosure. The liquid discharging apparatus 100 is an ink jet type printer that discharges ink droplets as an example of a liquid to a medium 12 to perform printing. As the medium 12, an object to be printed of any material such as a resin film and cloth can be adopted in addition to printing paper. In each drawing of FIG. 1 and the subsequent drawings, a nozzle row direction is referred to as a first axis direction X, a direction along an ink discharging direction from a nozzle Nz is referred to as a third axis direction Z, and a direction orthogonal to the first axis direction X and the third axis direction Z is referred to as a second axis direction Y among the first axis direction X, the second axis direction Y, and the third axis direction Z orthogonal to each other. The ink discharging direction may be parallel to a vertical direction, or may be a direction intersecting the vertical direction. A main scanning direction along a transport direction of a liquid discharging head 26 is the second axis direction Y, and a sub-scanning direction as a feeding direction of the medium 12 is the first axis direction X. In the following description, for convenience of the explanation, the main scanning direction is referred to as a printing direction as appropriate. Further, when the direction is specified, positive and negative symbols are used together in a direction notation with a positive direction set to "+" and a negative direction set to "−". The liquid discharging apparatus 100 may be a so-called line printer in which a medium transport direction (sub-scanning direction) matches a transport direction (main scanning direction) of the liquid discharging head 26.

The liquid discharging apparatus 100 includes a liquid container 14, a flow mechanism 615, a transport mechanism 722 for sending out the medium 12, a control unit 620, a head moving mechanism 824, and a liquid discharging head 26. The liquid container 14 individually stores a plurality of kinds of inks discharged from the liquid discharging head 26. As the liquid container 14, a bag-shaped liquid pack formed of a flexible film, a liquid tank capable of replenishing a liquid, or the like can be used. The flow mechanism 615 is provided in the middle of a flow path coupling the liquid container 14 and the liquid discharging head 26. The flow mechanism 615 is a pump and supplies a liquid from the liquid container 14 to the liquid discharging head 26.

The liquid discharging head 26 has a plurality of nozzles Nz for discharging a liquid. The nozzles Nz constitute a nozzle row that is arranged side by side along the first axis direction X. In the embodiment, two nozzle rows are used to discharge one kind of liquid. The nozzle Nz has a circular nozzle opening for discharging a liquid. In another embodiment, one nozzle row may be used to discharge one kind of liquid.

The control unit 620 includes a processing circuit such as a central processing unit (CPU) and a field programmable gate array (FPGA) and a storage circuit such as a semiconductor memory, and integrally controls the transport mechanism 722, the head moving mechanism 824, and the liquid discharging head 26. The transport mechanism 722 is operated under control of the control unit 620, and transports the medium 12 along the first axis direction X. That is, the transport mechanism 722 is a mechanism for relatively moving the medium 12 with respect to the liquid discharging head 26.

The head moving mechanism 824 is provided with a transport belt 23 stretched over a printing range of the medium 12 in the first axis direction X and a carriage 25 for accommodating the liquid discharging head 26 and fixing it to the transport belt 23. The head moving mechanism 824 is operated under control of the control unit 620, and causes the liquid discharging head 26 to reciprocate along the main scanning direction together with the carriage 25. When the carriage 25 reciprocates, the carriage 25 is guided by a guide rail (not shown). Further, a head configuration in which the liquid container 14 is mounted on the carriage 25 together with the liquid discharging head 26 may be adopted.

The liquid discharging head 26 is a stacked body in which head constituent materials are stacked in the third axis direction Z. The liquid discharging head 26 is provided with nozzle rows in which rows of the nozzles Nz are arranged along the sub-scanning direction. The liquid discharging head 26 is prepared for each color of liquid stored in the liquid container 14, and discharges the liquid supplied from the liquid container 14 toward the medium 12 from a plurality of nozzles Nz under control of the control unit 620. A desired image or the like is printed on the medium 12 by the liquid discharged from the nozzle Nz during the reciprocation of the liquid discharging head 26. An arrow indicated by a broken line in FIG. 1 schematically represents the movement of ink between the liquid container 14 and the liquid discharging head 26.

Figure 2:
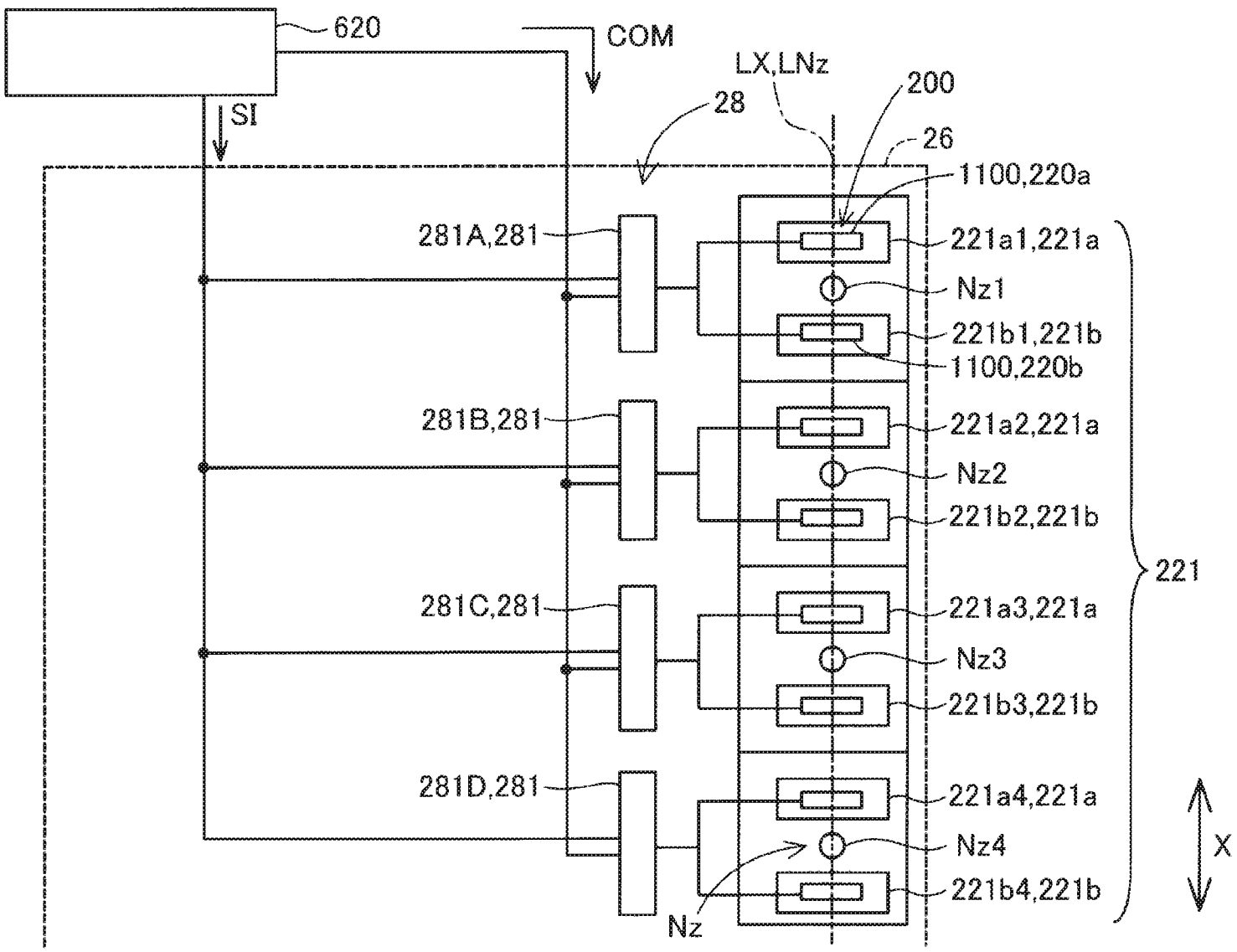
FIG. 2 is a functional configuration diagram of a liquid discharging head.

FIG. 2 is a functional configuration diagram of the liquid discharging head 26. The liquid discharging head 26 includes a nozzle drive circuit 28, a plurality of nozzles Nz constituting a nozzle row LNz, a plurality of pressure chambers 221, and a drive element 1100.

The plurality of pressure chambers 221 communicate with the corresponding nozzles Nz and accommodate the liquid. The plurality of pressure chambers 221 constitute a pressure chamber row LX by being arranged side by side along the first axis direction X. In the plurality of pressure chambers 221, two adjacent pressure chambers 221 commonly communicate with one nozzle Nz. Further, the plurality of nozzles Nz constitute the nozzle row LNz arranged along the first axis direction X. In the example shown in FIG. 2, two pressure chambers 221*a*1 and 221*b*1 are commonly communicated with a nozzle Nz1, and two pressure chambers 221*a*2 and 221*b*2 are commonly communicated with a nozzle Nz2. Further, two pressure chambers 221*a*3 and 221*b*3 are commonly communicated with a nozzle Nz3, and two pressure chambers 221*a*4 and 221*b*4 are commonly communicated with a nozzle Nz4. Here, one pressure chamber 221 commonly communicated with one nozzle Nz is also referred to as a first pressure chamber 221*a*, and the other pressure chamber 221 is also referred to as a second pressure chamber 221*b*.

The drive element 1100 is provided in correspondence with each of the plurality of pressure chambers 221. The drive element 1100 is, for example, a piezo element. The drive element 1100 is electrically coupled to the nozzle drive circuit 28, and generates a pressure change in the liquid in the pressure chamber 221 by a voltage as a drive pulse from the nozzle drive circuit 28 being applied. The drive element 1100 is mounted on a wall that defines the pressure chamber 221.

The plurality of nozzles Nz have nozzle openings in a third axis direction Z, respectively. The liquid in the pressure chamber 221 is pushed out by the drive element 1100 being driven. By this, the liquid is discharged outward from the nozzle opening.

The nozzle drive circuit 28 controls the operation of the drive element 1100. The nozzle drive circuit 28 has a switch circuit 281 for switching between on and off of supply of the drive pulse to the drive element 1100. The switch circuit 281 is provided in correspondence with each nozzle Nz. A switch circuit 281A is used for commonly controlling the driving of two drive elements 1100 provided in correspondence with the pressure chambers 221*a*1 and 221*b*1. A switch circuit 281B is used for commonly controlling the driving of two drivers 220*a* and 220*b* provided in correspondence with the pressure chambers 221*a*2 and 221*b*2. A switch circuit 281C is used for commonly controlling the driving of two drive elements 1100 provided in correspondence with the pressure chambers 221*a*3 and 221*b*3. A switch circuit 281D is used for commonly controlling the driving of two drive elements 1100 provided in correspondence with the pressure chambers 221*a*4 and 221*b*4.

A drive pulse COM and a pulse selection signal SI are supplied to the nozzle drive circuit 28 from the control unit 620. The pulse selection signal SI is a signal for selecting a drive pulse generated according to print data PD and applied to the driver 220 of the drive element 1100. The drive pulse COM is composed of at least one drive pulse. In the embodiment, for example, the drive pulse COM has a discharge pulse that vibrates the drive element 1100 to the extent that the liquid is discharged from the nozzle Nz and a micro vibration pulse that vibrates the liquid in the nozzle Nz to the extent that no liquid is discharged. For example, when the pulse selection signal SI indicates a signal for selecting the discharge pulse, the switch circuit 281 switches between on and off such that the discharge pulse is supplied to the drive element 1100 from the drive pulse COM.

Figure 3:
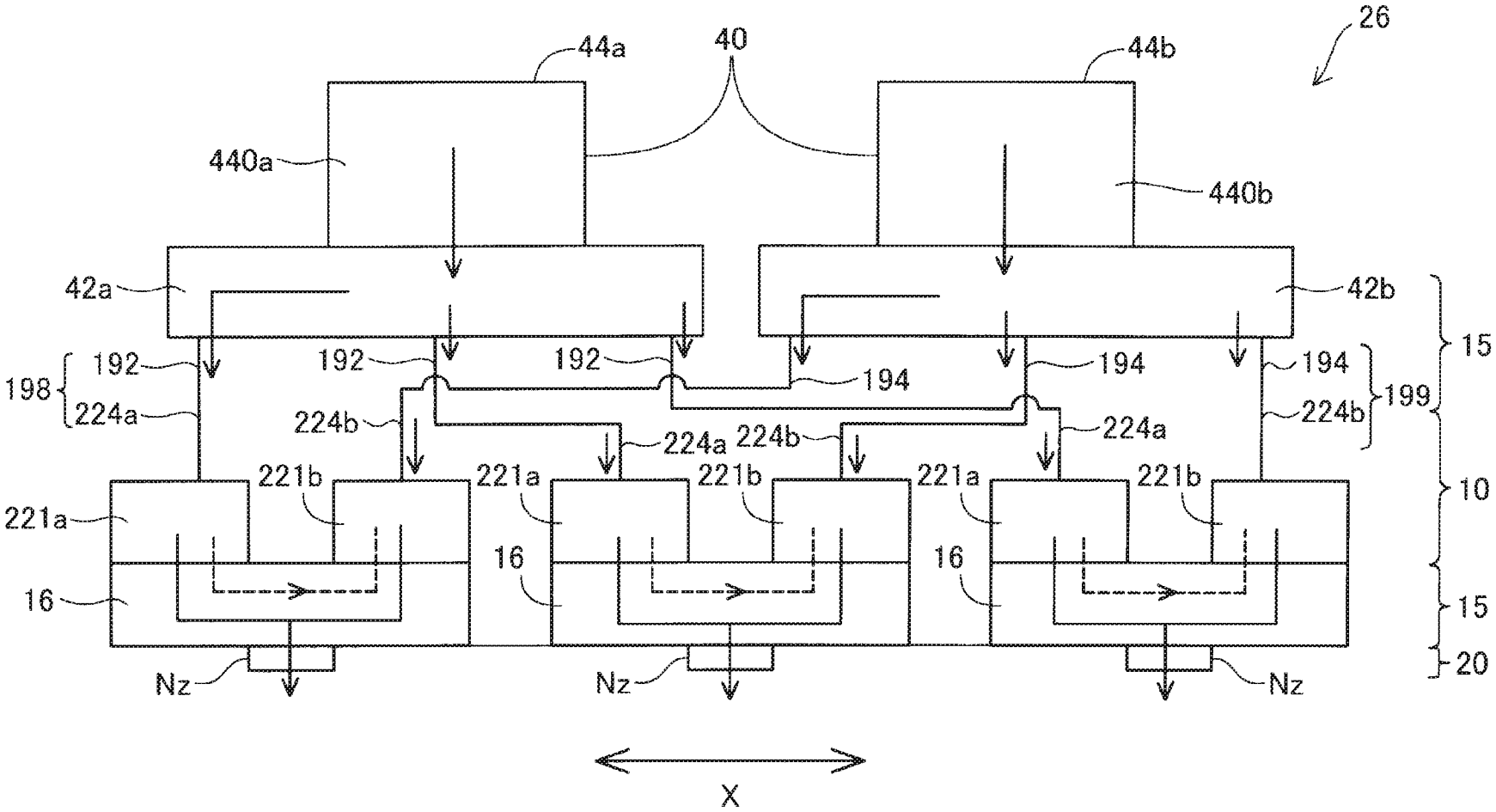
FIG. 3 is a schematic diagram for explaining a flow of liquid in a liquid discharging head.
Figure 4:
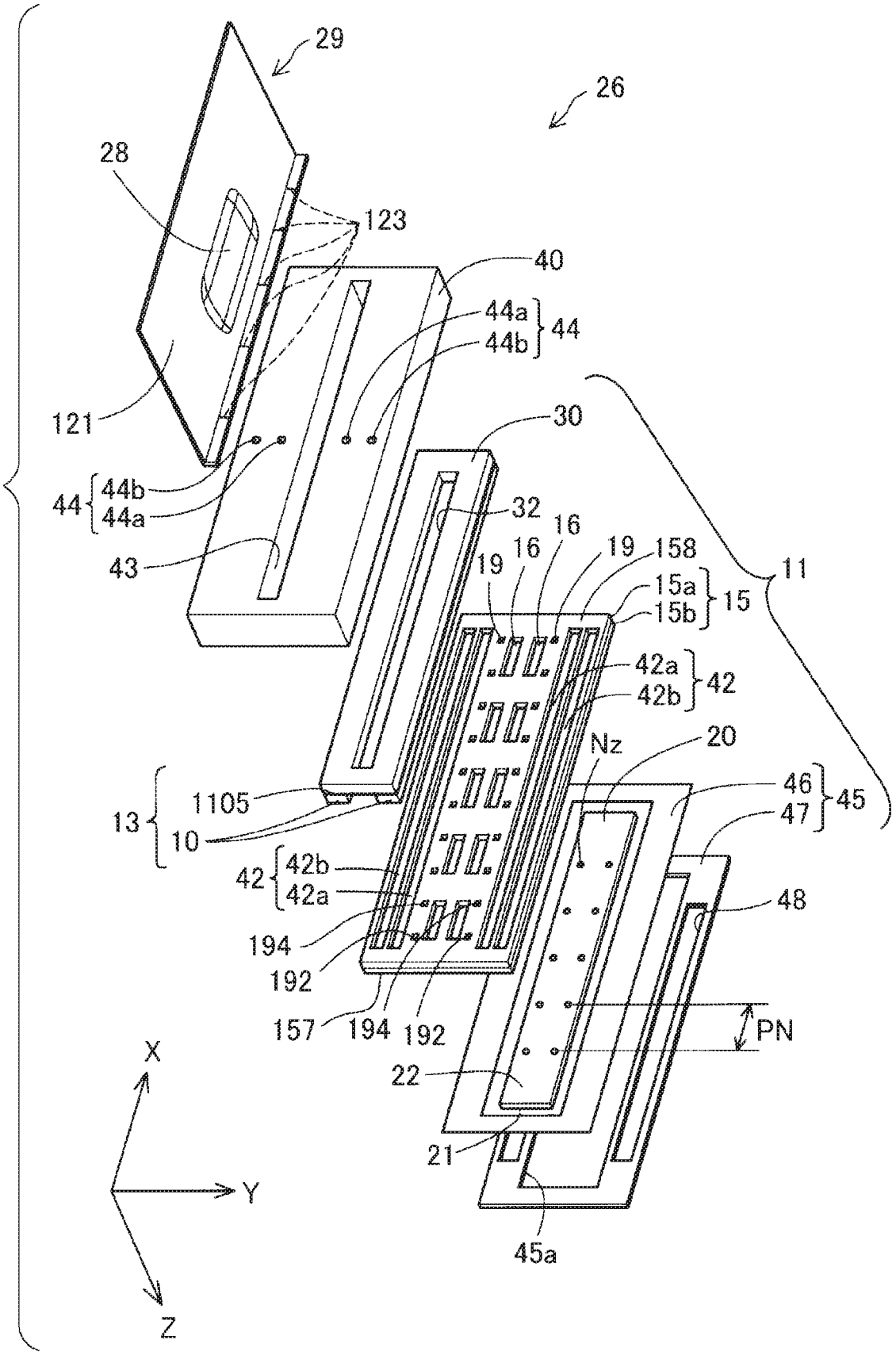
FIG. 4 is an exploded perspective diagram of a liquid discharging head.

FIG. 3 is a schematic diagram for explaining a flow of a liquid in the liquid discharging head 26. FIG. 4 is an exploded perspective diagram of the liquid discharging head 26. The number of nozzles Nz in FIG. 4 is smaller than the actual number for easy understanding. As shown in FIG. 4, the liquid discharging head 26 includes a head main body 11, a case member 40 fixed to one surface side of the head main body 11, and a circuit substrate 29. Further, the head main body 11 according to the embodiment includes a chamber plate 13, a flow path plate 15 provided on one side of the chamber plate 13, a protective substrate 30 provided on a side opposite to the flow path plate 15 with respect to the chamber plate 13, a nozzle plate 20 provided on a side opposite to a flow path forming substrate 10 with respect to the flow path plate 15, and a compliance substrate 45. The flow path plate 15 is also referred to as an intermediate plate 15. The chamber plate 13 is formed by bonding the flow path forming substrate 10 and an actuator substrate 1105.

Before describing each configuration of the liquid discharging head 26, the flow path of the liquid discharging head 26 will be described with reference to FIG. 3. Hereinafter, the description will be made based on the flow direction of the liquid which goes to the nozzle Nz. In FIG. 3, the direction of the flow of the liquid is indicated by the direction of the arrow.

Each nozzle Nz of the liquid discharging head 26 communicates with the liquid supplied to a first introduction hole 44*a* and a second introduction hole 44*b* by the flow mechanism 615. The first introduction hole 44*a* and the second introduction hole 44*b* are formed in the case member 40.

The liquid supplied to the first introduction hole 44*a* flows through a first common liquid chamber 440*a* in the case member 40 to flow into a first reservoir 42*a*. The first reservoir 42*a* commonly communicates with a plurality of the first pressure chambers 221*a*. The first reservoir 42*a* is formed by the flow path plate 15. The liquid in the first reservoir 42*a* sequentially flows through a first individual flow path 192 and a first supply flow path 224*a* to flow into the first pressure chamber 221*a*. A plurality of the first individual flow paths 192 and a plurality of the first supply flow paths 224*a* are provided in correspondence with respective first pressure chambers 221*a*. The first individual flow path 192 is formed by the flow path plate 15. The first supply flow path 224*a* and the first pressure chamber 221*a* are formed by the flow path forming substrate 10. The first individual flow path 192 and the first supply flow path 224*a* that couple the first pressure chamber 221*a* and the first reservoir 42*a* constitute a first coupling flow path 198.

The liquid in the first pressure chamber 221*a* flows through a communication flow path 16 to reach the nozzle Nz. The communication flow path 16 is formed by the flow path plate 15. The nozzle Nz is formed by the nozzle plate 20.

The liquid supplied to the second introduction hole 44*b* flows through a second common liquid chamber 440*b* in the case member 40 and flows into a second reservoir 42*b*. The second reservoir 42*b* commonly communicates with a plurality of the second pressure chambers 221*b*. The second reservoir 42*b* is formed by the flow path plate 15. The liquid in the second reservoir 42*b* sequentially flows through a second individual flow path 194 and a second supply flow path 224*b* to flow into the second pressure chamber 221*b*. A plurality of the second individual flow paths 194 and a plurality of the second supply flow paths 224*b* are provided in correspondence with respective second pressure chambers 221*b*. The second individual flow path 194 is formed by the flow path plate 15. The second supply flow path 224*b* and the second pressure chamber 221*b* are formed by the flow path forming substrate 10. The second individual flow path 194 and the second supply flow path 224*b* that couple the second pressure chamber 221*b* and the second reservoir 42*b* constitute a second coupling flow path 199.

The liquid in the second pressure chamber 221*b* flows through a communication flow path 16 to reach the nozzle Nz. Thus, the communication flow path 16 is a flow path through which the liquid of the first pressure chamber 221*a* and the liquid of the second pressure chamber 221*b* that communicate with one nozzle Nz are joined. When the first supply flow path 224*a* and the second supply flow path 224*b* are used without distinguishing them, the supply flow path 224 is used.

Figure 5:
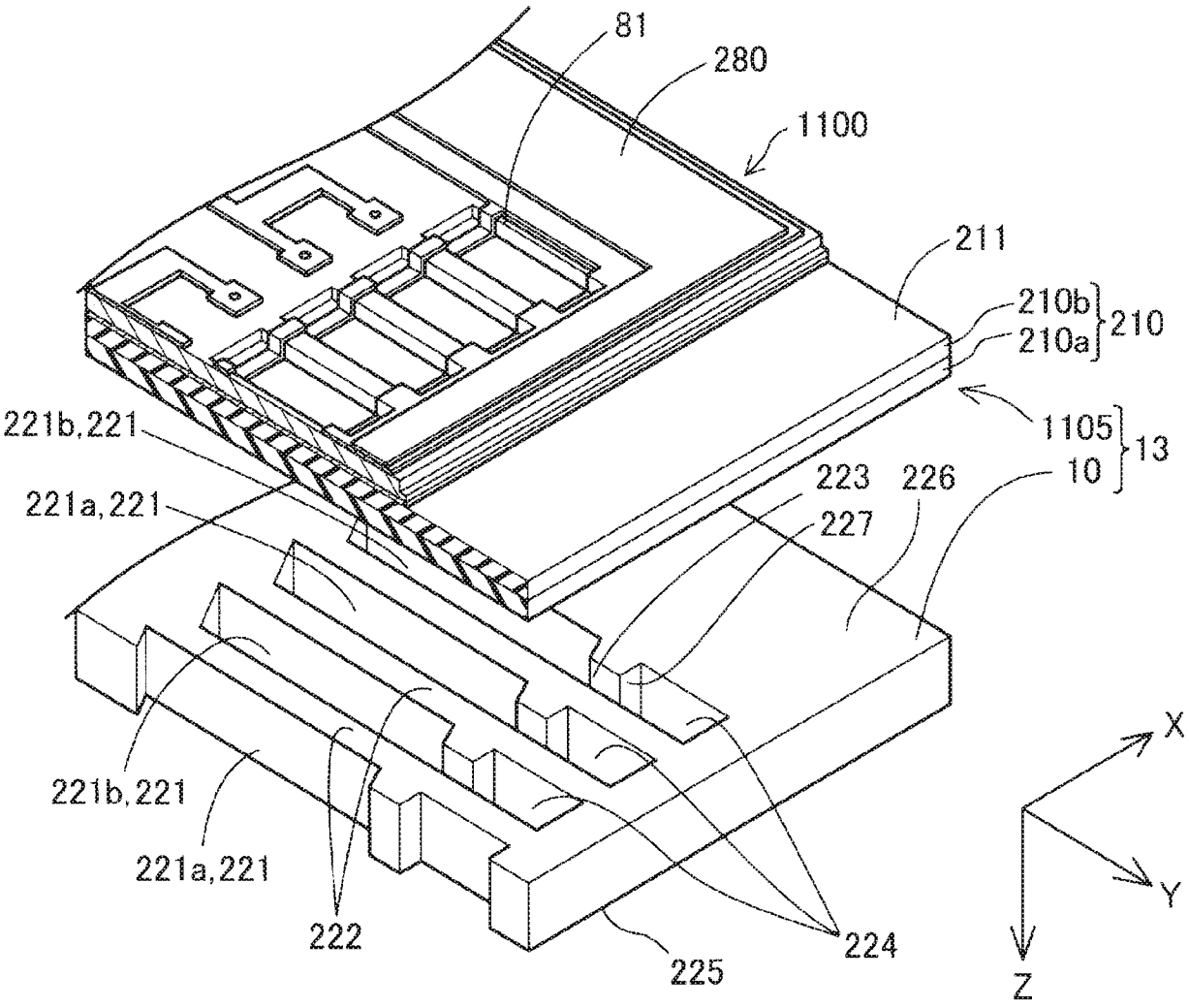
FIG. 5 is a perspective diagram showing a part of an actuator substrate and a flow path forming substrate.
Figure 6:
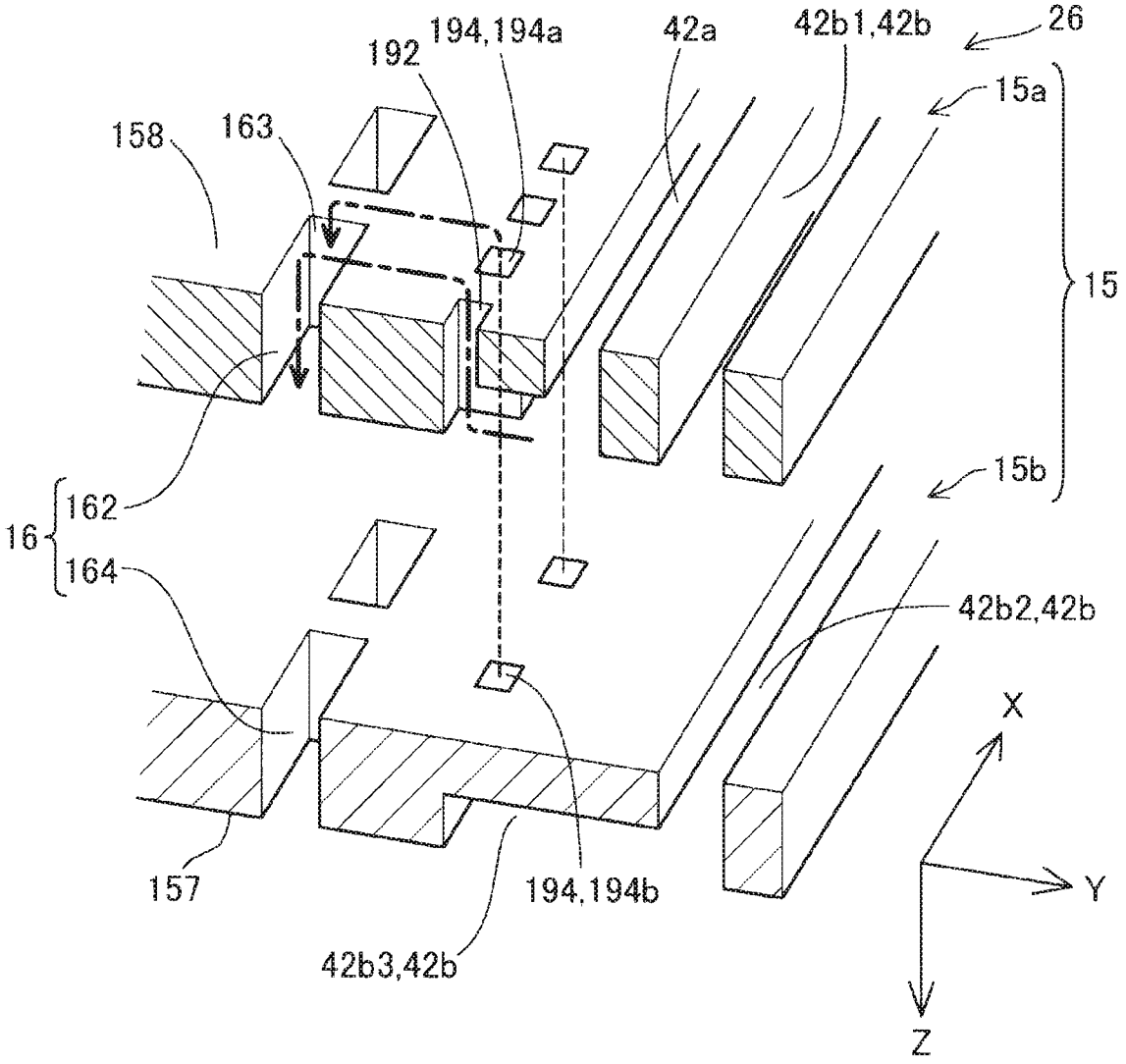
FIG. 6 is an exploded perspective diagram showing a part of a flow path plate.
Figure 7:
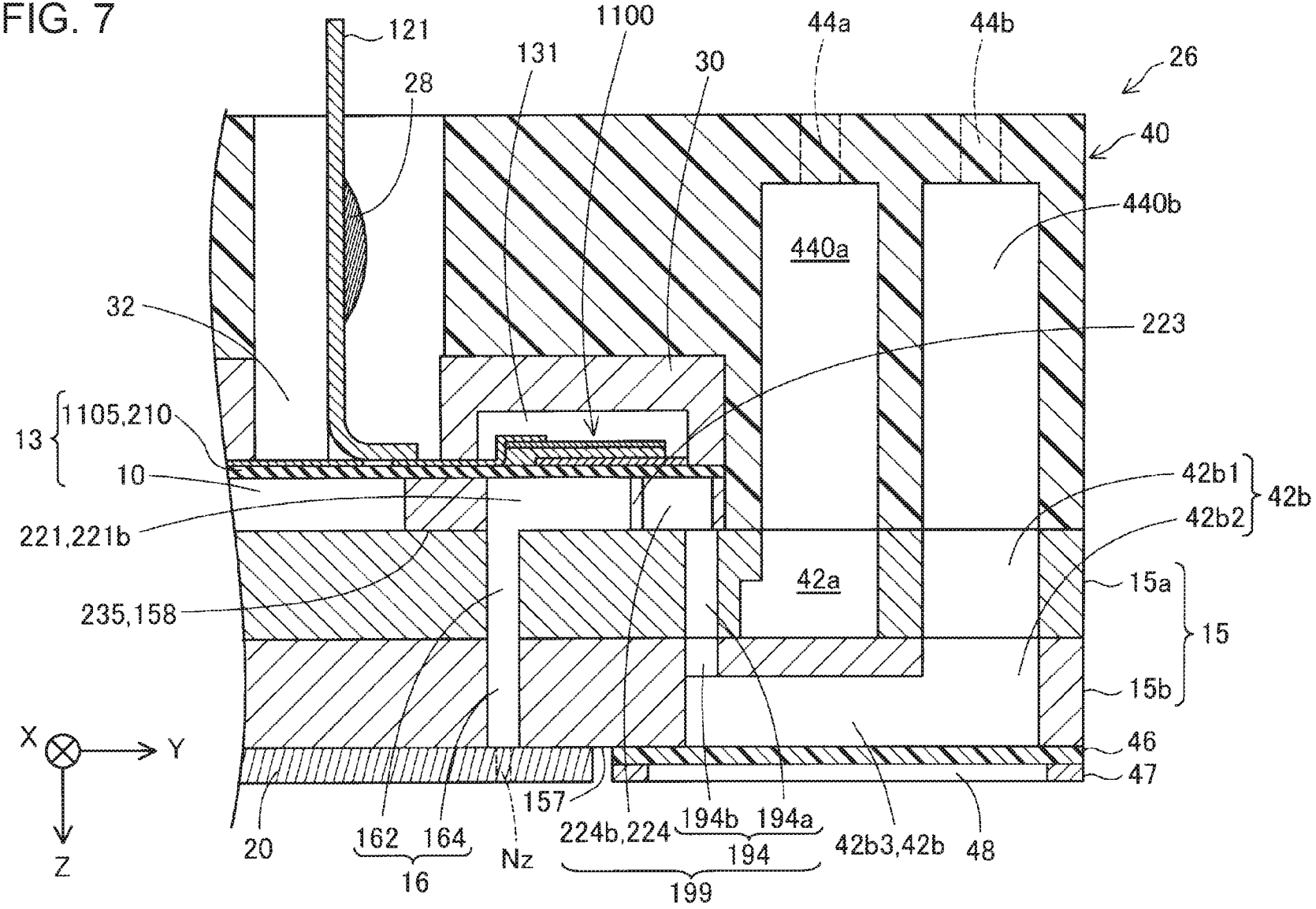
FIG. 7 is a cut diagram of a first portion of a liquid discharging head cut along a YZ plane.
Figure 8:
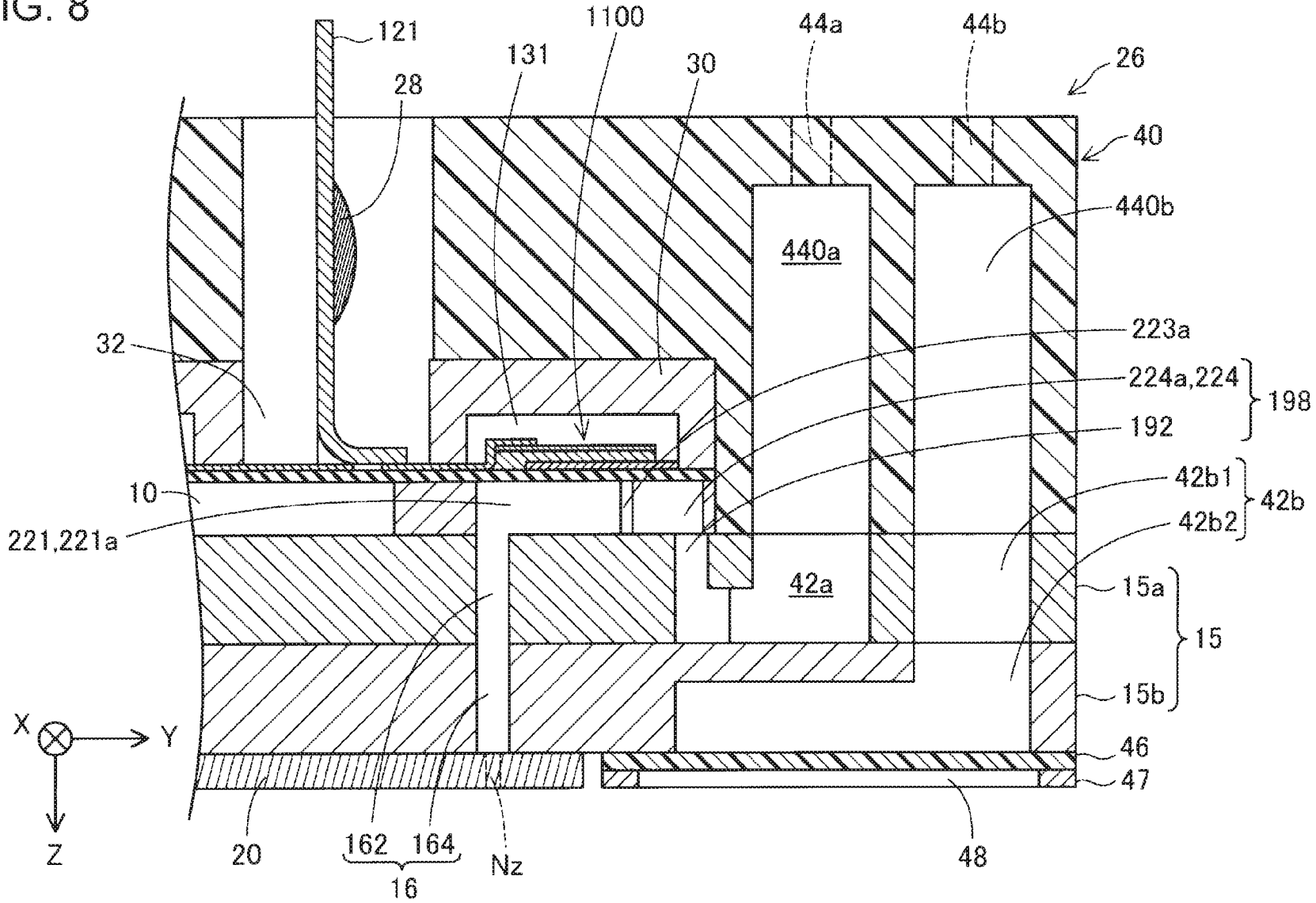
FIG. 8 is a cut diagram of a second portion of a liquid discharging head cut along a YZ plane.

Next, in addition to FIG. 4, a detailed configuration of the liquid discharging head 26 will be described with reference to FIGS. 5 to 8. FIG. 5 is a perspective diagram showing a part of the actuator substrate 1105 and the flow path forming substrate 10. FIG. 6 is an exploded perspective diagram showing a part of the flow path plate 15. FIG. 7 is a cut diagram of a first portion of the liquid discharging head 26 cut along the YZ plane parallel to the second axis direction Y and the third axis direction Z. FIG. 8 is a cut diagram of a second portion of the liquid discharging head 26 cut along the YZ plane parallel to the second axis direction Y and the third axis direction Z. FIGS. 7 and 8 illustrate each element corresponding to one nozzle row of two nozzle rows shown in FIG. 4, but each element corresponding to the other nozzle row has the same configuration.

As shown in FIG. 4, the case member 40 has a rectangular shape which is substantially the same as that of the flow path plate 15 in plan view. The case member 40 can be formed by using a synthetic resin, metal, or the like. In the embodiment, the case member 40 is formed by using a synthetic resin which can be mass-produced at a low cost. The case member 40 is bonded to the actuator substrate 1105 and the flow path plate 15. The case member 40 has a recess having a depth for accommodating the flow path forming substrate 10 and the actuator substrate 1105. As shown in FIG. 7, an opening surface on the nozzle plate 20 side of the recess is sealed by the flow path plate 15 in a state where the flow path forming substrate 10 or the like is accommodated in the recess of the case member 40.

As shown in FIG. 4, two first introduction holes 44*a* and two second introduction holes 44*b* are formed on the surface of the case member 40 opposite to the side where the nozzle plate 20 is located. When the first introduction hole 44*a* and the second introduction hole 44*b* are used without distinguishing them, also referred to as the introduction hole 44. As shown in FIG. 7, the first common liquid chamber 440*a* and the second common liquid chamber 440*b* extending along the third axis direction Z which is a direction along the liquid discharge direction from the nozzle Nz are formed inside the case member 40.

As shown in FIG. 4, the compliance substrate 45 has a flexible member 46 and a fixed substrate 47. The flexible member 46 and the fixed substrate 47 are bonded by an adhesive.

The fixed substrate 47 is formed of a material such as stainless steel harder than the flexible member 46. The fixed substrate 47 is a frame-like member, and the nozzle plate 20 is disposed inside the frame. The fixed substrate 47 seals an opening on the nozzle plate 20 side of the second reservoir 42*b* formed on the flow path plate 15.

The flexible member 46 is formed of a flexible material. The flexible member 46 has a frame shape, and the nozzle plate 20 is disposed inside the frame. The flexible member 46 is a film-like thin film having flexibility, for example, a thin film formed of polyphenylene sulfide (PPS) or aromatic polyamide and having a thickness of 20 μm or less. The flexible member 46 is a planar vibration absorbing body forming one wall of the second reservoir 42*b*. The flexible member 46 functions to absorb the pressure change in the second reservoir 42*b*.

As shown in FIG. 4, two flow path forming substrates 10 are provided at intervals in the second axis direction Y. One of the two flow path forming substrates 10 accommodates the liquid to be supplied to the nozzle Nz of one nozzle row, and the other accommodates the liquid to be supplied to the nozzle Nz of the other nozzle row. For the base material of the flow path forming substrate 10, metal such as stainless steel (SUS) or nickel (Ni), a ceramic material represented by zirconia ($ZrO_2$) or alumina ($Al_2O_3$), a glass ceramic material, a magnesium oxide (MgO), and an oxide such as lanthanum aluminate ($LaAlO_3$) can be used. In the embodiment, the base material of the flow path forming substrate 10 is a silicon single crystal.

As shown in FIG. 5, the flow path forming substrate 10 is a plate-like member. The flow path forming substrate 10 includes a surface 226 facing the actuator substrate 1105 and a first surface 225 facing the flow path plate 15. In the flow path forming substrate 10, a supply flow path 224 and a pressure chamber 221 are formed by a hole penetrating from a first surface 225 to a surface 226. The supply flow path 224 and the pressure chamber 221 may be formed as a recess that opens at least on the first surface 225 side. That is, the supply flow path 224 and the pressure chamber 221 may be formed at least on the first surface 225 side.

The plurality of pressure chambers 221 are provided side by side in the first axis direction X. A plurality of the supply flow paths 224 are provided side by side in the first axis direction. The pressure chamber 221 and the supply flow path 224 are formed by anisotropic etching the first surface 225 side of the flow path forming substrate 10. A partition wall 222 is provided between the first pressure chamber 221*a* and the second pressure chamber 221*b* adjacent to each other and between the first supply flow path 224*a* and the second supply flow path 224*b* adjacent to each other.

The actuator substrate 1105 is bonded to the surface 226. By this, the opening on the surface 226 side of the pressure chamber 221 and the supply flow path 224 is sealed by the actuator substrate 1105.

As shown in FIG. 5, a protruding portion 227 protruding from one surface toward the other surface opposed thereto, that defines a through-hole, is provided in the supply flow path 224. Due to the protruding portion 227, a flow path width of a downstream end 223 of the protruding portion 227 is narrower than a flow path width of the other portions. The downstream end 223 is coupled to the pressure chamber 221.

The actuator substrate 1105 includes a vibration plate 210, a drive element 1100, and a protective layer 280. The vibration plate 210 includes an elastic layer 210*a* and an insulating layer 210*b* disposed on the elastic layer 210*a*. The vibration plate 210 is formed as follows, for example. That is, the elastic layer 210*a* of the vibration plate 210 is formed on the surface 226 of the flow path forming substrate 10 before the pressure chamber 221 or the supply flow path 224 is formed, by a sputtering method or the like. Next, the insulating layer 210*b* is formed on the elastic layer 210*a* by a sputtering method or the like. Zirconium oxide may be used for the elastic layer 210*a*, and silicon oxide may be used for the insulating layer 210*b*.

The drive element 1100 is disposed on the surface 211 of the vibration plate 210. The drive element 1100 includes a piezoelectric layer having piezoelectric characteristics and a common electrode and a segment electrode arranged so as to sandwich both surfaces of the piezoelectric layer. When the drive element 1100 is driven, a bias voltage serving as a reference potential is supplied to the common electrode. On the other hand, when the drive element 1100 is driven, a drive pulse selected from the drive pulses COM is supplied to the segment electrode when the switch circuit 281 is turned on.

The protective layer 280 is disposed on the drive element 1100 and covers a part of the drive element 1100. The protective layer 280 has an insulating property and may be formed of at least one of an oxide material, a nitride material, a photosensitive resin material, and an organic-inorganic hybrid material. For example, the protective film 80 may be formed of an oxide material such as aluminum oxide ($Al_2O_3$) and silicon oxide ($SiO_2$). The protective layer 280 may have an opening 81 that exposes a part of the common electrode that is an upper electrode described later. In plan view, at least a part of the opening 81 is formed at a position overlapping the plurality of pressure chambers 221.

The actuator substrate 1105 has a lead electrode coupled to the common electrode and a lead electrode coupled to the segment electrode which is a lower electrode. Details of the actuator substrate 1105 will be described later.

As shown in FIGS. 4 and 6, the flow path plate 15 includes a plate first surface 157 facing the nozzle plate 20 and a plate second surface 158 as a second surface facing the flow path forming substrate 10. The flow path plate 15 is rectangular in plan view and has an area larger than that of the flow path forming substrate 10. As shown in FIG. 7, the plate second surface 158 is bonded to the first surface 225 of the flow path forming substrate 10.

As shown in FIG. 6, the flow path plate 15 is formed by stacking two plates of a first flow path plate 15*a* and a second flow path plate 15*b*. The first flow path plate 15*a* is positioned on the flow path forming substrate 10 side and has the plate second surface 158. The second flow path plate 15*b* is positioned on the nozzle plate 20 side and has the plate first surface 157. For the base material of each of the first flow path plate 15*a* and the second flow path plate 15*b*, metal such as stainless steel and nickel, or ceramic such as zirconium can be used. The flow path plate 15 is preferably formed of a material having the same linear expansion coefficient as that of the flow path forming substrate 10. That is, when the linear expansion coefficients of the flow path plate 15 and the flow path forming substrate 10 are greatly different, when heated or cooled, warping occurs due to the difference in the linear expansion coefficient between the flow path forming substrate 10 and the flow path plate 15. In the embodiment, the same base material as the base material of the flow path forming substrate 10, that is, a silicon single crystal substrate is used as the base material of the flow path plate 15. By this, since the linear expansion coefficients of the flow path forming substrate 10 and the flow path plate 15 can be made substantially the same, occurrence of warpage or cracks due to heat, peeling, and the like can be suppressed.

As shown in FIG. 4, the flow path plate 15 has a first reservoir 42*a*, a second reservoir 42*b*, a first individual flow path 192, a second individual flow path 194, and a communication flow path 16.

As shown in FIG. 6, the first reservoir 42*a* is formed by a through-hole penetrating the first flow path plate 15*a* in the Z-axis direction which is a plan view direction. The first reservoir 42*a* extends along the first axis direction X. As shown in FIGS. 4 and 8, the first reservoir 42*a* commonly communicates with the plurality of pressure chambers 221 via a plurality of the first individual flow paths 192. In the embodiment, the first reservoir 42*a* is coupled to the plurality of first pressure chambers 221*a* through the plurality of first individual flow paths 192, thereby commonly communicating with the plurality of first pressure chambers 221*a*.

As shown in FIG. 6, the second reservoir 42*b* is formed by a first opening 42*b*1 and a second opening 42*b*2 penetrating the first flow path plate 15*a* and the second flow path plate 15*b* in the third axis direction Z that is the plan view direction, and an opening 42*b*3 extending from the second opening 42*b*2 toward the second individual flow path 194 side in the second axis direction Y. The second reservoir 42*b* extends along the first axis direction X. The first opening 42*b*1 and the second opening 42*b*2 are overlapped in the plan view direction. Each of the first opening 42*b*1 and the second opening 42*b*2 has a rectangular shape having the same size in plan view. The second reservoir 42*b* commonly communicates with the plurality of pressure chambers 221 through the plurality of second individual flow paths 194. In the embodiment, the second reservoir 42*b* is coupled to the plurality of second pressure chambers 221*b* through the plurality of second individual flow paths 194, thereby commonly communicating with the plurality of second pressure chambers 221*b*.

As shown in FIG. 6, the first individual flow path 192 is a through-hole formed in the first flow path plate 15*a* penetrating in the third axis direction Z which is the plan view direction. The first individual flow path 192 is rectangular in plan view. As shown in FIG. 8, the first individual flow path 192 is coupled to the downstream end of the first reservoir 42*a*. The first individual flow path 192 couples the first reservoir 42*a* to the first supply flow path 224*a*.

As shown in FIG. 6, the second individual flow path 194 is formed by a first plate through-hole 194*a* penetrating the first flow path plate 15*a* in the third axis direction Z which is the plan view direction, and a second plate through-hole 194*b* penetrating the second flow path plate 15*b* in the third axis direction Z which is the plan view direction. The first plate through-hole 194*a* and the second plate through-hole 194*b* are overlapped in the plan view direction. Each of the first plate through-hole 194*a* and the second plate through-hole 194*b* has a rectangular shape having the same size in plan view. As shown in FIG. 7, the second individual flow path 194 is coupled to the downstream end of the second reservoir 42*b*. The second individual flow path 194 couples the second reservoir 42*b* to the second supply flow path 224*b*.

As shown in FIG. 6, the communication flow path 16 is formed by a first through-hole flow path 162 penetrating the first flow path plate 15*a* in the third axis direction Z which is a plan view, and a second through-hole flow path 164 penetrating the second flow path plate 15*b* in the third axis direction Z which is the plan view direction. A plurality of communication flow paths 16 are provided along the first axis direction X. The first through-hole flow path 162 and the second through-hole flow path 164 have a rectangular shape with the same size in plan view and are overlapped in plan view. The communication flow path 16 is coupled to one first individual flow path 192 and one second individual flow path 194 in common. One communication flow path 16 is provided for a set of the first pressure chamber 221*a* and the second pressure chamber 221*b* adjacent to each other. That is, one communication flow path 16 causes the first pressure chamber 221*a* and the second pressure chamber 221*b* adjacent to each other to communicate with one nozzle Nz. An opening 163 of the communication flow path 16 is formed on the plate second surface 158 of the flow path plate 15. The respective liquids in the first pressure chamber 221*a* and the second pressure chamber 221*b* flow into the communication flow path 16 through the opening 163.

As shown in FIG. 7, the protective substrate 30 has a recess 131 as a space for protecting the drive element 1100. The protective substrate 30 is bonded to the case member 40. The protective substrate 30 has a through-hole 32. A wiring member 121 is inserted into the through-hole 32. For example, as a material of the case member 40, resin or metal can be used. The case member 40 can be mass-produced at a low cost by molding a resin material.

As shown in FIG. 4, the nozzle plate 20 is a plate-like member and has a first surface 21 on the side opposite to the side where the flow path plate 15 is positioned, and a second surface 22 on the flow path plate 15 side. The nozzle plate 20 has a plurality of nozzles Nz. The plurality of nozzles Nz form two nozzle rows arranged along the first axis direction X. The nozzle Nz is formed by a through-hole penetrating the nozzle plate 20 in the third axis direction Z which is the plan view direction. The nozzle Nz is circular in plan view. One nozzle Nz commonly communicates with one first pressure chamber 221*a* and one second pressure chamber 221*b*.

The circuit substrate 29 has the wiring member 121 and the nozzle drive circuit 28. The wiring member 121 is a member for supplying an electric signal to the drive element 1100. The wiring member 121 is electrically coupled to a plurality of drive elements 1100 and a control unit 620. As the wiring member 121, a flexible sheet-like material such as a COF substrate can be used. The nozzle drive circuit 28 may not be provided in the wiring member 121. That is, the wiring member 121 is not limited to the COF substrate, and may be an FFC, an FPC, or the like. The wiring member 121 is electrically coupled to the drive element 1100 by the lead electrode described later. Further, the wiring member 121 has a plurality of terminals 123 electrically coupled to the plurality of lead electrodes.

The flow path forming substrate 10 and the nozzle plate 20 constituting the head main body 11 are single plate-like members, but may be formed by stacking a plurality of plates. Further, although the above-described flow path plate 15 is formed by stacking the first flow path plate 15*a* and the second flow path plate 15*b*, but may be formed by a single plate or by stacking three or more plates.

Figure 9:
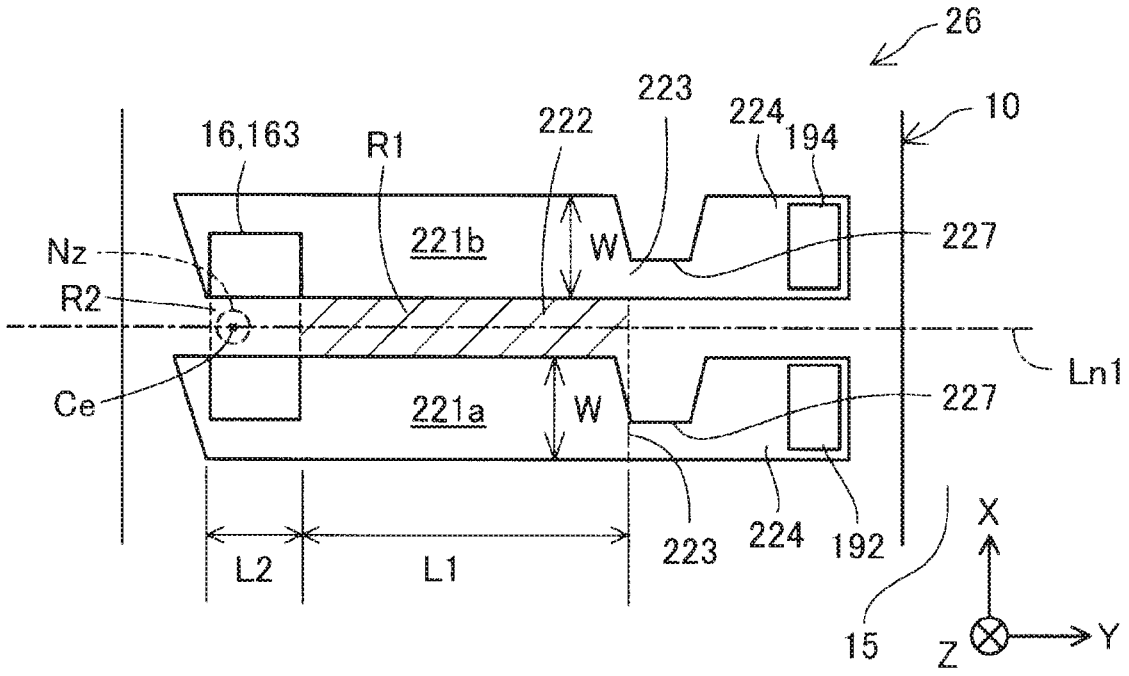
FIG. 9 is a diagram for further explaining each configuration of a liquid discharging head.

FIG. 9 is a diagram for further explaining each configuration of the liquid discharging head 26. FIG. 9 is a schematic diagram when the flow path forming substrate 10 and the flow path plate 15 are viewed in plan from the minus side in the third axis direction Z. A first region R1 of the partition wall 222 between the first pressure chamber 221*a* and the second pressure chamber 221*b* adjacent to each other is bonded to the plate second surface 158 of the flow path plate 15. By this, the movement of the first region R1 is constrained by the flow path plate 15. In FIG. 9, single hatching is applied to the first region R1. Further, a second region R2 of the partition wall 222 overlaps the opening 163 of one communication flow path 16 in plan view. That is, the second region R2 is a region not bonded to the plate second surface 158. When the partition wall 222 is bonded to the second surface 158 to be constrained, the partition wall 222 is hardly deformed in the constrained region, such that compliance of the pressure chamber 221 itself becomes small to improve discharge efficiency of the liquid from the nozzle Nz. The compliance is a physical quantity that represents the ease of deformation against pressure. The reasons for this effect are as follows. That is, when the compliance of the pressure chamber 221 is further reduced, the proportion of the pressure generated in the pressure chamber 221, that is absorbed by the deformation of the pressure chamber 221 itself is reduced, such that the liquid flow toward the nozzle Nz is relatively increased. On the other hand, when the partition wall 222 overlaps the opening 163 of the communication flow path 16, the inertance of the communication flow path 16 can be reduced. The inertance is a parameter for determining the instantaneous ease of the liquid flow. If the inertance is reduced, the liquid flows more easily. The inertance is determined by the structure of the flow path including the length and the cross section of the flow path. The inertance increases as the flow path cross-sectional area decreases. Thus, by forming the opening 163 of the communication flow path 16 so as to overlap the second region R2 of the partition wall 222, the flow path cross-sectional area of the communication flow path 16 can be increased. By this, since the inertance of the communication flow path 16 can be reduced, the liquid can be smoothly circulated from the pressure chamber 221 to the nozzle Nz through the communication flow path 16. Accordingly, it brings the effect of improving the discharge efficiency of the liquid from the nozzle Nz. That is, the selection, of whether the partition wall 222 is constrained by the second surface 158 to be the first region R1 or the partition wall 222 is overlapped with the opening 163 of the communication flow path 16 to be the second region R2, brings about an improvement effect different in principle with respect to the discharge efficiency from the nozzle Nz, and this configuration brings about a better effect of improving discharge efficiency by combining both regions.

The partition wall 222 extends along the second axis direction Y. Here, a length L2 of the second region R2 in the second axis direction is preferably equal to or smaller than half of a length L1 in the second axis direction Y of the first region R1. When the length L2 is larger than this, the first region R1 becomes relatively small, and the influence of lowering the discharge efficiency due to the increase of the compliance of the pressure chamber 221 may become significant. In other words, the effect of improving the above-described discharge efficiency becomes particularly excellent by doing so.

The length L2 of the second region R2 in the second axis direction Y is preferably equal to or greater than a width W of each of the first pressure chamber 221*a* and the second pressure chamber 221*b* in first axis direction X. This is because if the length L2 is smaller than this, the effect of reducing the inertance of the communication flow path 16 may not be sufficiently obtained. In other words, the effect of improving the above-described discharge efficiency becomes particularly excellent by doing so.

Further, the first pressure chamber 221*a* and the second pressure chamber 221*b* adjacent to each other are formed substantially in line symmetry with respect to a first virtual line Ln1 in plan view, and the communication flow path 16 is preferably formed substantially in line symmetry with respect to the first virtual line Ln1. The first virtual line Ln1 is positioned between the first pressure chamber 221*a* and the second pressure chamber 221*b* adjacent to each other in the first axis direction X. In this way, a deviation in magnitude between the pressure wave transmitted from the first pressure chamber 221*a* to the communication flow path 16 and the pressure wave transmitted from the second pressure chamber 221*b* to the communication flow path 16 can be suppressed. By this, the occurrence of deviation between the amount of the liquid flowing into the communication flow path 16 from the first pressure chamber 221*a* and the amount of the liquid flowing into the communication flow path 16 from the second pressure chamber 221*b* can be suppressed.

In the disclosure, "substantially in line symmetry" means not only perfect line symmetry but also asymmetry that may occur in production. For example, when the pressure chamber 221 is formed by anisotropic etching, a step or unevenness is generated on the side wall of the pressure chamber 221 or the side wall is inclined as shown in FIG. 9, such that the pressure chamber 221 cannot be formed into a perfect rectangular shape. Further, since the protruding portion 227 is formed, the side wall of the pressure chamber 221 near the protruding portion 227 may be inclined. Further, even when the communication flow path 16 is formed by anisotropic etching, a step or unevenness may be generated on the side wall of the communication flow path 16. Accordingly, even when the first pressure chamber 221*a* and the second pressure chamber 221*b* are manufactured or the communication flow path 16 is manufactured so as to be line-symmetrical to the first virtual line Ln1, it may be slightly asymmetric actually. In the disclosure, even in this case, it is regarded as "substantially in line symmetry".

As shown in FIG. 9, the nozzle Nz communicating with the first pressure chamber 221*a* and the second pressure chamber 221*b* adjacent to each other is preferably disposed so as to overlap the first virtual line Ln1 in plan view. In this way, a deviation in magnitude between the pressure wave transmitted from the first pressure chamber 221*a* to the nozzle Nz and the pressure wave transmitted from the second pressure chamber 221*b* to the nozzle Nz can be suppressed. By this, the occurrence of deviation between the amount of the liquid flowing into the nozzle Nz from the first pressure chamber 221*a* through the communication flow path 16 and the amount of the liquid flowing into the nozzle Nz from the second pressure chamber 221*b* through the communication flow path 16 can be suppressed. In the embodiment, the center Ce of the nozzle Nz overlaps the first virtual line Ln in plan view.

Figure 10:
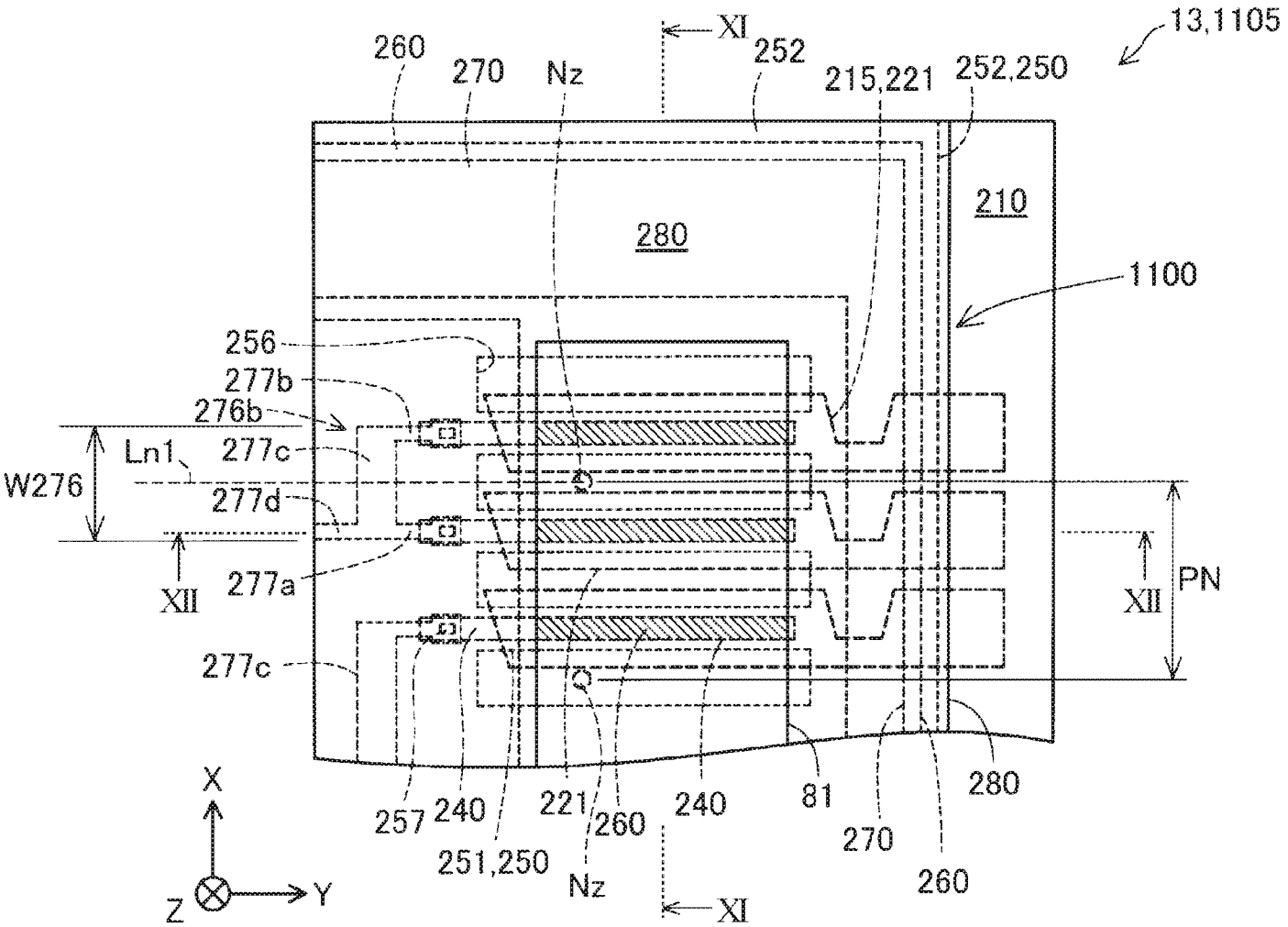
FIG. 10 is a plan diagram showing a positional relationship between a vibration plate, a flow path forming substrate, a drive element, a first lead electrode, and a second lead electrode.
Figure 11:
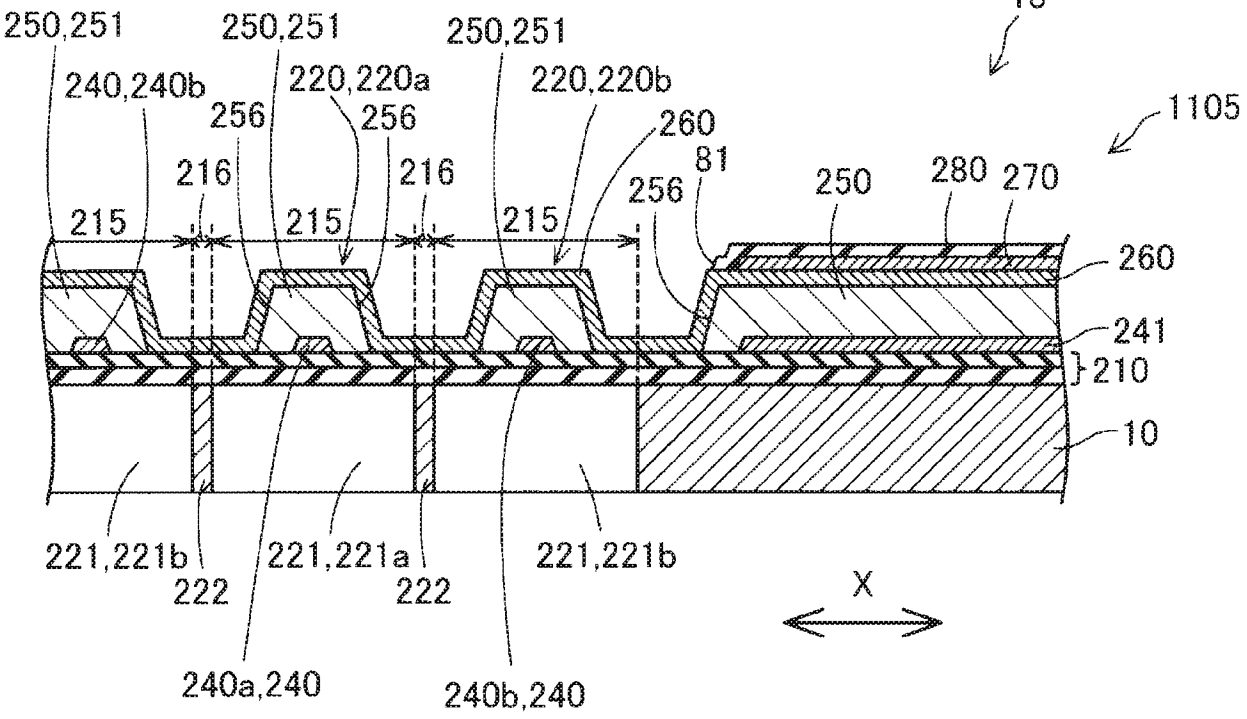
FIG. 11 is a cross-sectional diagram taken along line XI-XI of FIG. 10.
Figure 12:
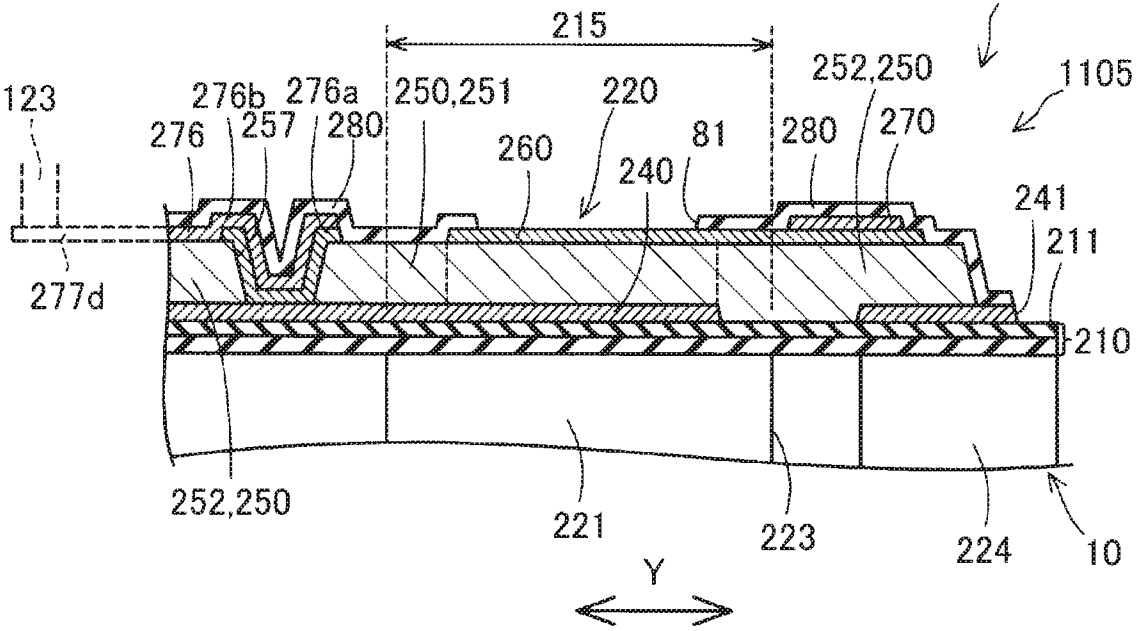
FIG. 12 is a cross-sectional diagram taken along line XII-XII of FIG. 10.

FIG. 10 is a plan diagram showing a positional relationship between the vibration plate 210, the flow path forming substrate 10, the drive element 1100, the first lead electrode 270, and the second lead electrode 276. FIG. 11 is a cross-sectional diagram taken along line XI-XI of FIG. 10. FIG. 12 is a cross-sectional diagram taken along line XII-XII of FIG. 10.

As shown in FIGS. 10 to 12, the drive element 1100 includes a plurality of segment electrodes 240 formed on the surface 211 so as to extend in the second axis direction Y, a piezoelectric layer 250, and a common electrode 260. The piezoelectric layer 250 has a first portion 251 formed to overlap with at least a part of the plurality of segment electrodes 240 and covers the plurality of segment electrodes 240, and a second portion 252 other than the first portion 251.

As shown in FIGS. 11 and 12, the vibration plate 210 has a movable region 215. The movable region 215 is a region overlapping with the pressure chamber 221 in plan view. The movable region 215 is formed for each pressure chamber 221. In the embodiment, a plurality of movable regions 215 are arranged side by side in the first axis direction X. In the vibration plate 210, a non-movable region 216 is formed between the movable regions 215 adjacent to each other. As shown in FIG. 11, the partition wall 222 of the flow path forming substrate 10 is disposed below the non-movable region 216.

As shown in FIGS. 11 and 12, the segment electrode 240 extends along the second axis direction Y at least in the movable region 215. In the embodiment, one end portion of the segment electrode 240 in the second axis direction is formed in the movable region 215 and the other end portion is formed outside the movable region 215.

The segment electrode 240 is a conductive layer and constitutes a lower electrode in the drive element 1100. The segment electrode 240 may be a metal layer containing, for example, any one of platinum (Pt), iridium (Ir), gold (Au), and nickel (Ni).

In addition, although omitted in FIG. 10 for convenience, as shown in FIGS. 11 and 12, a base layer 241 is formed on the surface 211, the base layer 241 being made of the same material as that of the segment electrode 240 in a region where a second portion 252 of the piezoelectric layer 250 is formed. The base layer 241 is a conductive layer to which no voltage is applied, and a conductive layer formed to control crystal growth of the piezoelectric body when the piezoelectric layer 250 is formed above the base layer 241. According to this, the crystal direction of the piezoelectric layer 250 becomes uniform, and the reliability of the drive element 1100 is improved.

As shown in FIGS. 10 to 12, the piezoelectric layer 250 is a plate-like member formed on the surface 211 of the vibration plate 210. The piezoelectric layer 250 has a plurality of openings 256 that define the first portion 251 and the second portion 252 for exposing a part of the vibration plate 210. The first portion 251 extends along the second axis direction Y in the movable region 215 and covers a part of the segment electrode 240. As shown in FIG. 12, the piezoelectric layer 250 has a plurality of openings 257 that open on the segment electrode 240. The piezoelectric layer 250 is made of a polycrystalline body having piezoelectric characteristics and can be deformed by being applied in the drive element 1100. The structure and material of the piezoelectric layer 250 may have piezoelectric characteristics and are not particularly limited. The piezoelectric layer 250 may be formed of a well-known piezoelectric material, for example, lead zirconate titanate ($Pb(Zr, Ti)O_3$), bismuth sodium titanate ($(Bi, Na)TiO_3$), or the like.

The common electrode 260 is formed to cover at least a part of the movable region 215 in plan view. As shown in FIG. 11, the common electrode 260 is formed so as to continuously cover the first portion 251 of each of the plurality of piezoelectric layers 250 in the first axis direction X. As shown in FIG. 12, the common electrode 260 is electrically coupled to the first lead electrode 270 in a region not overlapped with the movable region 215 in plan view. The common electrode 260 is made of a layer having conductivity, and constitutes the upper electrode in the drive element 1100. The common electrode 260 may be, for example, a metal layer containing platinum (Pt), iridium (Ir), gold (Au), or the like.

The drive element 1100 has the driver 220 provided in correspondence with each pressure chamber 221. The driver 220 is a part of the piezoelectric layer 250 being sandwiched between the common electrode 260 and the segment electrode 240 on the pressure chamber 221. By applying a voltage as a drive pulse to the segment electrode 240, the driver 220 is deformed and pressure is applied to the pressure chamber 221. Here, the driver 220 disposed on the first pressure chamber 221*a* in order to vary the liquid pressure of the first pressure chamber 221*a* is also referred to as a first driver 220*a*. Further, a driver disposed on the second pressure chamber 221*b* in order to vary the liquid pressure of the second pressure chamber 221*b* is also referred to as a second driver 220*b*.

The first lead electrode 270 is electrically coupled to the common electrode 260 at the second portion 252 of the piezoelectric layer 250. Further, the first lead electrode 270 is electrically coupled to the nozzle drive circuit 28 shown in FIG. 4 via wiring (not shown). The first lead electrode 270 is formed of a material having conductivity.

As shown in FIG. 12, the second lead electrode 276 is formed so as to be electrically coupled to the segment electrode 240 in the opening 257. The second lead electrode 276 has a base layer 276*a* which is a conductive film located in the opening 257, and a wiring layer 276*b* formed so as to be electrically coupled to the base layer 276*a*. In the manufacturing process, when the base layer 276*a* functions as a protective film for the segment electrode 240, it is possible to prevent the segment electrode 240 from being damaged in the manufacturing process. The second lead electrode 276 is formed of a material having conductivity. Each second lead electrode 276 is electrically coupled to each corresponding terminal 123 provided on the wiring member 121.

As described above, the chamber plate 13 has a plurality of pressure chambers 221 arranged along the first axis direction X, the driver 220 of the drive element 1100 provided in correspondence with each pressure chamber 221, and the plurality of second lead electrodes 276 for supplying a drive pulse COM which is an electric signal to the drive element 1100. As shown in FIG. 12, the circuit substrate 29 has the terminal 123 coupled to the second lead electrode 276.

Here, among the plurality of segment electrodes 240 constituting the drive element 1100, an electrode which is formed so as to overlap the first pressure chamber 221*a* and not to overlap the second pressure chamber 221*b* in plan view is referred to as a first segment electrode 240*a*. Among the plurality of segment electrodes 240, an electrode which is formed so as to overlap the second pressure chamber 221*b* and not to overlap the first pressure chamber 221*a* in plan view is referred to as a second segment electrode 240*b*.

In the embodiment, as illustrated in FIG. 10, the wiring layer 276*b* of the second lead electrode 276 has a first individual wiring 277*a*, a second individual wiring 277*b*, a joining wiring 277*c*, and a coupling wiring 277*d*. The first individual wiring 277*a* is coupled to the first segment electrode 240*a* in the opening 257. The second individual wiring 277*b* is coupled to the second segment electrode 240*b* in the opening 257. The joining wiring 277*c* is wiring coupling the first individual wiring 277*a* and the second individual wiring 277*b* and extends in the first axis direction X. The coupling wiring 277*d* is wiring extending from the joining wiring 277*c* toward the terminal 123 side, and is coupled to the terminal 123. Thus, the first segment electrode 240*a* and the second segment electrode 240*b* are electrically coupled to one common second lead electrode 276.

The maximum width W276 of the second lead electrode 276 as the lead electrode in the first axis direction X is preferably 50% to 80% of a nozzle pitch PN of the nozzle row. In this way, variations in current flowing in the second lead electrode 276 can be reduced. Further, in this way, the interval between the two adjacent second lead electrodes 276 is easily secured sufficiently, the occurrence of short circuit can be suppressed. In the embodiment, the nozzle pitch PN is a pitch of 150 dpi.

As described above, wiring of the electric signals to the first segment electrode 240*a* and the second segment electrode 240*b* can be made common by the second lead electrode 276 located closer to the drive element 1100. By this, in the drive element 1100, variations between a wiring impedance from the nozzle drive circuit 28 to the first segment electrode 240*a* and a wiring impedance from the nozzle drive circuit 28 to the second segment electrode 240*b* can be reduced. Accordingly, since the liquid can be supplied more uniformly to the nozzle Nz from the first pressure chamber 221*a* and the second pressure chamber 221*b*, the possibility that the discharge characteristics of the nozzles Nz vary can be reduced.

In the first embodiment, the first segment electrode 240*a* provided in correspondence with the first pressure chamber 221*a* communicating with one nozzle Nz and the second segment electrode 240*b* provided in the second pressure chamber 221*b* communicating with one nozzle Nz are separate electrodes arranged at intervals in the first axis direction X. However, the formation mode of the first segment electrode 240*a* and the second segment electrode 240*b* is not limited to this.

Figure 13:
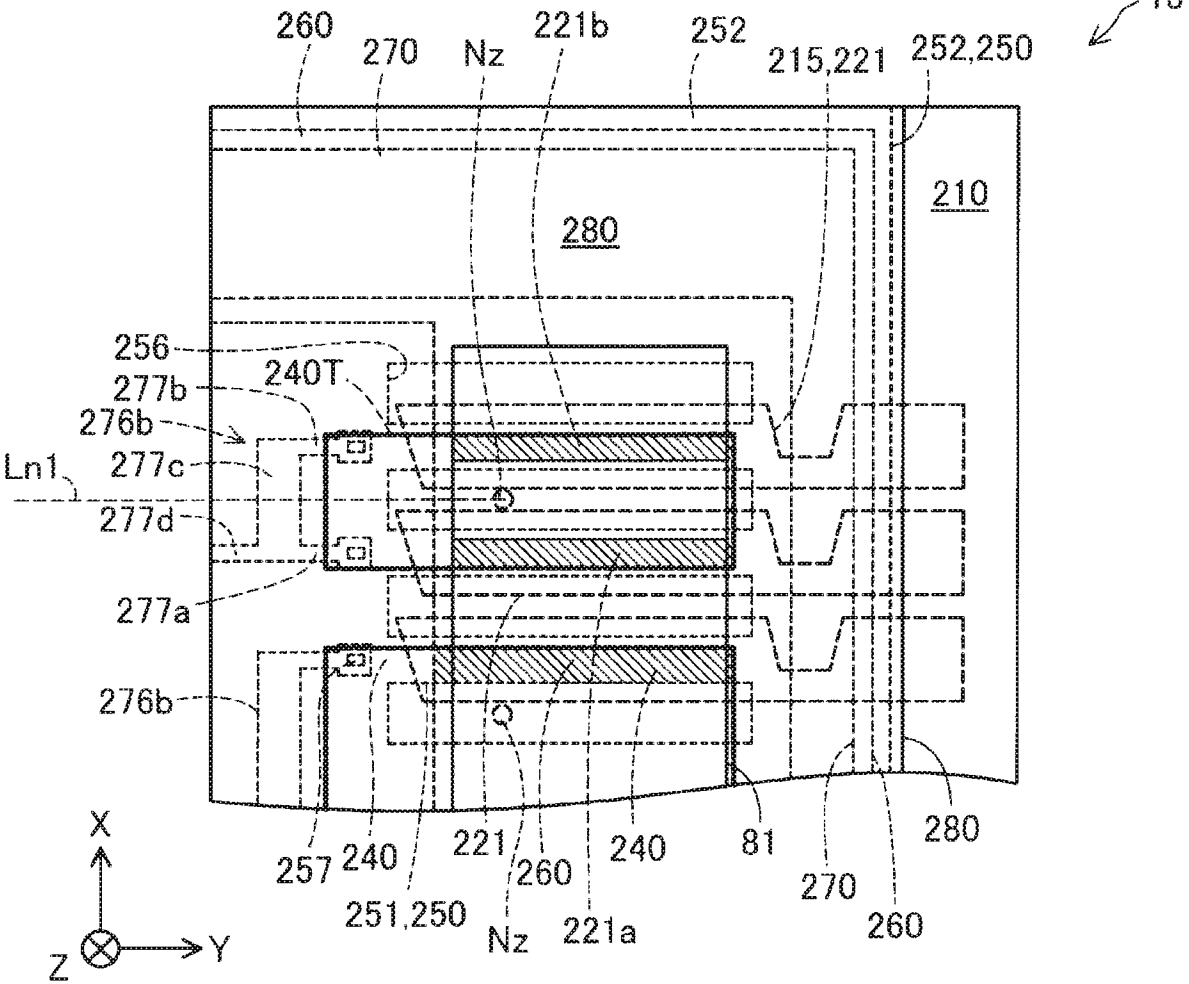
FIG. 13 is a diagram for explaining another formation mode of a first segment electrode and a second segment electrode.

Hereinafter, another formation mode of the first segment electrode 240*a* and the second segment electrode 240*b* will be described with reference to FIG. 13. FIG. 13 is a diagram for explaining another formation mode of the first segment electrode 240*a* and the second segment electrode 240*b*. FIG. 13 is a diagram equivalent to FIG. 10. As shown in FIG. 13, the first segment electrode 240*a* and the second segment electrode 240*b* provided in correspondence with one nozzle Nz are formed as parts of a common electrode layer 240T. In the first axis direction X, the electrode layers 240T are arranged at intervals for each set of the first pressure chamber 221*a* and the second pressure chamber 221*b* provided in correspondence with one nozzle Nz. The outer shape of the electrode layer 240T is shown by a thick dotted line in FIG. 13. The piezoelectric layer 250 (not shown) is disposed so as to be sandwiched between the electrode layer 240T and the common electrode 260. A portion of the electrode layer 240T located on the first pressure chamber 221*a* functions as the first segment electrode 240*a*, and a portion located on the second pressure chamber 221*b* functions as the second segment electrode.

In FIGS. 10 and 13, it is preferable that the first segment electrode 240*a* and the second segment electrode 240*b* are formed substantially in line symmetry with respect to the first virtual line Ln1 in plan view. Further, it is preferable that one second lead electrode 276 is formed so as to straddle the first virtual line Ln1 in plan view. In this way, variations between the wiring impedance from the nozzle drive circuit 28 to the first segment electrode 240*a* and the wiring impedance from the nozzle drive circuit 28 to the second segment electrode 240*b* can be reduced.

Figure 14:
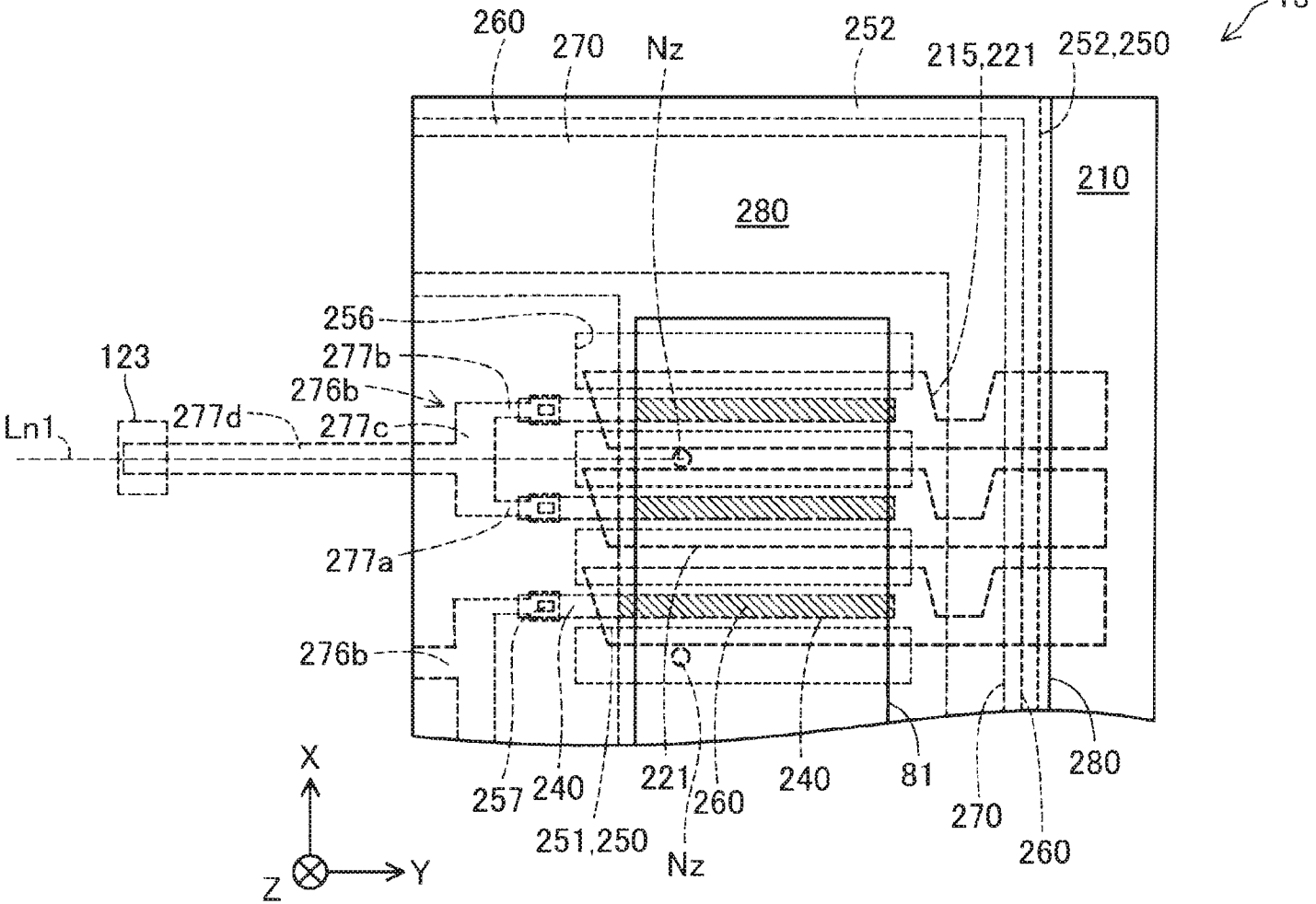
FIG. 14 is a diagram for explaining still another aspect of a first embodiment.

FIG. 14 is a diagram for explaining still another aspect according to the first embodiment. FIG. 14 is a diagram equivalent to FIG. 10. As shown in FIG. 14, it is preferable that the terminal 123 and the second lead electrode 276 are coupled at a position overlapping the first virtual line Ln1 in plan view. In the form shown in FIG. 14, the coupling wiring 277*d* extends to the terminal 123 along the second axis direction Y at a position overlapping the first virtual line Ln1 in plan view. In this way, variations between the wiring impedance from the nozzle drive circuit 28 to the first segment electrode 240*a* and the wiring impedance from the nozzle drive circuit 28 to the second segment electrode 240*b* can be further reduced.

As described above, in the first embodiment, as shown in FIGS. 2 and 3, the liquid discharging head 26 includes the first reservoir 42*a* and the second reservoir 42*b* commonly communicated with the plurality of pressure chambers 221 constituting the pressure chamber row LX. Further, the pressure chamber row LX includes the first pressure chamber 221*a* and the second pressure chamber 221*b*. As shown in FIG. 3, the first pressure chamber 221*a* communicates with the first reservoir 42*a* through the first individual flow path 192 and the first supply flow path 224*a*. The second pressure chamber 221*b* is communicated with the second reservoir 42*b* through the second individual flow path 194 and the second supply flow path 224*b*. Further, as described above, the liquid discharging head 26 is provided with the communication flow path 16 for causing the first pressure chamber 221*a* and the second pressure chamber 221*b* to commonly communicate with one nozzle Nz. By this, since the liquid can be supplied from the two pressure chambers 221*a* and 221*b* toward one nozzle Nz, the liquid discharging head 26 which is small in size and improved in liquid discharge efficiency is provided. Further, by controlling the operation of the flow mechanism 615 and the operation of the drive element 1100 and circulating the liquid between the first pressure chamber 221*a* and the second pressure chamber 221*b* through the communication flow path 16, the liquid in the vicinity of the nozzle Nz can be efficiently replaced with the liquid located around. By this, the occurrence of the defective discharge of the liquid which may occur when the liquid in the vicinity of the nozzle Nz is dried and the viscosity is increased.

As shown in FIG. 3, the liquid discharging head 26 includes a plurality of sets of the first pressure chamber 221*a*, the second pressure chamber 221*b*, the communication flow path 16, and one nozzle Nz. As shown in FIG. 4, one of the plurality of nozzles Nz corresponding to each set constitutes a nozzle row arranged side by side along the first axis direction X.

In the embodiment, although a mode in which a liquid is supplied from each of the first reservoir 42*a* and the second reservoir 42*b* has been described, as in the thirteenth embodiment described later, the same liquid discharging head 26 may be used as a so-called liquid circulation head. In such a case, for example, in a case where the liquid flows from the first pressure chamber 221*a* to the second pressure chamber 221*b* through one communication flow path 16 as shown by the direction of the dotted arrow in FIG. 3, the direction of the liquid flowing through each set of communication flow paths 16 is the same. In the example shown in FIG. 3, the liquid in each communication flow path 16 flows from one side to the other side in the first axis direction X. Here, when the liquid flows from the first pressure chamber 221*a* to the second pressure chamber 221*b* through the communication flow path 16, that is, when returning the liquid from the second pressure chamber 221*b* to the liquid container 14 through the second reservoir 42*b* and the second common liquid chamber 440*b*, the following phenomenon may occur. That is, due to the flow in the vicinity of the nozzle Nz, the direction of the liquid discharged from the nozzle Nz may be shifted with respect to the third axis direction Z which is the opening direction of the nozzle Nz. Thus, the degree of variations of the direction of the liquid discharged from each nozzle Nz can be reduced by aligning the flow direction of each communication flow path 16.

As shown in FIGS. 6 and 7, the first reservoir 42*a* and the second reservoir 42*b* are at least partially overlapped when viewed in a plan view in the discharge direction of the liquid, that is, when viewed toward the plus side in the third axis direction Z. In the embodiment, the first reservoir 42*a* and the opening 42*b*3 of the second reservoir 42*b* are overlapped each other. In this way, it is possible to suppress the increase in size of the liquid discharging head 26 in the horizontal direction.

As shown in FIGS. 7 and 8, the flow path length of the first individual flow path 192 extending along the third axis direction Z is shorter than that of the second individual flow path 194 extending along the third axis direction Z. Thus, the flow path length of the first coupling flow path 198 is shorter than that of the second coupling flow path 199.

Further, according to the first embodiment, a plurality of sets of the first pressure chamber 221*a*, the second pressure chamber 221*b*, one nozzle Nz, and one second lead electrode 276 are provided as many as the number of the nozzles Nz constituting the nozzle row. Further, the plurality of nozzles Nz corresponding to each set are arranged side by side along the first axis direction X as shown in FIG. 4 thereby forming the nozzle row.

Further, according to the first embodiment, as shown in FIG. 3, the first pressure chamber 221*a* and the first reservoir 42*a* are coupled through the first coupling flow path 198 and the second pressure chamber 221*b* and the second reservoir 42*b* are coupled through the second coupling flow path 199. That is, the first pressure chamber 221*a* and the second pressure chamber 221*b* are coupled to different reservoirs. Thus, for example, it is possible to cause the first reservoir 42*a* to function as a supply reservoir for supplying the liquid to the communication flow path 16, and cause the second reservoir 42*b* to function as a recovery reservoir for recovering the liquid from the communication flow path 16. The liquid in the recovery reservoir may be returned to the liquid container 14 via the second common liquid chamber 440*b*. That is, the liquid may be circulated between the liquid container 14 and the liquid discharging head 26. The circulation of the liquid may be performed by controlling the operation of the flow mechanism 615.

According to the above-described first embodiment, when the first pressure chamber 221*a* and the second pressure chamber 221*b* communicate with one nozzle Nz, it is possible to cause larger amount of liquid to be discharged from the nozzle while suppressing increase in volume of each pressure chamber 221. That is, larger amount of liquid can be discharged from the nozzle while suppressing the lowering of the discharge efficiency in which the liquid is discharged from the nozzle Nz.

B. Second Embodiment

Figure 15:
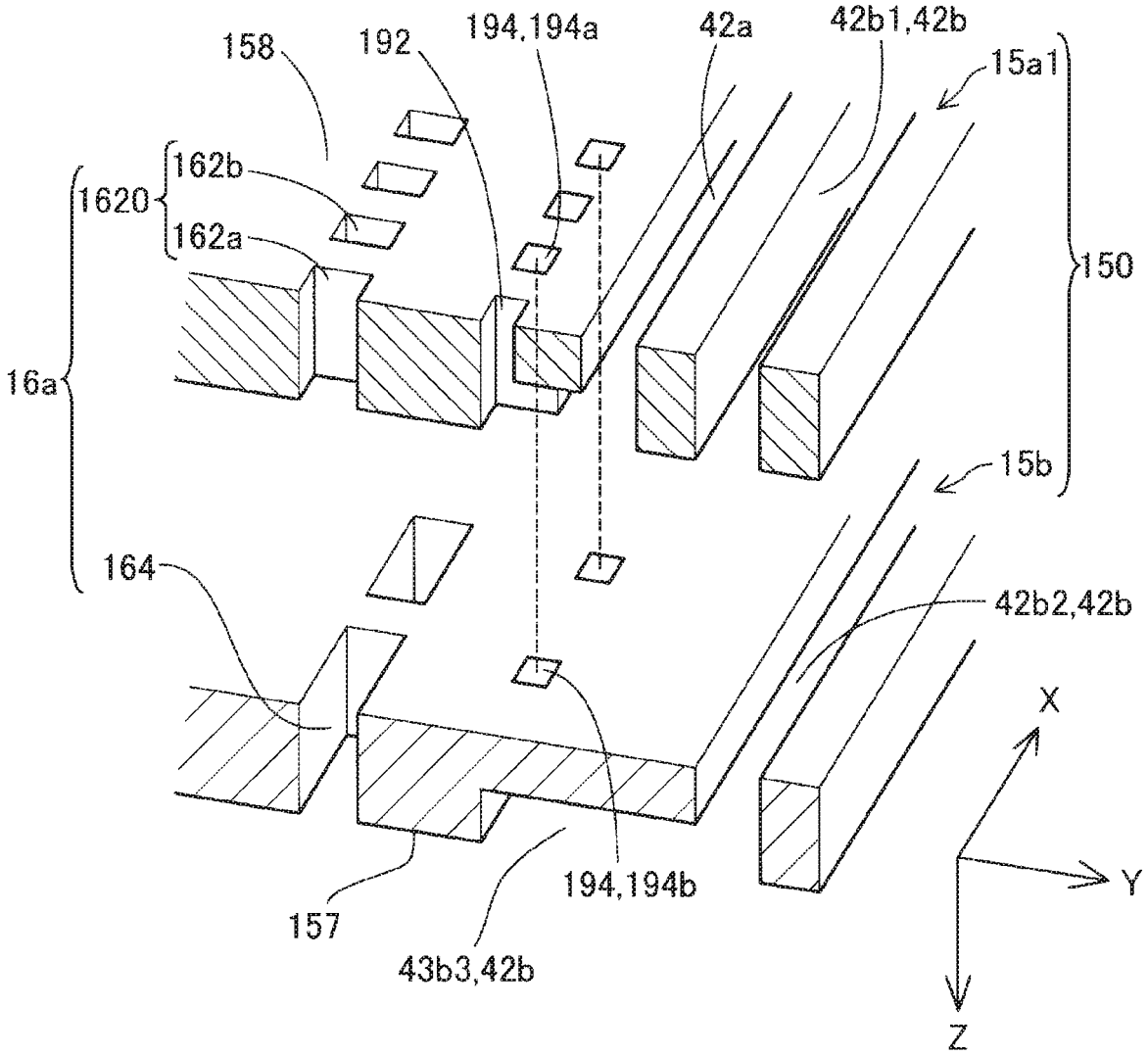
FIG. 15 is a perspective diagram of a flow path plate according to a second embodiment.
Figure 16:
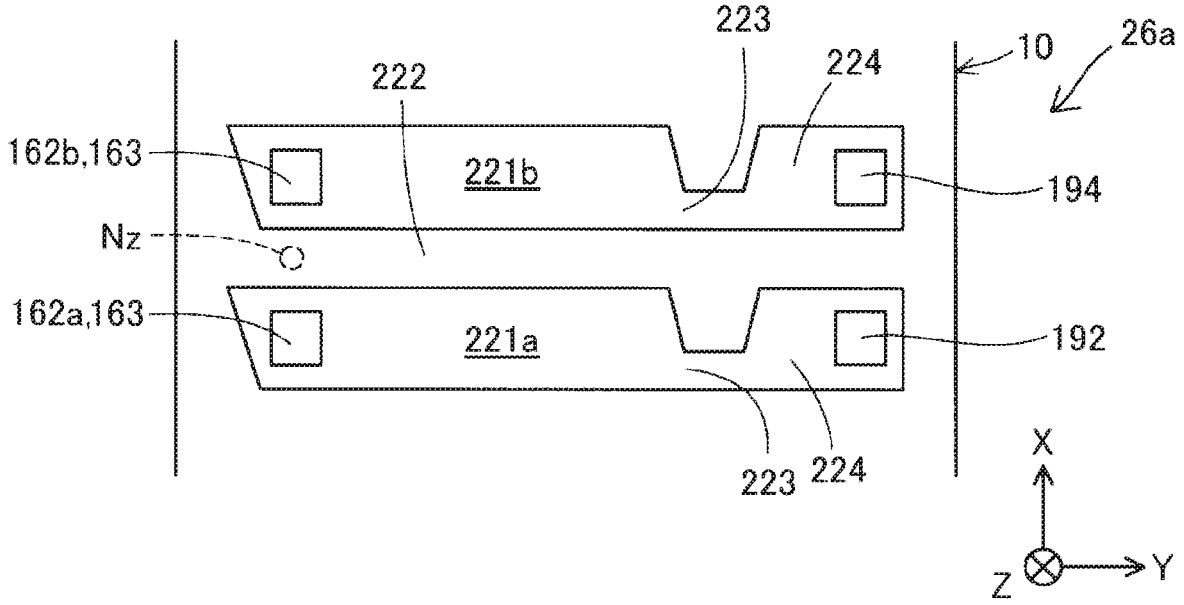
FIG. 16 is a first diagram for explaining a configuration of a liquid discharging head according to a second embodiment.
Figure 17:
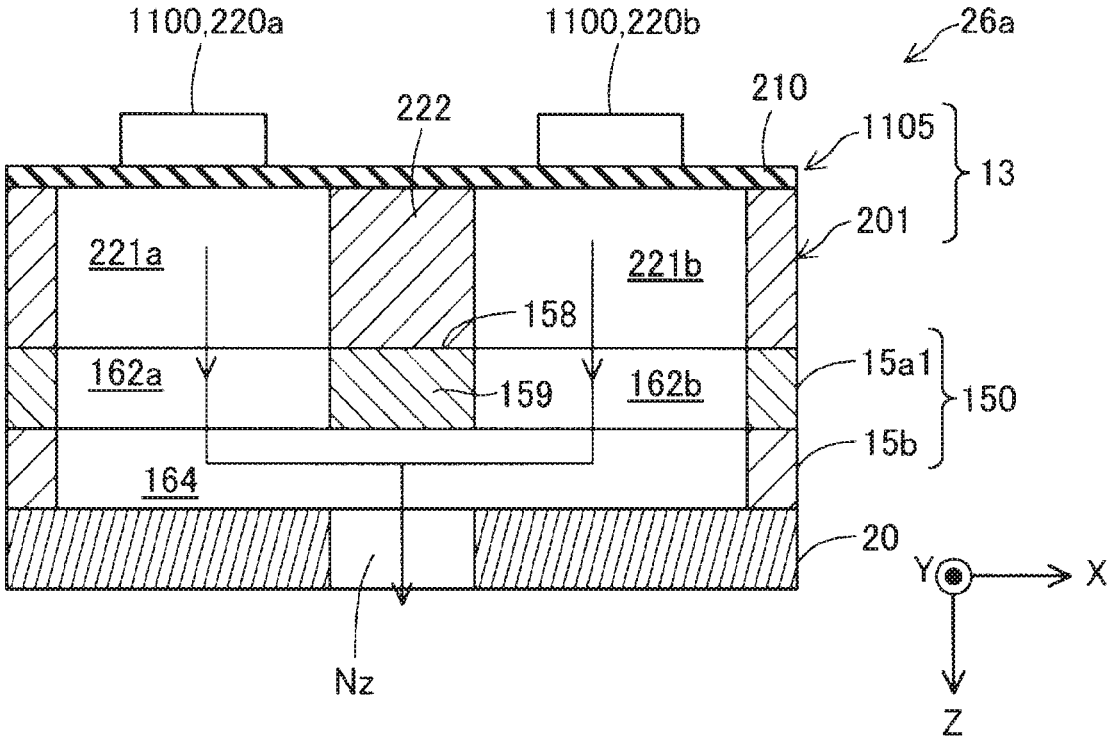
FIG. 17 is a second diagram for explaining a configuration of a liquid discharging head according to a second embodiment.

FIG. 15 is a perspective diagram of the flow path plate 150 according to a second embodiment. FIG. 16 is a first diagram for explaining a configuration of the liquid discharging head 26*a* according to the second embodiment. FIG. 17 is a second diagram for explaining a configuration of the liquid discharging head 26*a* according to the second embodiment. FIG. 16 is a schematic diagram of the flow path forming substrate 10 and the flow path plate 150 when viewed in plan from the -third axis direction Z side. FIG. 17 is a schematic diagram of the nozzle plate 20 when cut on an XZ plane passing through the nozzle Nz and the pressure chamber 221.

The difference between the flow path plate 150 of the second embodiment and the flow path plate 15 of the first embodiment is the configuration of a first through-hole flow path 1620 of the first flow path plate 15*a*. Since the other configuration of the flow path plate 150 is the same as the configuration of the flow path plate 15 of the first embodiment, the same components are denoted by the same reference numerals and the description thereof is omitted.

The first through-hole flow path 1620 penetrates the first flow path plate 15*a*1 in the third axis direction Z which is the plan view direction. A plurality of the first through-hole flow paths 1620 are provided in correspondence with each pressure chamber 221. That is, each pressure chamber 221 communicates with each corresponding first through-hole flow path 1620. The plurality of first through-hole flow paths 1620 are arranged side by side along the first axis direction X. Among the first through-hole flow paths 1620 adjacent to each other, a flow path facing the first pressure chamber 221*a* is referred to as the first flow path 162*a*, and a flow path facing the second pressure chamber 221*b* is referred to as the second flow path 162*b*. A flow path partition wall 159 is provided between the first flow path 162*a* and the second flow path 162*b* adjacent to each other communicating with one nozzle Nz. The first flow path 162*a* and the second flow path 162*b* adjacent to each other in plan view are arranged so as to overlap with one second through-hole flow path 164.

As shown in FIG. 17, when the liquid is discharged from the nozzle Nz, a drive pulse is supplied to the driver 220*a* of the drive element 1100 on the first pressure chamber 221*a* and the driver 220*b* of the drive element 1100 on the second pressure chamber 221*b*. Thus, as shown by the direction of the arrow, the liquid in the first pressure chamber 221*a* is pushed out to the first flow path 162*a* and flows into the second through-hole flow path 164. Further, the liquid in the second pressure chamber 221*b* is pushed out to the second flow path 162*b* and flows into the second through-hole flow path 164. The liquid that flows from the first flow path 162*a* and the second flow path 162*b* into the second through-hole flow path 164 and joined flows toward the nozzle Nz. By this, the liquid in the nozzle Nz is pushed out to the outside and discharged.

As shown in FIGS. 16 and 17, the partition wall 222 between the first pressure chamber 221*a* and the second pressure chamber 221*b* adjacent to each other is bonded to the plate second surface 158 of the flow path plate 15 over the entire region, and the movement thereof is restricted. By this, since the rigidity of the first pressure chamber 221*a* and the second pressure chamber 221*b* can be increased, vibration of the driver 220 can be transmitted to the pressure chamber 221 more efficiently.

Moreover, according to the second embodiment, the same effect is achieved in terms of having the same configuration as the first embodiment. For example, when the first pressure chamber 221*a* and the second pressure chamber 221*b* communicate with one nozzle Nz, it is possible to cause larger amount of liquid to be discharged from the nozzle while suppressing increase in volume of each pressure chamber 221.

C. Third Embodiment

Figure 18:
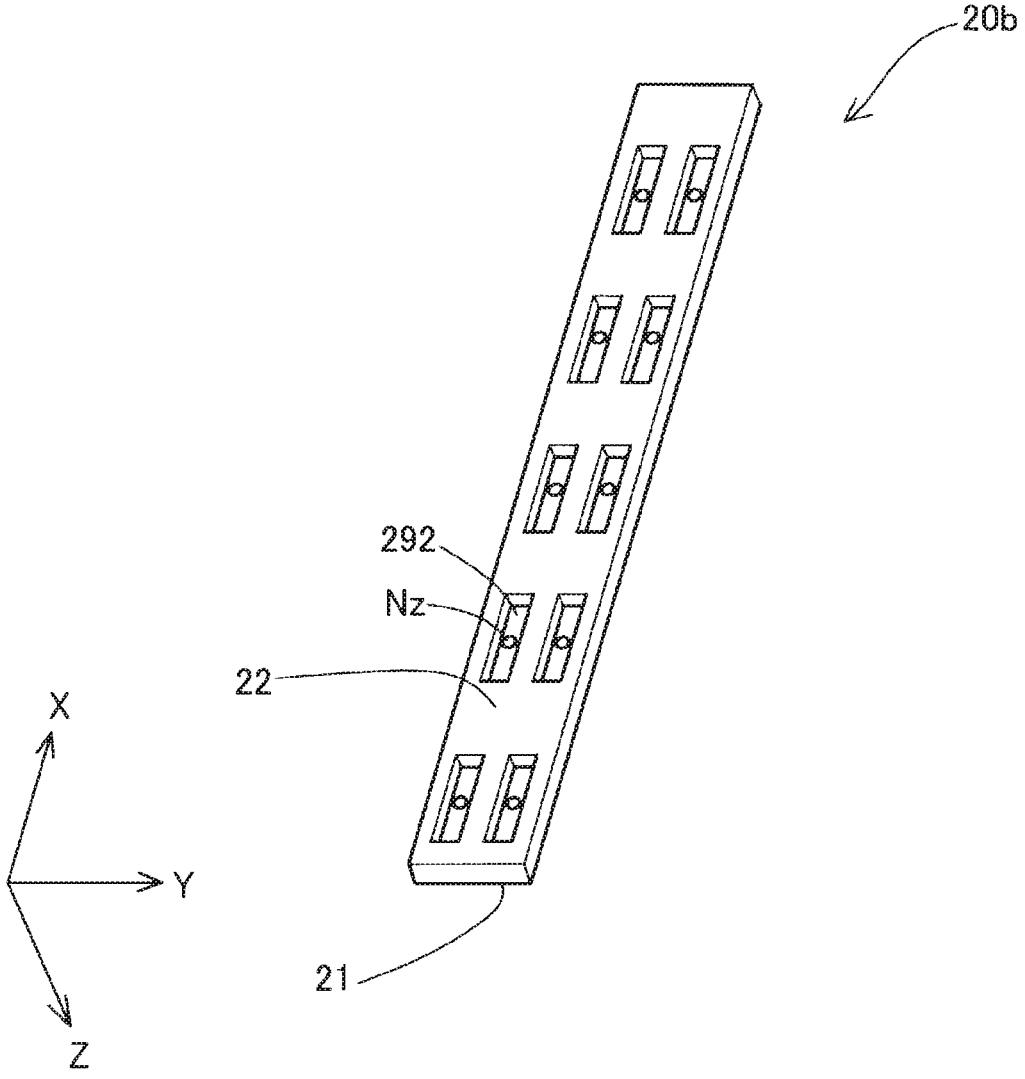
FIG. 18 is a plan diagram of a nozzle plate according to a third embodiment.
Figure 19:
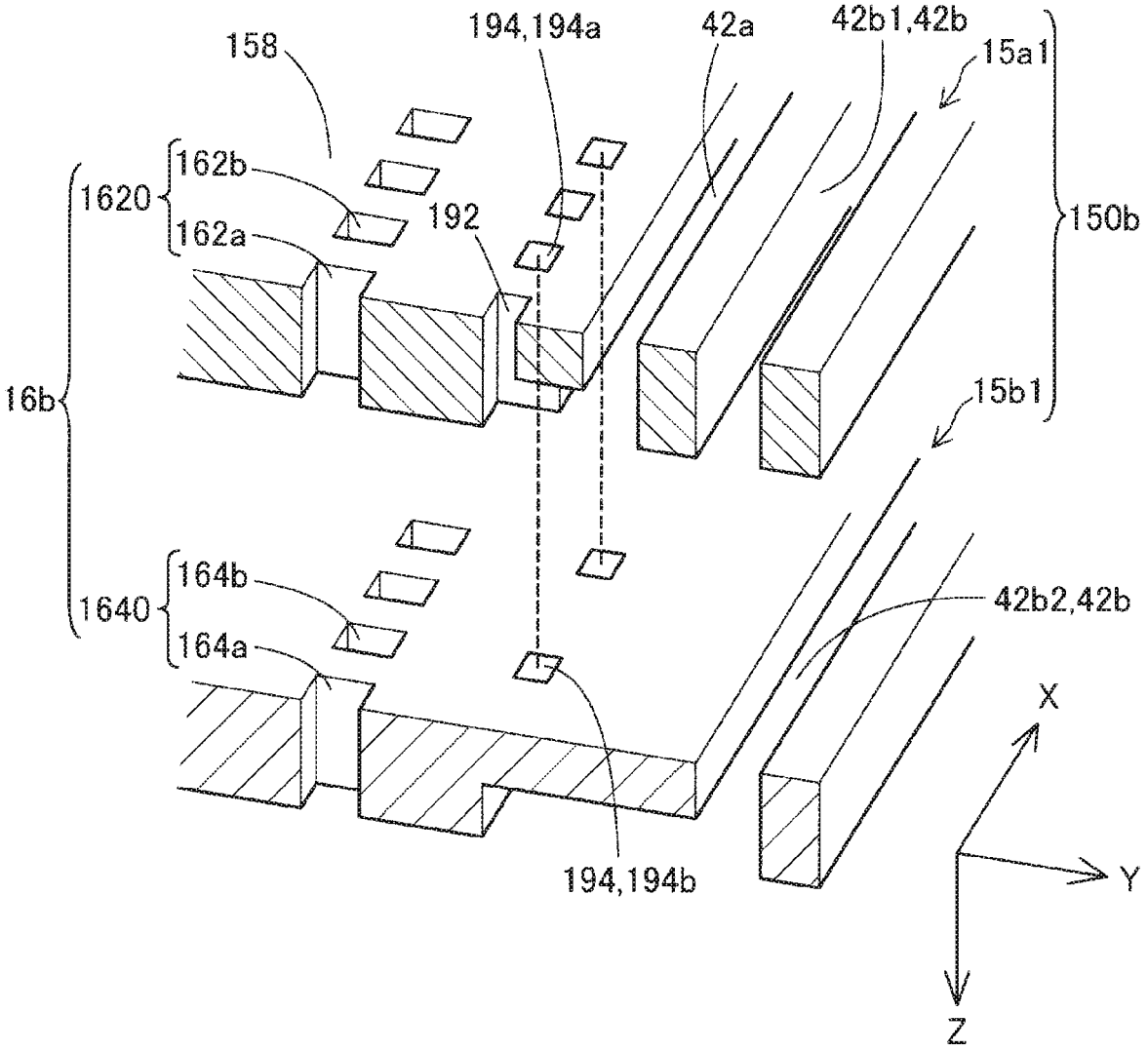
FIG. 19 is an exploded perspective diagram showing a part of a flow path plate according to a third embodiment.
Figure 20:
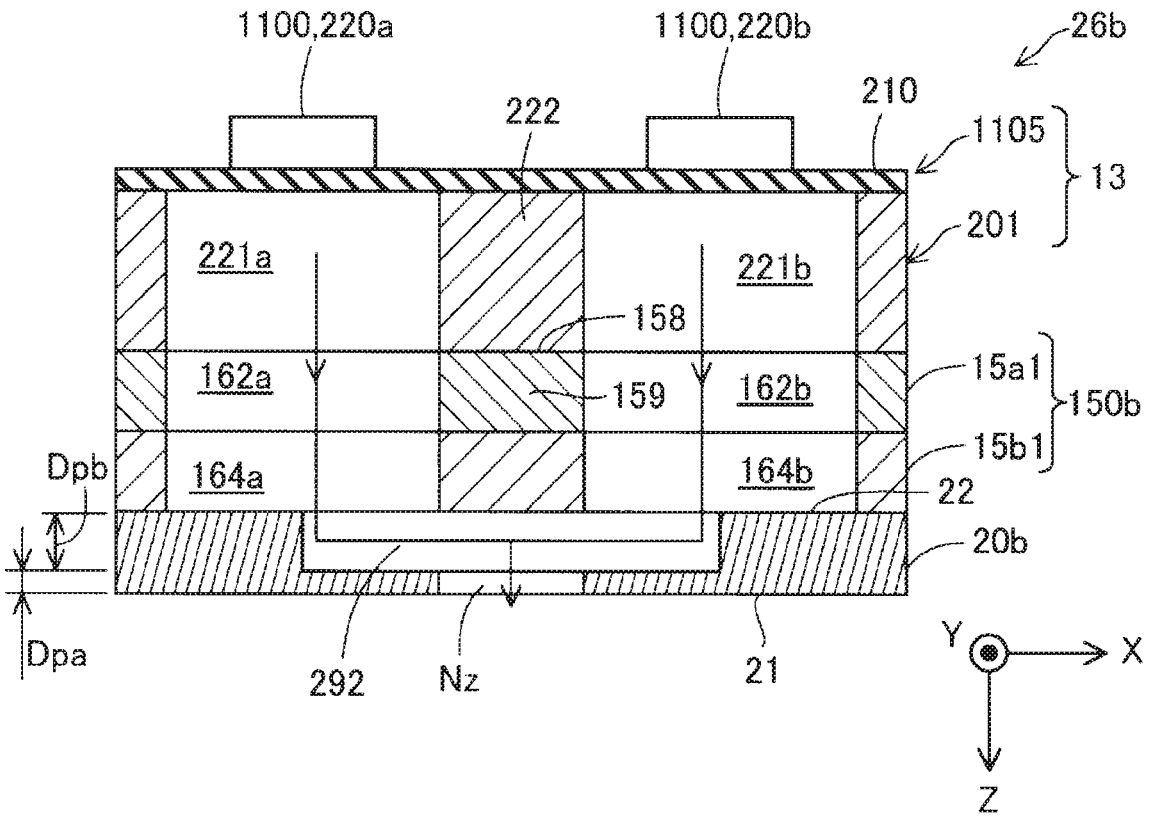
FIG. 20 is a first diagram for explaining a configuration of a liquid discharging head according to a third embodiment.
Figure 21:
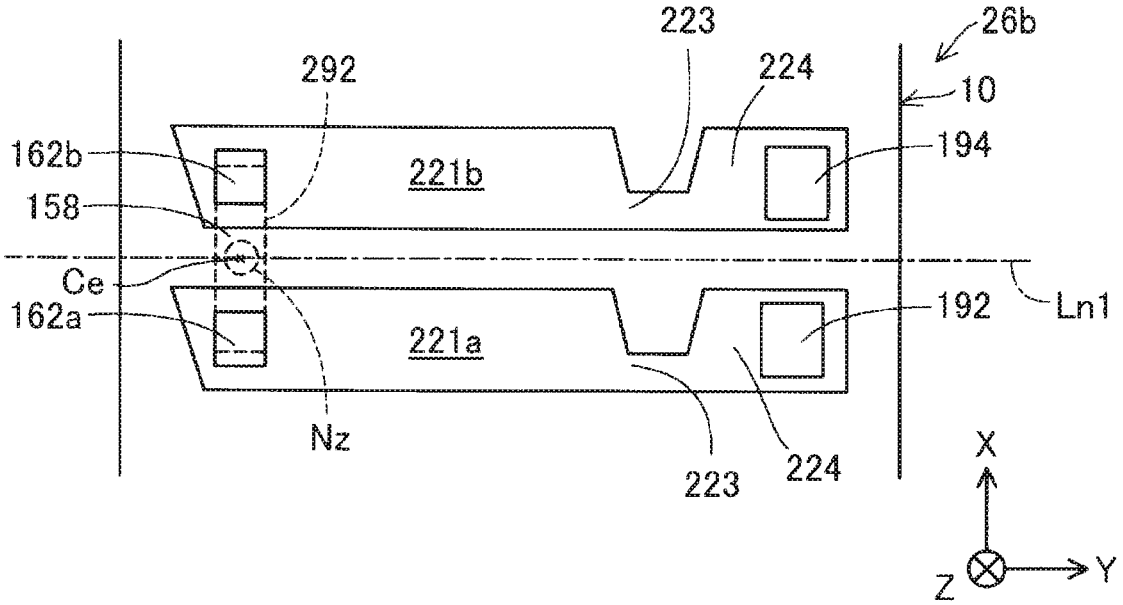
FIG. 21 is a second diagram for explaining a configuration of a liquid discharging head.

FIG. 18 is a plan diagram of the nozzle plate 20*b* according to a third embodiment. FIG. 19 is an exploded perspective diagram showing a part of the flow path plate 150*b* according to the third embodiment. FIG. 20 is a first diagram for explaining the configuration of the liquid discharging head 26*b* according to the third embodiment. FIG. 21 is a second diagram for explaining the configuration of the liquid discharging head 26*b*. FIG. 20 is a schematic diagram of the nozzle plate 20*b* when cut on an XZ plane passing through the nozzle Nz and the pressure chamber 221. FIG. 21 is a diagram when the flow path forming substrate 10 and the flow path plate 150*b* are viewed in plan from the -third axis direction Z side.

The difference between the liquid discharging head 26*b* of the third embodiment, and the liquid discharging head 26 of the first embodiment and the liquid discharging head 26*a* of the second embodiment is that the communication flow path 292 that causes the first pressure chamber 221*a* and the second pressure chamber 221*b* which commonly communicate with one nozzle Nz to communicate with the one nozzle Nz is formed on the nozzle plate 20*b*. The same reference numerals are given to the same components in the liquid discharging head 26*b* of the third embodiment and the liquid discharging head 26*a* of the second embodiment, and description thereof is omitted.

As shown in FIGS. 18 and 20, the nozzle plate 20*b* includes the first surface 21 on which the nozzle Nz that discharges a liquid is formed, and the second surface 22 on which the communication flow path 292 communicating with the nozzle Nz is formed. The second surface 22 is a surface opposite to the first surface 21. As shown in FIG. 20, the communication flow path 292 is an opening extending from the second surface 22 to the first surface 21 side, and has a depth dimension of Dpb. The communication flow path 292 extends along the first axis direction X. The nozzle Nz is an opening that is coupled to an end opening of the communication flow path 292 on the first surface 21 side and extends to the first surface 21. The nozzle Nz has a depth dimension of Dpa. A plurality of the communication flow paths 292 are provided in correspondence with each nozzle Nz. As shown in FIG. 20, the communication flow path 292 forms a horizontal flow path perpendicular to the third axis direction Z.

As shown in FIG. 18, the communication flow path 292 is rectangular and the nozzle Nz is circular in plan view. In plan view, the communication flow path 292 is formed in a region larger than the coupled nozzle Nz. That is, in plan view, the nozzle Nz is arranged inside the contour of the communication flow path 292. As shown in FIG. 20, a step is formed at a coupling portion between the nozzle Nz and the communication flow path 292.

The depth dimension Dpb of the communication flow path 292 is preferably equal to or larger than the depth dimension Dpa of the nozzle Nz. When the depth dimension Dpb of the communication flow path 292 is reduced, the flow path cross-sectional area of the communication flow path 292, that is, the cross-sectional area of the flow path forming the horizontal flow is reduced, and the inertance of the communication flow path 292 is increased. When the inertance of the communication flow path 292 is increased, it may cause a possibility that the liquid in the communication flow path 292 cannot be smoothly circulated. Thus, by making the depth dimension Dpb equal to or larger than the depth dimension Dpa, the increase in the inertance of the communication flow path 292 can be suppressed. By this, the lowering of the discharge efficiency from the nozzle Nz can be suppressed.

The depth dimension Dpb is preferably twice the depth dimension Dpa or less. In this way, it is possible to suppress the increase in manufacturing time when the communication flow path 292 is formed by etching or the like. Further, in this way, since the degree of manufacturing variations of the depth dimension Dpb of the communication flow path 292 can be reduced, the possibility of variations in the discharge amount of the liquid from each nozzle Nz can be reduced.

In the embodiment, the depth dimension Dpa of the nozzle Nz is 25 μm to 40 μm, and the depth dimension Dpb of the communication flow path 292 is 30 μm to 70 μm.

As shown in FIG. 19, a second through-hole flow path 1640 penetrates a second flow path plate 15*b*1 in the third axis direction Z which is the plan view direction. The second flow path plate 15*b* has a plurality of second through-hole flow paths 1640. A plurality of the second through-hole flow paths 1640 are provided in correspondence with each pressure chamber 221. The second through-hole flow path 162 is rectangular in plan view. In plan view, each second through-hole flow path 162 is arranged so as to overlap with the corresponding first through-hole flow path 162. A flow path communicating with the first pressure chamber 221*a* through the first flow path 162*a* among the adjacent second through-hole flow paths 1640 is referred to as a first formation flow path 164*a* and a flow path communicating with the second pressure chamber 221*b* through the second flow path 162*b* is referred to as a second formation flow path 164*b*.

As shown in FIG. 20, when the liquid is discharged from the nozzle Nz, the drive pulse is supplied to the driver 220*a* of the drive element 1100 on the first pressure chamber 221*a* and the driver 220*b* of the drive element 1100 on the second pressure chamber 221*b*. By this, as shown by the direction of the arrow, the liquid in the first pressure chamber 221*a* is pushed out to the first flow path 162*a* and flows in order of the first formation flow path 164*a* and the communication flow path 292. The liquid in the second pressure chamber 221*b* is pushed out to the second flow path 162*b* as shown by the direction of the arrow and flows in order of the second formation flow path 164*b* and the communication flow path 292. In the communication flow path 292, the liquids in the first formation flow path 164*a* and the second formation flow path 164*b* are joined and are discharged from the nozzle Nz.

As shown in FIG. 20, the chamber plate 13 is disposed on the second surface side of the nozzle plate 20*b*. Further, the first pressure chamber 221*a* and the second pressure chamber 221*b* communicate with one nozzle Nz through one communication flow path 292. In this way, since the first pressure chamber 221*a* and the second pressure chamber 221*b* can be communicated with one nozzle Nz by the nozzle plate 20*b*, other members such as the flow path forming substrate 10 can be used in common with other kinds of liquid discharging heads. The other kind of liquid discharging head is, for example, a liquid discharging head in which one pressure chamber communicates with one nozzle Nz.

As shown in FIG. 21, the communication flow path 292 is formed such that at least a part of the communication flow path 292 overlaps the first pressure chamber 221*a* and the second pressure chamber 221*b* in plan view. That is, a part of the communication flow path 292 is positioned immediately below the first pressure chamber 221*a* and the second pressure chamber 221*b*. In this way, it is not necessary to extend the flow path, that is the flow path which couples the first pressure chamber 221*a* and the second pressure chamber 221*b* to the communication flow path 292, formed on the flow path plate 150*b* in the embodiment in the horizontal direction. Thus, it is possible to suppress the increase in size of the liquid discharging head 26*b* in the horizontal direction.

Further, as in the first embodiment, the first pressure chamber 221*a* and the second pressure chamber 221*b* adjacent to each other are formed substantially in line symmetry with respect to a first virtual line Ln1 in plan view, and the communication flow path 292 is preferably formed substantially in line symmetry with respect to the first virtual line Ln1. In this way, a deviation in magnitude between the pressure wave transmitted from the first pressure chamber 221*a* to the communication flow path 292 and the pressure wave transmitted from the second pressure chamber 221*b* to the communication flow path 292 can be suppressed. By this, the occurrence of deviation between the amount of a liquid flowing into the communication flow path 292 from the first pressure chamber 221*a* and the amount of a liquid flowing into the communication flow path 292 from the second pressure chamber 221*b* can be suppressed.

One nozzle Nz communicating with the first pressure chamber 221*a* and the second pressure chamber 221*b* is preferably disposed to overlap with the first virtual line Ln1 in plan view. In this way, a deviation in magnitude between the pressure wave transmitted from the first pressure chamber 221*a* to the nozzle Nz and the pressure wave transmitted from the second pressure chamber 221*b* to the nozzle Nz can be further suppressed. By this, the occurrence of deviation between the amount of a liquid flowing into the nozzle Nz from the first pressure chamber 221*a* and the amount of a liquid flowing into the nozzle Nz from the second pressure chamber 221*b* can be further suppressed. In the embodiment, the center Ce of the nozzle Nz overlaps the first virtual line Ln in plan view.

It is preferable that a flow path from the first pressure chamber 221*a* and the second pressure chamber 221*b* toward one nozzle Nz is formed substantially in line symmetry with respect to the first virtual line Ln1 in plan view. By this, the occurrence of deviation between the amount of a liquid flowing into the communication flow path 292 from the first pressure chamber 221*a* and the amount of a liquid flowing into the communication flow path 292 from the second pressure chamber 221*b* can be further suppressed.

As shown in FIG. 19, the flow path plate 150*b* as the intermediate plate includes the first flow path 162*a* and the first formation flow path 164*a* as a first through-hole penetrating in plan view direction, and the second flow path 162*b* and the second formation flow path 164*b* as a second through-hole penetrating in plan view direction. The flow path plate 150*b* is disposed between the nozzle plate 20*b* and the chamber plate 13. As shown in FIG. 20, the first pressure chamber 221*a* communicates with the communication flow path 292 via the first flow path 162*a* and the first formation flow path 164*a* as the first through-hole. Further, the second pressure chamber 221*b* communicates with the communication flow path 292 via the second flow path 162*b* and the second formation flow path 164*b* as the second through-hole. By this, the first pressure chamber 221*a* and the second pressure chamber 221*b* can be communicated with the communication flow path 292 via the flow path plate 150*b* serving as the intermediate plate. Thus, the liquid discharging head 26*b* can be manufactured by using the intermediate plate 150*b* usable for the liquid discharging head provided with each nozzle corresponding to each pressure chamber.

According to the third embodiment, the same effect is achieved in terms of having the same configuration as that of the first embodiment or the second embodiment. For example, when the first pressure chamber 221*a* and the second pressure chamber 221*b* communicate with one nozzle Nz, it is possible to cause larger amount of liquid to be discharged from the nozzle while suppressing increase in volume of each pressure chamber 221.

D. Fourth Embodiment

Figure 22:
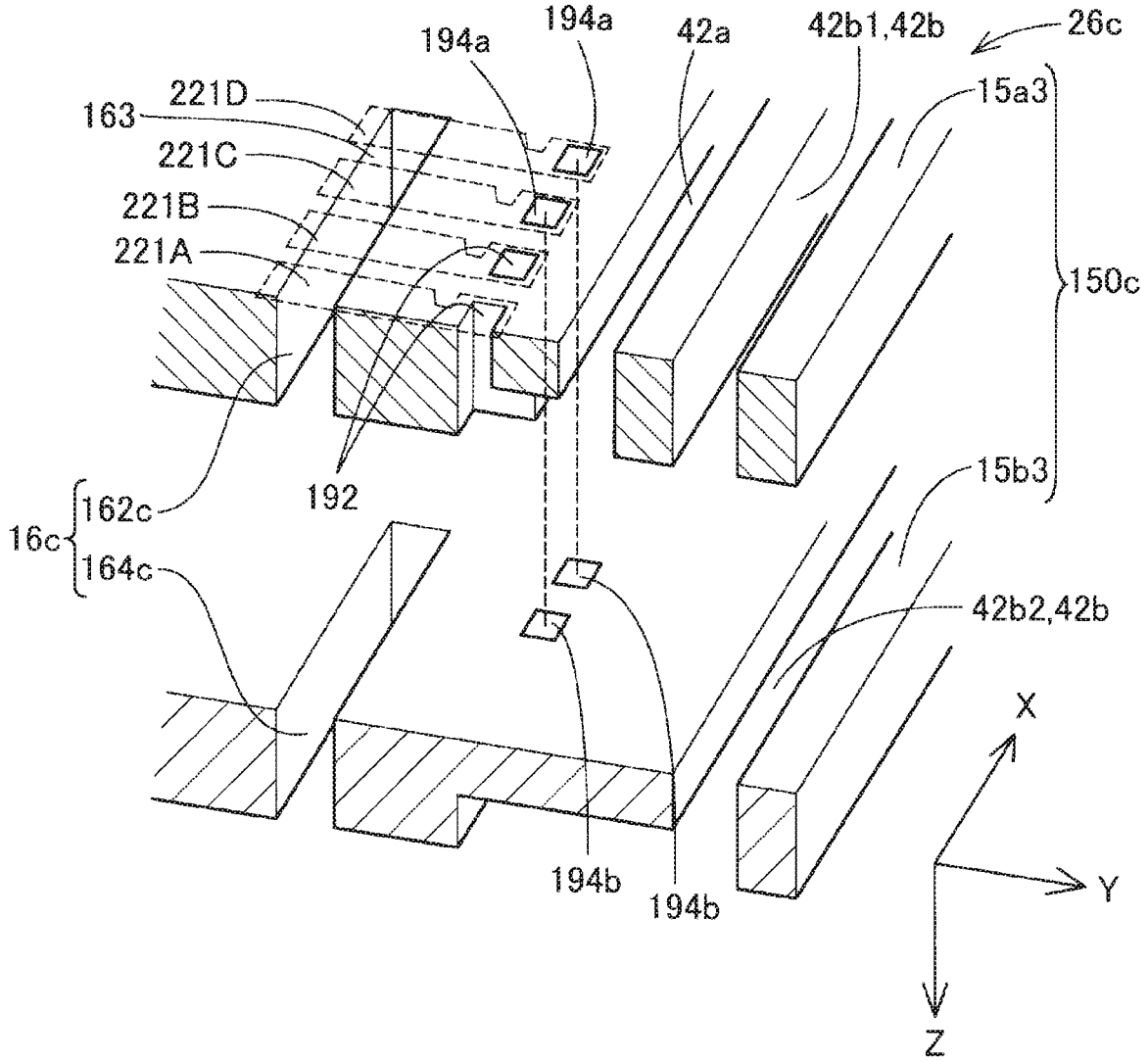
FIG. 22 is an exploded perspective diagram showing a part of a flow path plate according to a fourth embodiment.
Figure 23:
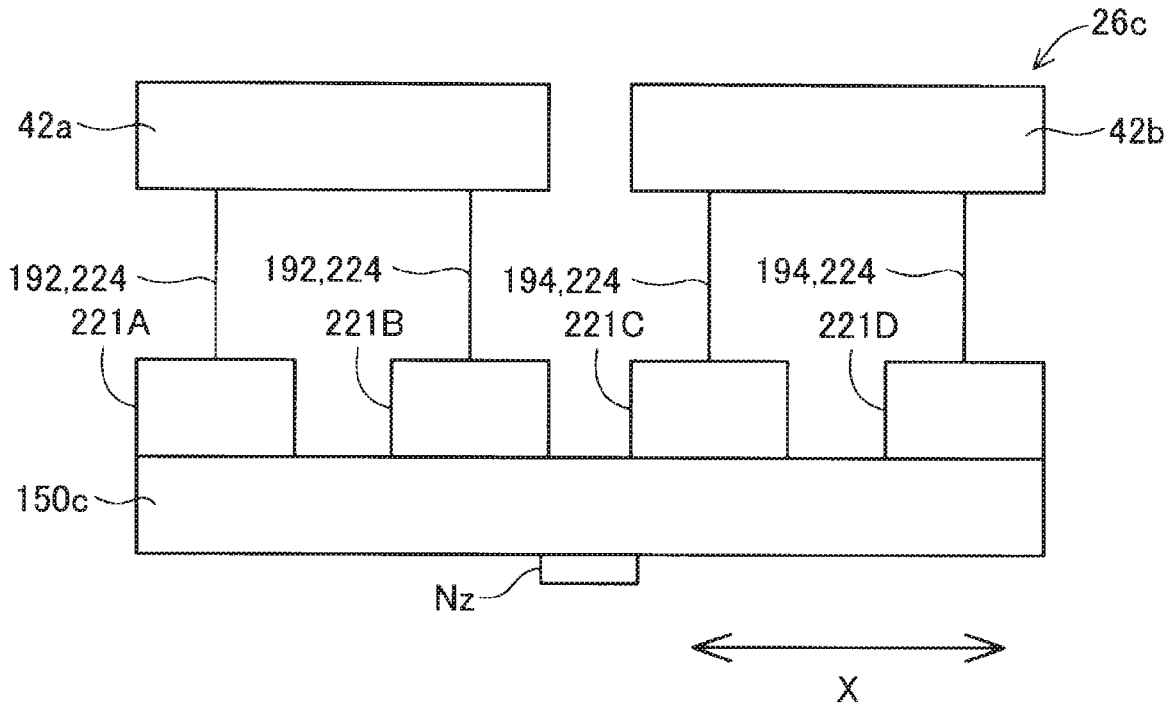
FIG. 23 is a schematic diagram for explaining a flow of a liquid in a liquid discharging head.

FIG. 22 is an exploded perspective diagram showing a part of the flow path plate 150*c* according to a fourth embodiment. FIG. 23 is a schematic diagram for explaining a flow of a liquid in a liquid discharging head 26*c*. FIG. 22 illustrates the configuration of the flow path plate 150*c* communicating with one nozzle Nz. In each embodiment, although the number of pressure chambers 221 communicating with one nozzle Nz is two, it is not limited to this, and may be three or more. The liquid discharging head 26*c* of the fourth embodiment is an example of four pressure chambers 221A, 221B, 221C, and 221D communicating with one nozzle Nz. The difference between the liquid discharging head 26*c* and the liquid discharging head 26 shown in FIG. 6 is the configuration of the flow path plate 150*c*. Since the other configuration of the liquid discharging head 26*c* is the same as the configuration of the liquid discharging head 26 of the first embodiment, the same components are denoted by the same reference numerals and the description thereof is omitted. The number of nozzles Nz constituting the nozzle row of the nozzle plate 20 in the fourth embodiment is half of the number of nozzles Nz constituting the nozzle row of the nozzle plate 20 in the first embodiment.

As shown in FIG. 22, a first flow path plate 15*a*3 has a plurality of sets of two first plate through-holes 194*a* communicating with one nozzle Nz and two first individual flow paths 192. Only one set is shown in FIG. 22. Two individual flow paths 192 are coupled to a first reservoir 42*a*. The two first plate through-holes 194*a* are coupled to two corresponding second plate through-holes 194*b* formed in the second flow path plate 15*b*3. By this, the second reservoir 42*b* is communicated with two second individual flow paths 194 arranged side by side in the first axis direction X. One communication flow path 16*c* commonly communicates with four pressure chambers 221A, 221B, 221C, and 221D arranged side by side in the first axis direction. That is, in plan view, the opening 163 of one communication flow path 16*c* is positioned over the four pressure chambers 221A, 221B, 221C, and 221D along the first axis direction. The communication flow path 16 is formed by the first through-hole flow path 162*c* formed on the first flow path plate 15*a* and the second through-hole flow path 164*c* formed on the second flow path plate 15*b*.

As shown in FIG. 23, the liquid in the first reservoir 42*a* is supplied to the pressure chambers 221A and 221B, and joined in the communication flow path 16*c*. The liquid in the second reservoir 42*b* is supplied to the pressure chambers 221C and 221D, and joined in the communication flow path 16*c*. Liquids in the four pressure chambers 221A, 221B, 221C, and 221D are discharged from the nozzle Nz through the communication flow path 16*c*.

In the embodiment, the second lead electrode 276 coupling four segment electrodes 240 provided in correspondence with each of four pressure chambers 221A, 221B, 221C, and 221D communicating with one nozzle Nz may be made common to the terminal 123. That is, lead wires electrically coupled to the four segment electrodes 240 may join in the middle to form one lead wire. In this way, since it is possible to suppress the shift in driving timing of the four drivers 220 provided in correspondence with each of the four pressure chambers 221A, 221B, 221C, and 221D, it is possible to suppress the lowering in the discharge efficiency of the nozzle Nz.

According to the fourth embodiment, the same effect is achieved in terms of having the same configuration as those of the first embodiment to the third embodiment. For example, when the first pressure chamber 221*a* and the second pressure chamber 221*b* communicate with one nozzle Nz, it is possible to cause larger amount of liquid to be discharged from the nozzle while suppressing increase in volume of each pressure chamber 221.

E. Fifth Embodiment

Figure 24:
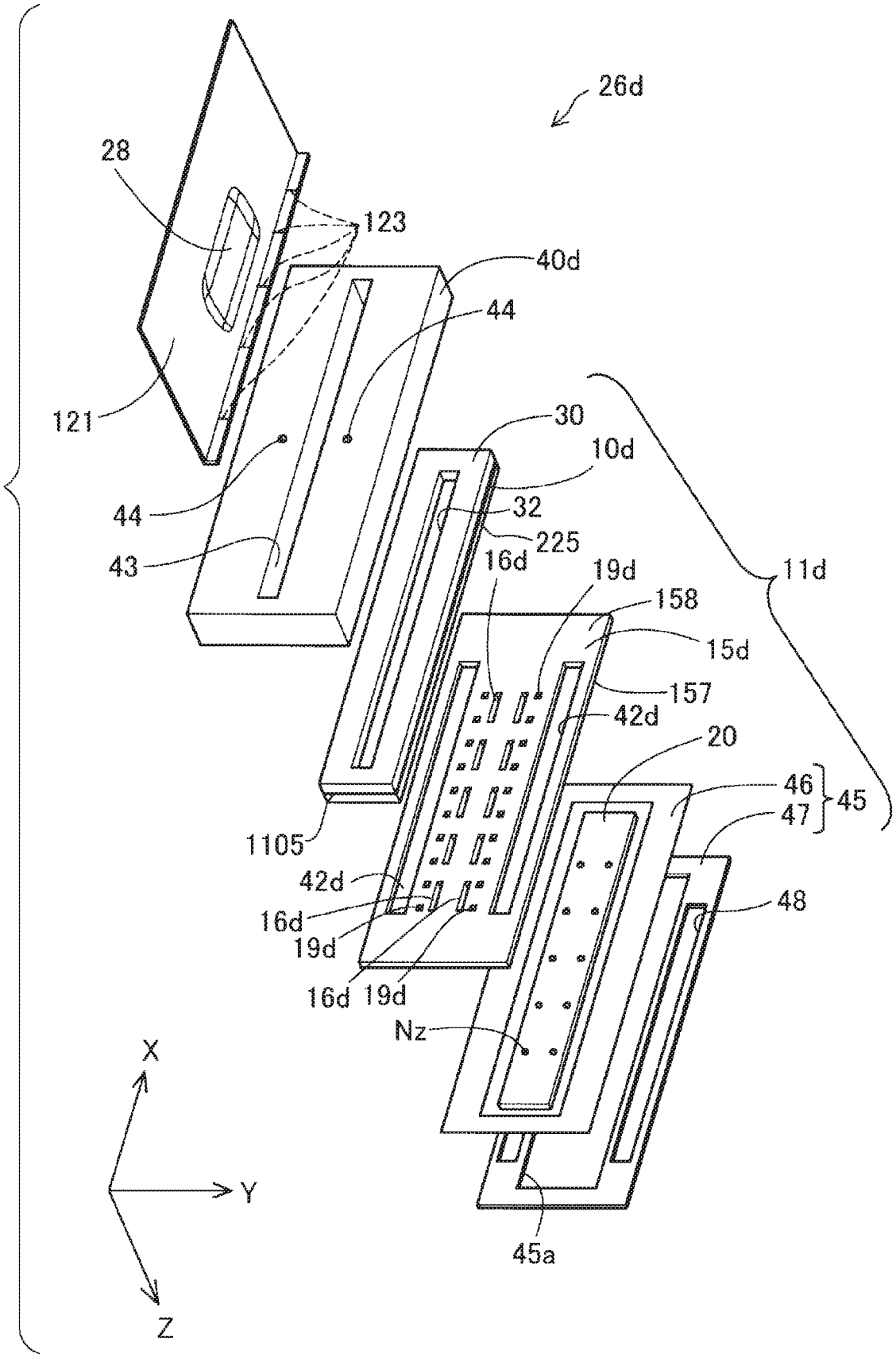
FIG. 24 is an exploded perspective diagram of a liquid discharging head according to a fifth embodiment.
Figure 25:
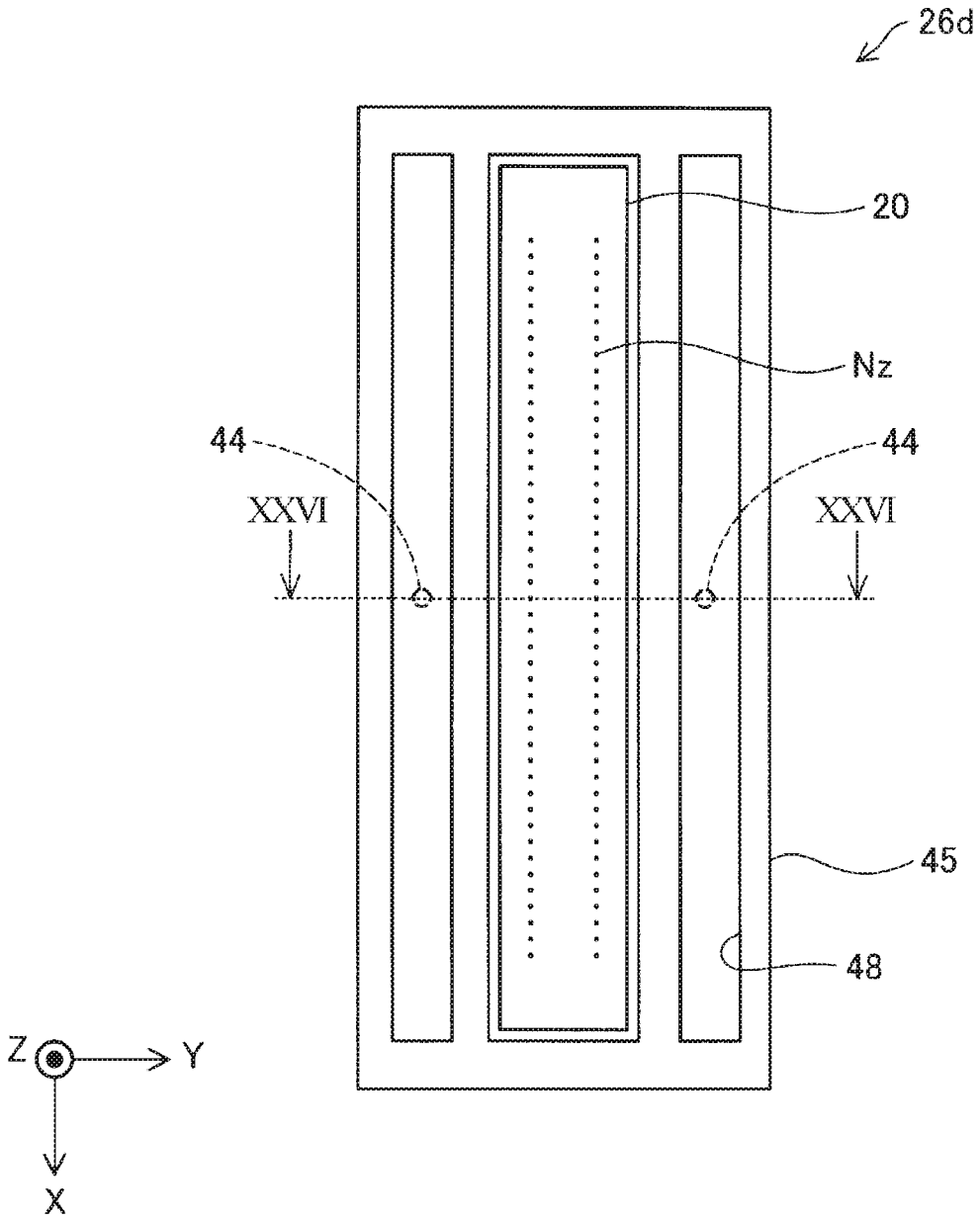
FIG. 25 is a plan diagram showing a side of a liquid discharging head facing a recording medium.
Figure 26:
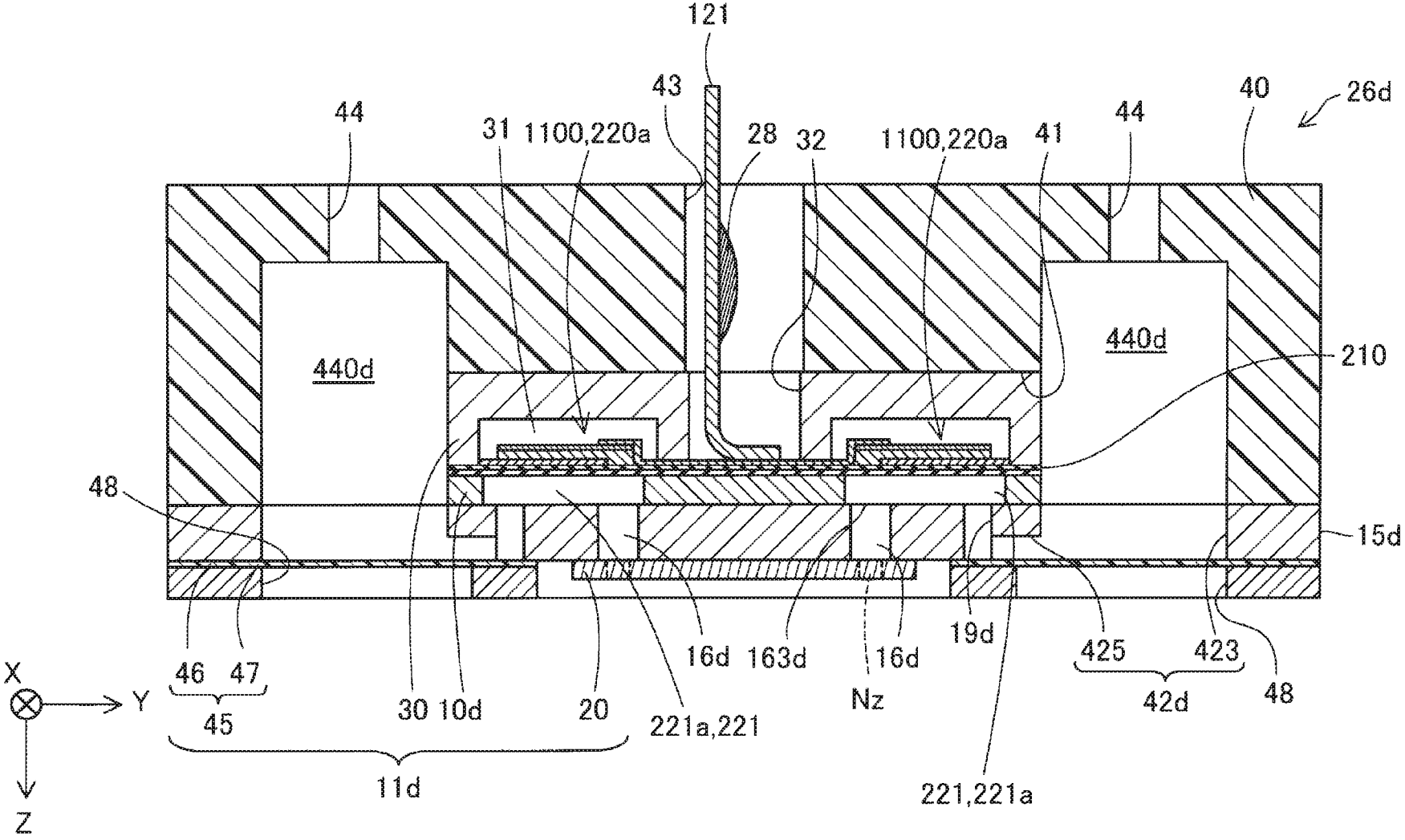
FIG. 26 is a cross-sectional diagram taken along line XXVI-XXVI in FIG. 25.
Figure 27:
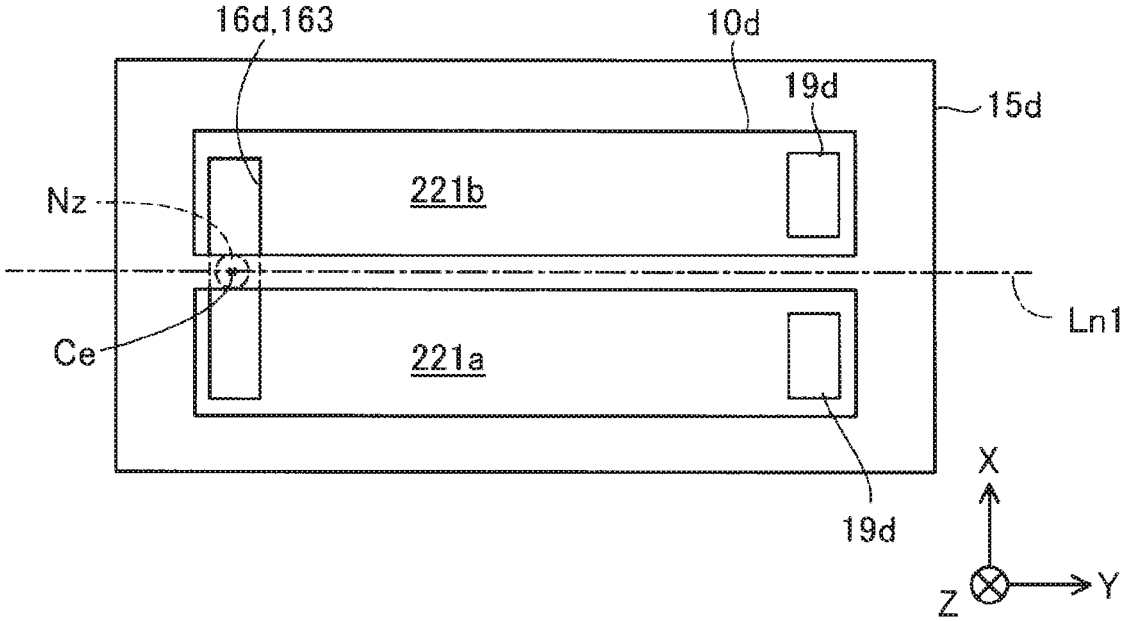
FIG. 27 is a schematic diagram when a flow path forming substrate and a flow path plate are viewed in plan view.

FIG. 24 is an exploded perspective diagram of a liquid discharging head 26*d* according to a fifth embodiment. FIG. 25 is a plan diagram showing a side of the liquid discharging head 26*d* facing a recording medium. FIG. 26 is a cross-sectional diagram taken along line XXVI-XXVI in FIG. 25. FIG. 27 is a schematic diagram when the flow path forming substrate 10*d* and the flow path plate 15*d* are viewed in plan from a minus side in the third axis direction Z. The main difference between the liquid discharging head 26 of the first embodiment shown in FIG. 4 and the liquid discharging head 26*d* of the fifth embodiment is that, the first pressure chamber 221*a* and the second pressure chamber 221*b* communicate with one common reservoir 42*d* and the configuration of the flow path forming substrate 10*d* and the case member 40*d*. The same reference numerals are given to the same components in the liquid discharging head 26*d* of the fifth embodiment and the liquid discharging head 26 of the first embodiment, and description thereof is omitted.

As shown in FIG. 24, the case member 40*d* has one introduction hole 44 for one nozzle row extending in the first axis direction X. In the embodiment, since the number of the nozzle rows is two, two introduction holes 44 are provided. As shown in FIG. 26, the case member 40*d* has a common liquid chamber 440*d* coupled to the introduction hole 24. The common liquid chamber 440*d* extends along the third axis direction Z.

The chamber plate 13*d* is one sheet-like member. As shown in FIG. 26, the chamber plate 13*d* can be formed of a material similar to that in the first embodiment. In the embodiment, the chamber plate 13*d* is formed of a silicon single crystal substrate. The chamber plate 13*d* is provided with a plurality of pressure chambers 221 formed by anisotropic etching from one surface side. The pressure chamber 221 is a rectangular parallelepiped space. The pressure chambers 221 are arranged side by side along the first axis direction X. Two chamber rows in which the pressure chambers 221 are arranged along the first axis direction X are formed corresponding to the nozzle rows. Two adjacent pressure chambers 221 among the plurality of pressure chambers arranged along the first axis direction X include the first pressure chamber 221*a* and the second pressure chamber 221*b* commonly communicated with one nozzle Nz as in the first embodiment. FIG. 26 shows a cross section of the liquid discharging head 26*d* passing through the first pressure chamber 221*a*.

As shown in FIG. 24, the flow path plate 15*d* has the plate first surface 157 facing the nozzle plate 20 and the plate second surface 158 as the second surface facing the flow path forming substrate 10. The flow path plate 15*d* is rectangular in plan view and has an area larger than that of the flow path forming substrate 10. The plate second surface 158 is bonded to the first surface 225 of the flow path forming substrate 10. Metal such as stainless steel and nickel or ceramics such as zirconium can be used as the base material of the flow path plate 15*d*. As in the first embodiment, the flow path plate 15*d* is preferably formed of a material having the same linear expansion coefficient as that of the flow path forming substrate 10.

The flow path plate 15*d* is provided with, for each nozzle row, a reservoir 42*d*, a plurality of individual flow paths 19*d* provided in correspondence with each pressure chamber 221, and the communication flow path 16*d* provided in correspondence with each set of the first pressure chamber 221*a* and the second pressure chamber 221*b*.

As shown in FIG. 26, the reservoir 42*d* is constituted by a first manifold portion 423 and a second manifold portion 425. The reservoir 42*d* extends over a range where a plurality of pressure chambers 221 arranged along the first axis direction X are located in the first axis direction X. The first manifold portion 423 is an opening penetrating the flow path plate 15*d* in the plan view direction that is the thickness direction. The second manifold portion 425 is an opening extending inward in the in-plane direction of the flow path plate 15*d* from the first manifold portion 423. An opening of the reservoir 42*d* on the nozzle Nz side is sealed by the flexible member 46.

The individual flow path 19*d* is provided for each pressure chamber 221. The individual flow path 19*d* is a through-hole penetrating the flow path plate 15*d* in the third axis direction Z which is the plan view direction. The individual flow path 19*d* is rectangular in plan view. In the individual flow path 19*d*, an upstream end is coupled to the second manifold portion 425, and a downstream end is coupled to the pressure chamber 221.

The communication flow path 16*d* is a through-hole penetrating the flow path plate 15*d* in the third axis direction Z. The communication flow path 16*d* communicates with the first pressure chamber 221*a* and the second pressure chamber 221*b* which commonly communicate with one nozzle Nz. The communication flow path 16*d* is rectangular in plan view. As shown in FIG. 27, an opening 163*d* of the communication flow path 16*d* is formed over the first pressure chamber 221*a* and the second pressure chamber 221*b*.

In the same way as the first embodiment, the first pressure chamber 221*a* and the second pressure chamber 221*b* adjacent to each other are formed substantially in line symmetry with respect to a first virtual line Ln1 in plan view, and the communication flow path 16*d* is preferably formed substantially in line symmetry with respect to the first virtual line Ln1 in plan view. As in the first embodiment, a nozzle Nz communicating with the first pressure chamber 221*a* and the second pressure chamber 221*b* adjacent to each other is preferably disposed to overlap the first virtual line Ln1 in plan view.

According to the fifth embodiment, the same effect is achieved in terms of having the same configuration as those of the first embodiment to the fourth embodiment. For example, when the first pressure chamber 221*a* and the second pressure chamber 221*b* communicate with one nozzle Nz, it is possible to cause larger amount of liquid to be discharged from the nozzle while suppressing increase in volume of each pressure chamber 221.

F. Sixth Embodiment

In the liquid discharging heads 26 to 26*d* of the first embodiment to the fifth embodiment, the first coupling flow path 198 is configured to be shorter than the second coupling flow path 199 as shown in FIGS. 7 and 8. That is, a relationship in which the inertance ITF1 of the first coupling flow path 198 is smaller than the inertance ITF2 of the second coupling flow path 199. A preferred aspect in the liquid discharging heads 26 to 26*d* having this relationship will be described as a sixth embodiment. Hereinafter, the sixth embodiment as a preferred aspect will be described with the liquid discharging head 26*ba* which is a preferred aspect of the third embodiment in which the communication flow path 292 is formed in the nozzle plate 20*b* as an example.

Figure 28:
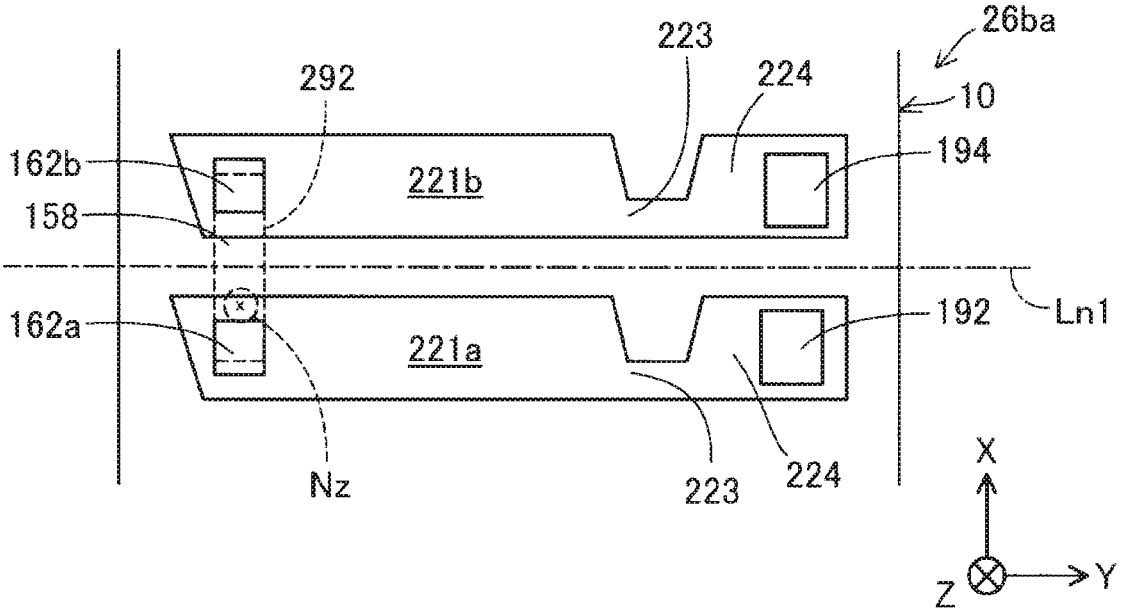
FIG. 28 is a diagram equivalent to FIG. 21.
Figure 29:
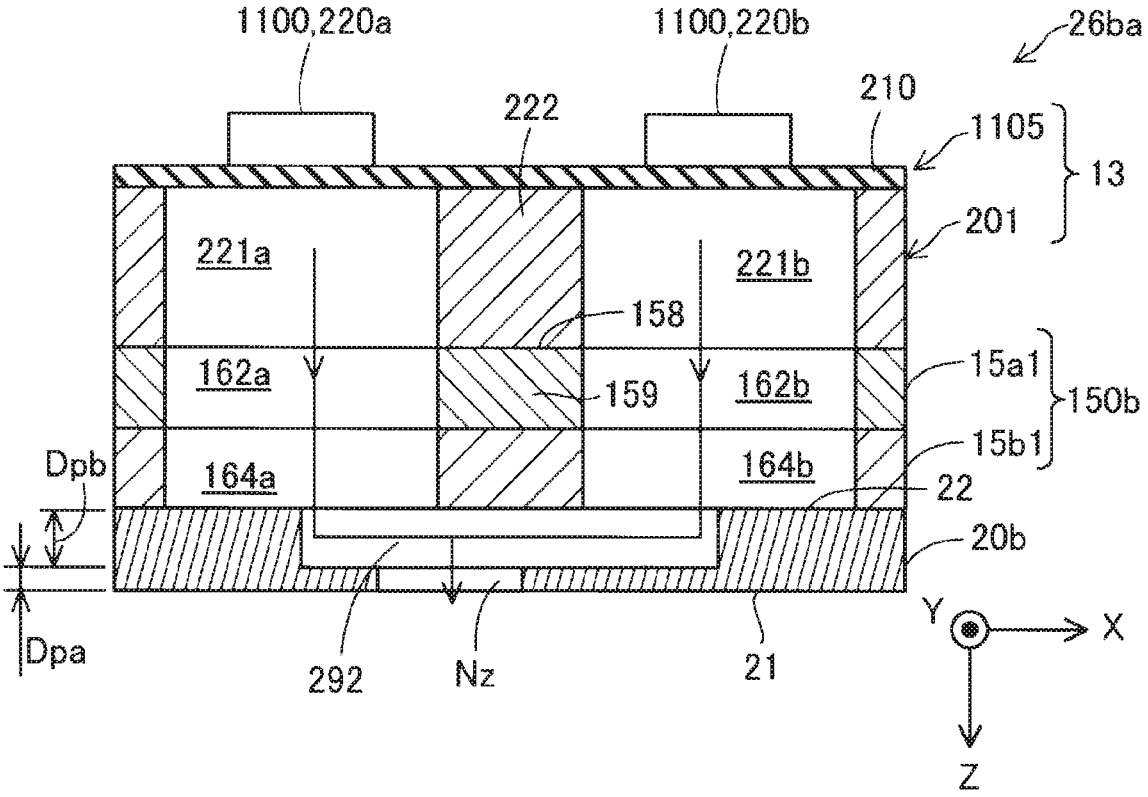
FIG. 29 is a diagram equivalent to FIG. 20.

FIG. 28 is a diagram equivalent to FIG. 21. FIG. 29 is a diagram equivalent to FIG. 20. The difference between the liquid discharging head 26*ba* and the liquid discharging head 26*b* of the third embodiment is a forming position of the nozzle Nz. Since the other configuration of the liquid discharging head 26*ba* is the same as the configuration of the liquid discharging head 26*b*, the same components are denoted by the same reference numerals and the description thereof is omitted. As shown in FIG. 28, the nozzle Nz is formed closer to the first pressure chamber 221*a* than to the second pressure chamber 221*b* in plan view. By this, as shown in FIG. 29, a first flow path length, which is a flow path length from one nozzle Nz to the first pressure chamber 221*a*, is shorter than a second flow path length, which is a flow path length from one nozzle Nz to the second pressure chamber 221*b*. Therefore, a first inertance ITN1 from one nozzle Nz to the first pressure chamber 221*a* is smaller than a second inertance ITN2 from the one nozzle Nz to the second pressure chamber. The inertance ITF on the coupling flow paths 198 and 199 side and the inertance ITN on the nozzle Nz side as viewed from the pressure chambers 221*a* and 221*b* affect ink discharge efficiency from the pressure chambers 221*a* and 221*b* to the nozzle Nz. For example, when the inertance ITF on the coupling flow paths 198 and 199 side becomes relatively large, the efficiency of the flow from the pressurized pressure chambers 221*a* and 221*b* to the nozzle Nz, that is, the discharge efficiency becomes relatively large. On the other hand, when the inertance ITN on the nozzle Nz side becomes relatively large, the discharge efficiency from the pressurized pressure chambers 221*a* and 221*b* becomes relatively small. Therefore, the difference in inertance between the first coupling flow path 198 and the second coupling flow path 199 may cause an imbalance of discharge efficiency from the nozzle Nz between the first pressure chamber 221*a* and the second pressure chamber 221*b*. For example, when ITF1<ITF2 for the inertance on the coupling flow paths 198 and 199 side is established, if the relationship of ITN1=ITN2 for the inertance on the nozzle Nz side, the discharge efficiency from the second pressure chamber 221*b* becomes greater than the discharge efficiency from the first pressure chamber 221*a*. By this, the imbalance of discharge efficiency between the pressure chambers 221*a* and 221*b* occurs. In order to compensate for or reduce such imbalance, it is preferable that a relationship of ITN1<ITN2 is established with respect to the inertance on the nozzle Nz side.

In the sixth embodiment, the first inertance ITN1 is made smaller than the second inertance ITN2 by making the first flow path length shorter than the second flow path length. However, as long as the first inertance INT1 becomes smaller than the second inertance ITN2, another configuration may be adopted. For example, by making the cross-sectional area of at least some of the flow paths among the flow paths from one nozzle Nz to the second pressure chamber 221*b* smaller than the cross-sectional area of the flow path from one nozzle Nz to the first pressure chamber 221*a*, the first inertance INT1 may be smaller than the second inertance ITN2.

G. Seventh Embodiment

In the liquid discharging heads 26 to 26*d* of the first embodiment to the fifth embodiment, the first coupling flow path 198 is configured to be shorter than the second coupling flow path 199 as shown in FIGS. 7 and 8. Therefore, when the flow path shapes of the first coupling flow path 198 and the second coupling flow path 199 are the same, the relationship in which the inertance ITF1 of the first coupling flow path 198 is smaller than the inertance ITF2 of the second coupling flow path 199 is established. When the relationship in which the inertance ITF1 of the first coupling flow path 198 is smaller than the inertance ITF2 of the second coupling flow path 199 is established, there may be an imbalance in the ease of liquid flow between the first coupling flow path 198 and the second coupling flow path 199. In the following, a preferred aspect when the first coupling flow path 198 is shorter than the second coupling flow path 199 will be described as a seventh embodiment. In the following, a seventh embodiment as a preferred aspect will be described by taking a liquid discharging head 26*bb* which is a preferred aspect of the third embodiment in which the communication flow path 292 is formed in the nozzle plate 20*b* as an example.

Figure 30:
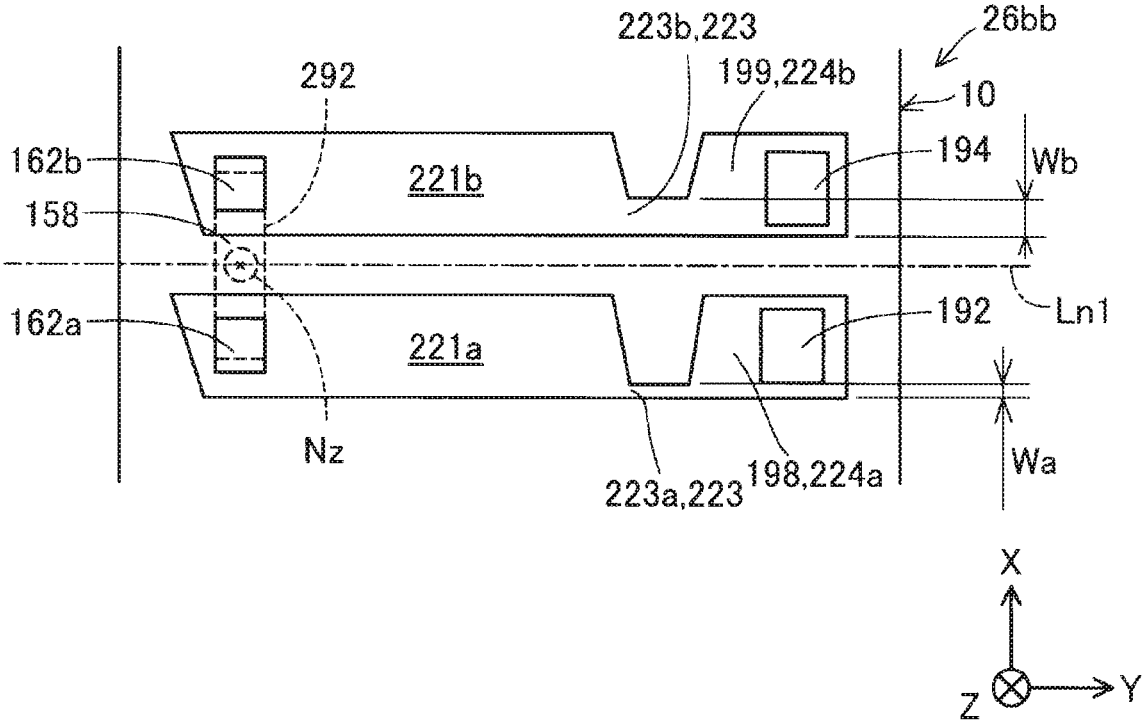
FIG. 30 is a diagram equivalent to FIG. 21.

FIG. 30 is a diagram equivalent to FIG. 21. A difference between the liquid discharging head 26*bb* of the seventh embodiment and the liquid discharging head 26*b* of the third embodiment is the relationship between the flow path cross-sectional areas of the downstream end 223*b* of the second supply flow path 224*b* constituting the second coupling flow path 199 and the downstream end 223*a* of the first supply flow path 224*a* constituting the first coupling flow path 198. Since the other configuration of the liquid discharging head 26*bb* is the same as the configuration of the liquid discharging head 26*b*, the same components are denoted by the same reference numerals and the description thereof is omitted. A flow path width Wa of the downstream end 223*a* is narrower than a flow path width Wb of the downstream end 223*b*. By this, the flow path cross-sectional area of the downstream end 223*a* is smaller than the flow path cross-sectional area of the downstream end 223*b*. By this, even when the flow path length of the second coupling flow path 199 is greater than the flow path length of the first coupling flow path 198, the inertance of the second coupling flow path 199 and the inertance of the first coupling flow path 198 can be prevented from deviating greatly.

In the seventh embodiment, the flow path widths Wa and Wb are preferably set such that the inertance of the first coupling flow path 198 and the inertance of the second coupling flow path 199 are approximately the same. Further, in place of the flow path widths Wa and Wb of the downstream ends 223*a* and 223*b*, the flow path cross-sectional area of the other portion of the first coupling flow path 198 may be made smaller than the flow path cross-sectional area of the second coupling flow path 199. That is, the liquid discharging head 26*bb* may be configured such that at least a part of the first coupling flow path 198 is smaller than the flow path cross-sectional area of the second coupling flow path 199. In this way, it is possible to suppress the large deviation between the inertance of the second coupling flow path 199 and the inertance of the first coupling flow path 198.

H. Eighth Embodiment

As shown in FIGS. 10 to 12, in the liquid discharging apparatus 100 of the first to seventh embodiments, the first segment electrode 240*a* corresponding to the first pressure chamber 221*a* communicating with one nozzle Nz and the second segment electrode 240*b* corresponding to the second pressure chamber 221*b* communicating with one nozzle Nz are electrically coupled to the terminal 123 by the common second lead electrode 276. However, the first segment electrode 240*a* and the second segment electrode 240*b* may be electrically coupled to each terminal 123 by separate second lead electrodes 276. That is, drive pulses independent of each other may be supplied to the first segment electrode 240*a* and the second segment electrode 240*b*. That is, the first driver 220*a* as the first drive element for varying the liquid pressure of the first pressure chamber 221*a* and the second driver 220*b* as the second drive element for varying the liquid pressure of the second pressure chamber 221*b* can be driven independently of each other. In this way, the degree of freedom of the discharge control of the liquid in the liquid discharging heads 26 to 26*bb* is improved.

For example, since in the liquid discharging head 26 of the first embodiment shown in FIG. 9, the opening 163 of the communication flow path 16 and the respective openings of the first pressure chamber 221*a* and the second pressure chamber are in contact with each other, crosstalk is likely to occur between the first pressure chamber 221*a* and the second pressure chamber 221*b*. The crosstalk is a phenomenon in which pressure fluctuation generated in one pressure chamber 221 propagates to the other pressure chamber 221. Therefore, the liquid discharging apparatus 100 preferably drives the first driver 220*a* and the second driver 220*b* independently so as to suppress crosstalk generated between the first pressure chamber 221*a* and the second pressure chamber 221*b*. Hereinbelow, a specific example thereof will be described.

Figure 31:
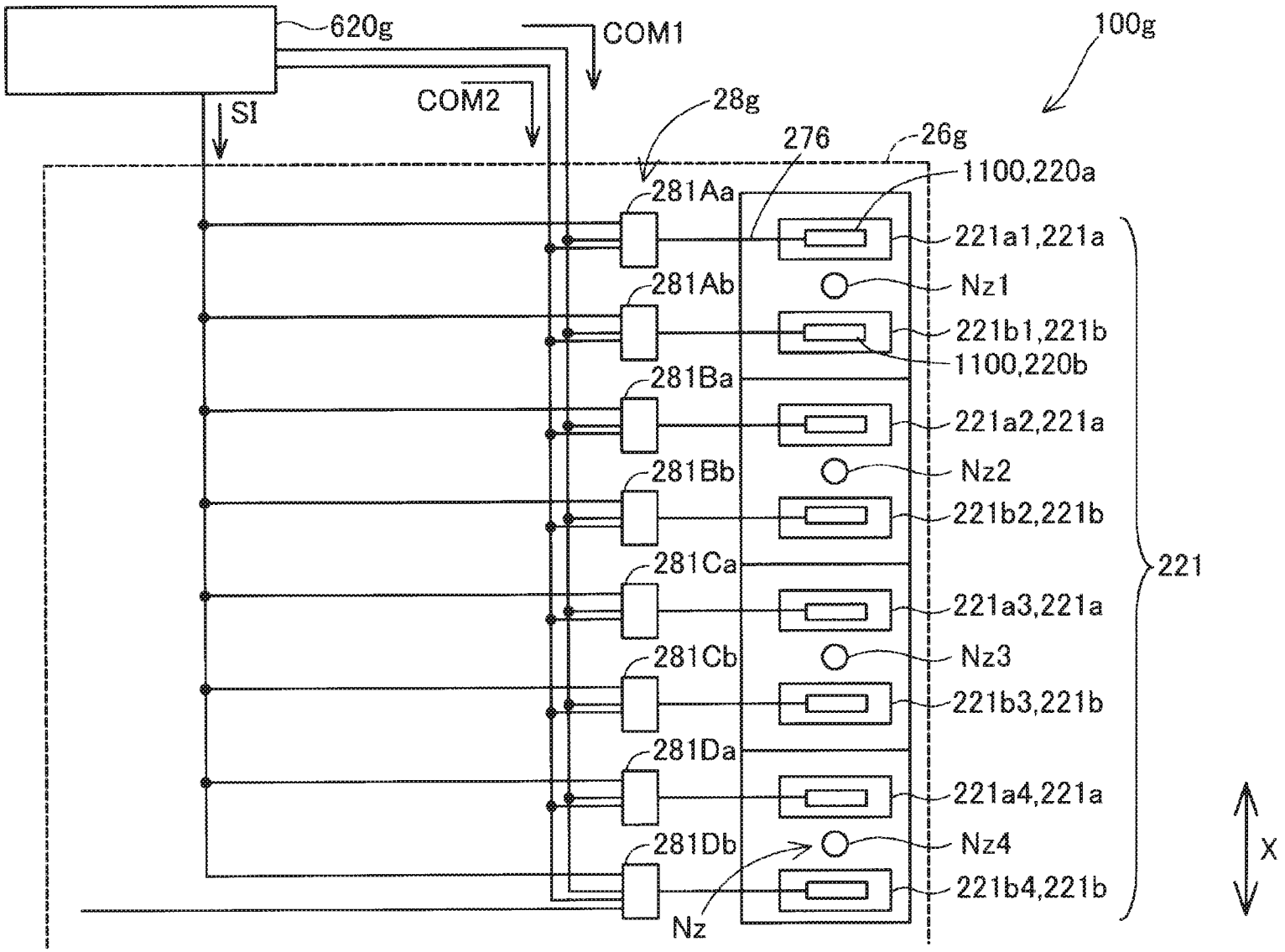
FIG. 31 is a functional configuration diagram of a liquid discharging head according to an eighth embodiment.
Figure 32:
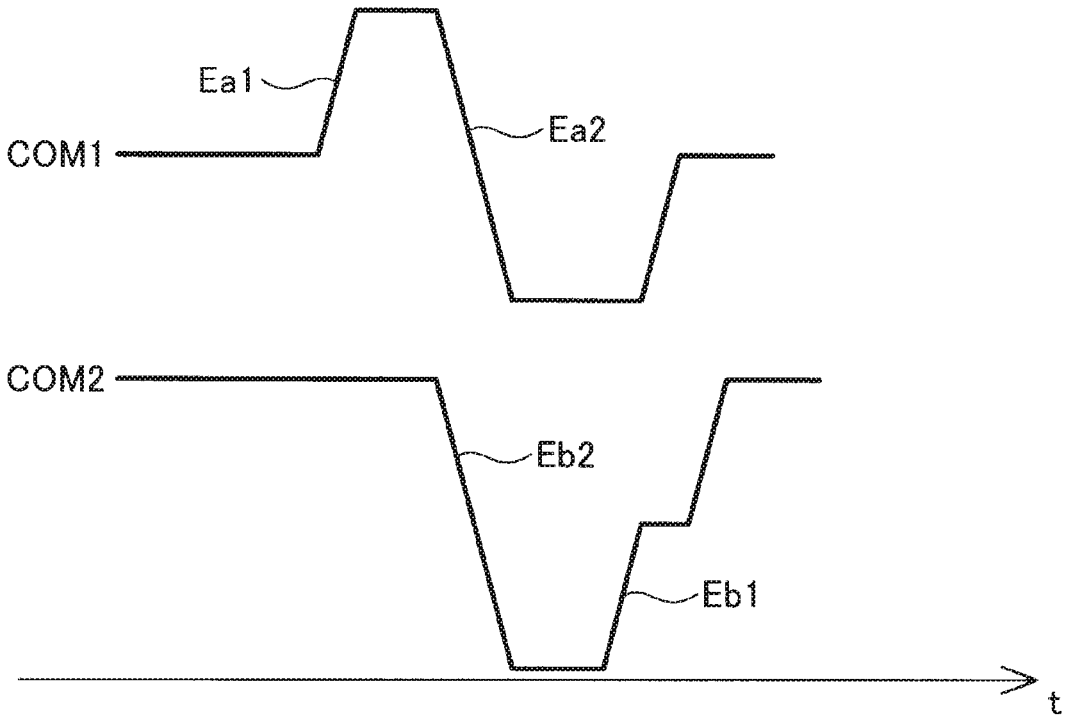
FIG. 32 is a diagram for explaining a first drive pulse and a second drive pulse.

FIG. 31 is a functional configuration diagram of a liquid discharging head 26*g* provided in a liquid discharging apparatus 100*g* which is a specific example of an eighth embodiment. FIG. 32 is a diagram for explaining a first drive pulse COM1 and a second drive pulse COM2. The difference between the liquid discharging apparatus 100*g* according to the eighth embodiment and the liquid discharging apparatuses 100 according to the first to seventh embodiments is that the second lead electrode 276 is provided for each of the first driver 220*a* and the second driver 220*b*, and that a control unit 620*g* can generate two drive pulses COM1 and COM2.

As shown in FIG. 32, the first drive pulse COM1 and the second drive pulse COM2 are different drive pulses. The "different drive pulses" mean that the inclination of the contraction component or the expansion component constituting at least the drive pulses, the timing of application, and the timing of termination of application are different. The contraction and expansion are the state changes in the pressure chamber 221. That is, the contraction is to reduce the volume of the pressure chamber 221 and pressurize the pressure chamber 221 by deforming the wall forming the pressure chamber 221 inward. The expansion means is to expand the volume of the pressure chamber 221 and decompress the pressure chamber 221 by deforming the wall forming the pressure chamber 221 outward.

As shown in FIG. 32, the first drive pulse COM1 has an expansion component Ea1 and a contraction component Ea2. When the expansion component Ea1 is applied to the driver 220, the pressure chamber 221 is pressurized. On the other hand, when the contraction component Ea2 is applied to the driver 220, the pressure chamber 221 is decompressed. Further, the second drive pulse COM2 has an expansion component Eb1 and a contraction component Eb2.

As shown in FIG. 31, a nozzle drive circuit 28*g* has switch circuits 281Aa to Db corresponding to respective drivers 220. A first drive pulse COM1, a second drive pulse COM2, and a pulse selection signal SI are supplied to each of the switch circuits 281Aa to 281Db from the control unit 620*g*. The pulse selection signal SI is a signal for selecting which of the first drive pulse COM1 and the second drive pulse COM2 is applied to the driver 220. For example, when the pulse selection signal SI is a signal for selecting a first drive pulse COM1, the switch circuit 281 controls the operation of the circuit so as to apply the first drive pulse COM1 to the driver 220.

The nozzle drive circuit 28*g* may apply the first drive pulse COM1 to the first driver 220*a* and apply the second drive pulse COM2 to the second driver 220*b*. In this case, as shown in FIG. 32, the nozzle drive circuit 28*g* preferably synchronizes the start timing of the contraction component with respect to the first driver 220*a* corresponding to the first pressure chamber 221*a* and the second driver 220*b* corresponding to the second pressure chamber 221*b* so that the natural vibration of the vibration plate 210 due to the pressurized component is in phase.

Here, the respective components of the drive pulses COM1 and COM2 and the application timing may be appropriately determined according to the product specification and the characteristics of the liquid discharging head 26 to be used. For example, as shown in FIG. 32, the drive pulses COM1 and COM2 having completely different shapes may be used to apply various gradation changes of the droplet amount. Further, in the case of the liquid discharging head 26 as shown in FIG. 9, since the partition wall 222 of the second region R2 is not restricted, the influence of crosstalk vibration from the adjacent pressure chamber 221 is easily increased. In such a case, extremely large discharge efficiency can be obtained by designing the drive pulses COM1 and COM2 using a tuning condition with the crosstalk vibration. In addition, as described in the first embodiment, the adjacent pressure chambers 221 may be designed to be driven at exactly the same drive pulse and the application timing.

I. Ninth Embodiment

Figure 33:
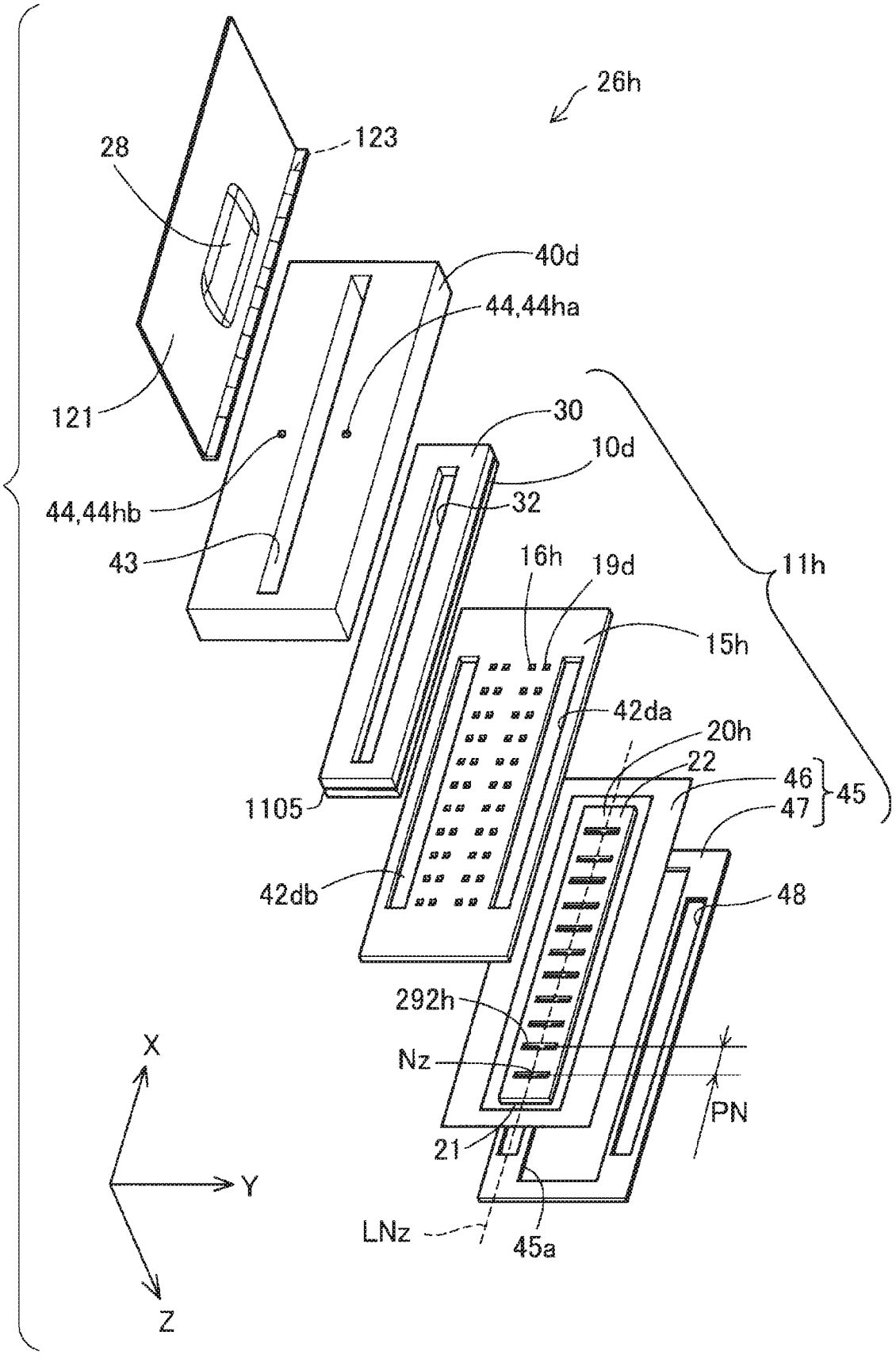
FIG. 33 is an exploded perspective diagram of a liquid discharging head according to a ninth embodiment.
Figure 34:
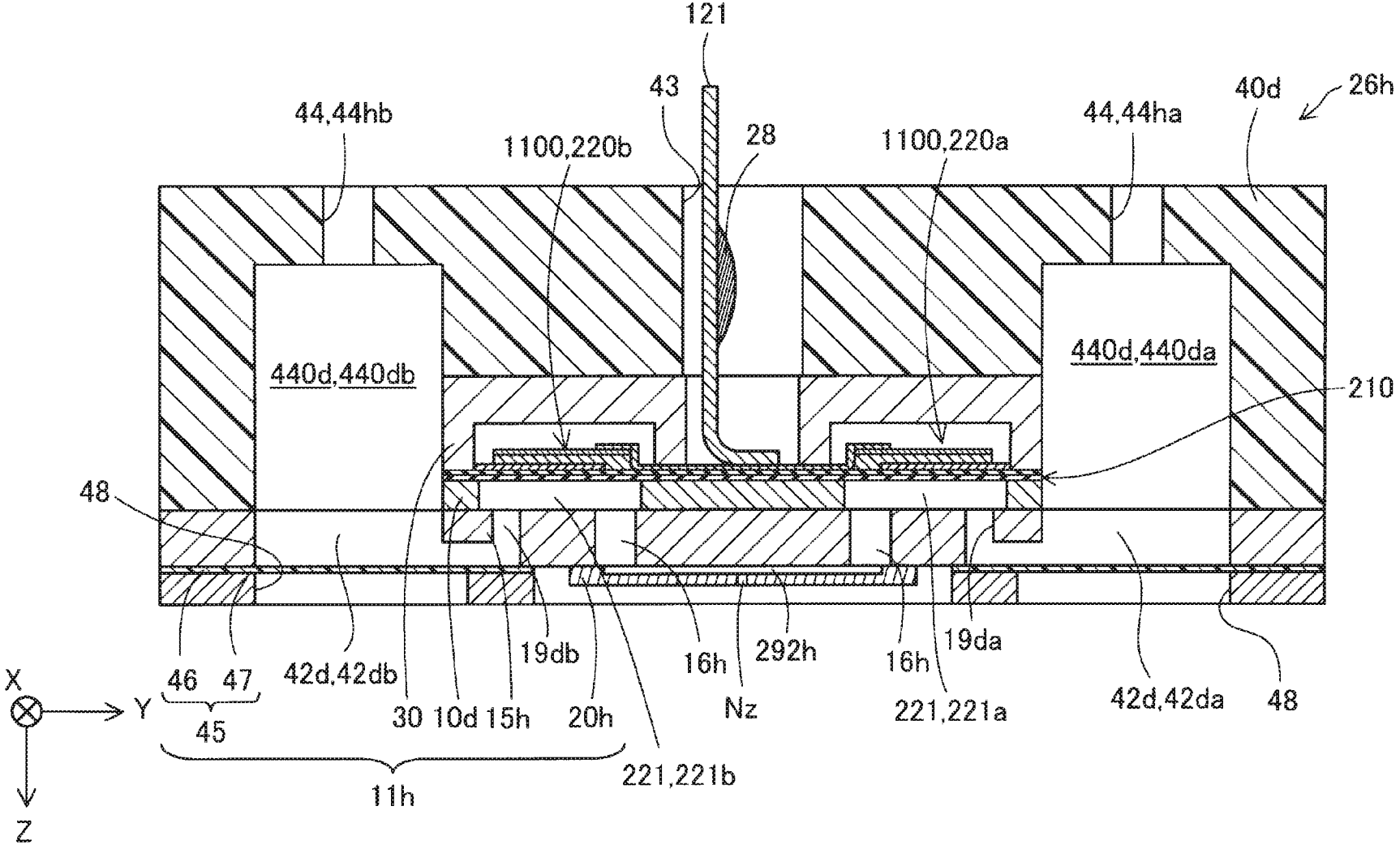
FIG. 34 is a cross-sectional diagram of a liquid discharging head cut along a YZ plane through which one nozzle passes.

FIG. 33 is an exploded perspective diagram of a liquid discharging head 26*h* according to a ninth embodiment. FIG. 34 is a cross-sectional diagram of the liquid discharging head 26*h* cut along the YZ plane through which one nozzle Nz passes. The difference between the liquid discharging head 26*d* and the liquid discharging head 26*h* in the fifth embodiment shown in FIG. 24 is as follows. That is, as shown in FIG. 34, the liquid discharging head 26*h* and the liquid discharging head 26*d* are different in that, the first pressure chamber 221*a* and the second pressure chamber 221*b* in which the liquid discharging head 26*h* is arranged in the second axis direction Y intersecting the first axis direction X, that is, orthogonal to the first axis direction X in the present embodiment, communicate with one nozzle Nz through one communication flow path 292*h*, and in that the communication flow path 292*h* is formed in the nozzle plate 20*h*. In the ninth embodiment, the same components as those in the fifth embodiment are denoted by the same reference numerals and description thereof is omitted.

As shown in FIG. 34, one of two introduction holes 44 of the case member 40*d* arranged at intervals in the second axis direction Y functions as a first introduction hole 44*ha* coupled to the first pressure chamber 221*a* via the first common liquid chamber 440*da*, the first reservoir 42*da*, and the first individual flow path 19*da*. Further, the other of the two introduction holes 44 functions as a second introduction hole 44*hb* coupled to the second pressure chamber 221*b* via a second common liquid chamber 440*db*, a second reservoir 42*db*, and a second individual flow path 19*db*.

An intermediate coupling flow path 16*h* for coupling each pressure chamber 221 to a corresponding communication flow path 292*h* is formed in a flow path plate 15*h* of a head main body 11*h*. The intermediate coupling flow path 16*h* is a hole penetrating the flow path plate 15*h* in plan view direction. Liquids in the first pressure chamber 221*a* and the second pressure chamber 221*b* communicating with one nozzle Nz are joined together in the communication flow path 292*h* through the corresponding intermediate coupling flow path 16*h*.

As shown in FIG. 33, the communication flow path 292*h* is formed on the second surface 22. The communication flow path 292*h* is an opening extending from the second surface 22 toward the first surface 21 side. The communication flow path 292*h* extends along the second axis direction Y. In the second axis direction Y, the nozzle Nz is formed at the central portion of the communication flow path 292*h*. The nozzle plate 20*h* has a plurality of nozzles Nz. The plurality of nozzles Nz form a nozzle row LNz arranged along the first axis direction X. The nozzle pitch PN in this embodiment is half of a pitch of liquid discharging heads 26 to 26*g* in the first to eighth embodiments, and is a pitch of 300 dpi. The communication flow path 292*h* is rectangular, and the nozzle Nz is circular in plan view.

Further, the liquid discharging head 26*h* of the embodiment may adopt disclosure contents of the liquid discharging heads 26 to 26*g* of the first to eighth embodiments within the applicable range. For example, in plan view, the communication flow path 292*h* may be formed in a region larger than the coupled nozzle Nz. That is, in plan view, the nozzle Nz is arranged inside the contour of the communication flow path 292*h*. The depth dimension Dpb of the communication flow path 292*h* may be equal to or larger than the depth dimension Dpa of the nozzle Nz. The depth dimension Dpb may be twice the depth dimension Dpa or less. In the embodiment, the depth dimension Dpa of the nozzle Nz is 25 μm to 40 μm, and the depth dimension Dpb of the communication flow path 292 is 30 μm to 70 μm.

According to the ninth embodiment, one first pressure chamber 221*a* and the other second pressure chamber 221*b* of the two chamber rows communicate with one nozzle Nz through the communication flow path 292*h*. In this way, as in the above-described first embodiment, it is possible to cause larger amount of liquid to be discharged from the nozzle while suppressing increase in volume of each pressure chamber 221. Further, according to the ninth embodiment, the same effect is achieved in terms of having the same configuration as those of the first embodiment to the ninth embodiment.

J. Tenth Embodiment

Figure 35:
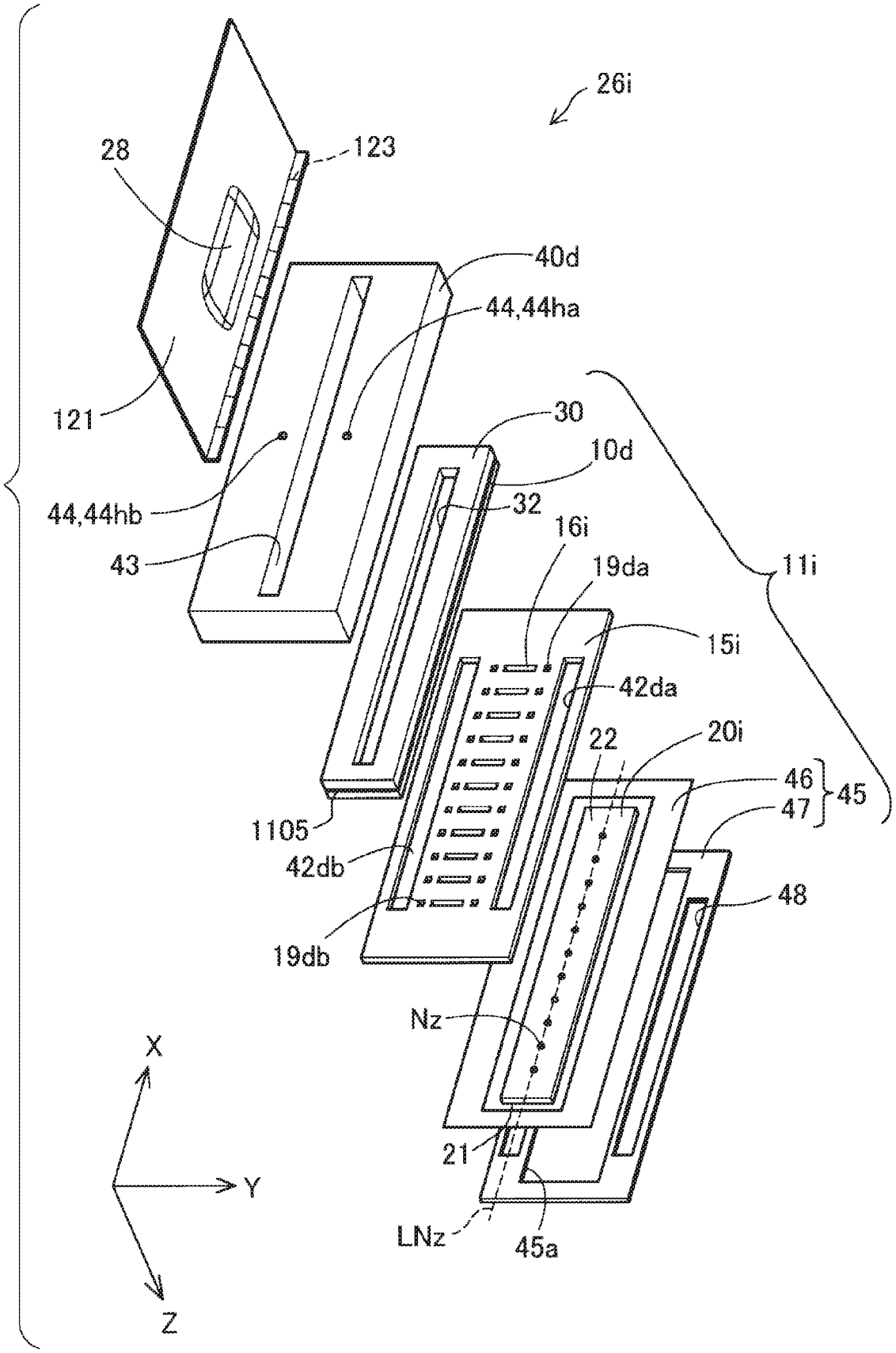
FIG. 35 is an exploded perspective diagram of a liquid discharging head according to a tenth embodiment.
Figure 36:
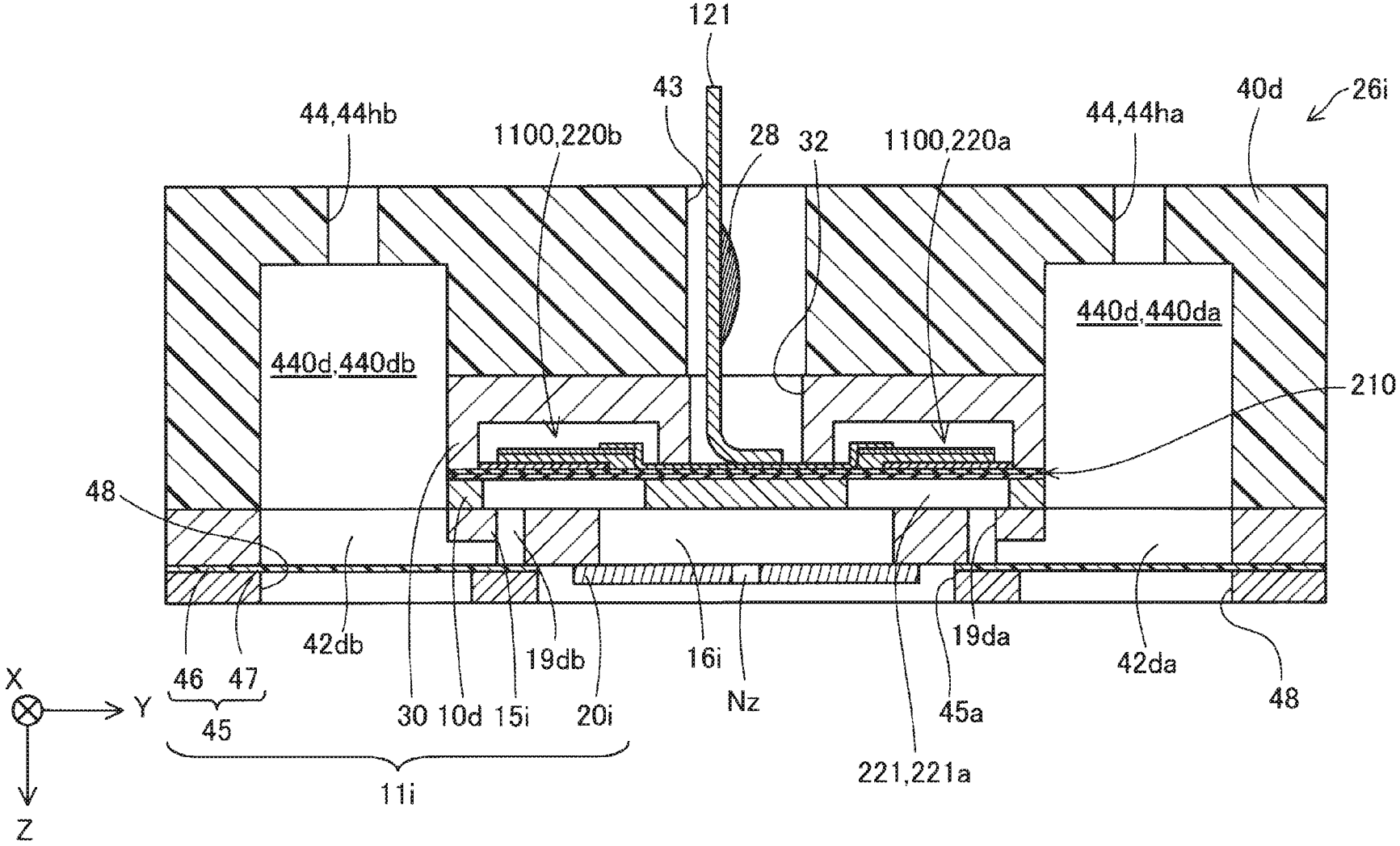
FIG. 36 is a cross-sectional diagram of a liquid discharging head cut along a YZ plane through which one nozzle passes.

FIG. 35 is an exploded perspective diagram of a liquid discharging head 26*i* according to a tenth embodiment. FIG. 36 is a cross-sectional diagram of the liquid discharging head 26*i* cut along the YZ plane through which one nozzle Nz passes. The difference between the liquid discharging head 26*h* and the liquid discharging head 26*i* in the ninth embodiment shown in FIG. 33 is as follows. That is, as shown in FIG. 35, the difference is that the communication flow path 16*i* of the liquid discharging head 26*i* is formed in the flow path plate 15*i* and is that the communication flow path 292*h* is not formed in the nozzle plate 20*i*. Since the other configuration of the tenth embodiment is the same as the configuration of the ninth embodiment, the same components are denoted by the same reference numerals and the description thereof is omitted.

As shown in FIG. 36, a communication flow path 16*i* of a head main body 11*i* is coupled to the first pressure chamber 221*a* and the second pressure chamber 221*b* communicating with one nozzle Nz. In the embodiment, in plan view, a part of the communication flow path 16*i* is formed such that the first pressure chamber 221*a* and the second pressure chamber 221*b* overlap. The nozzle plate 20*i* forms one nozzle row LNz. Further, the liquid discharging head 26*i* of the embodiment may adopt the configuration used in the liquid discharging heads 26 to 26*h* of the first to ninth embodiments within the applicable range. For example, the first pressure chamber 221*a* and the second pressure chamber 221*b* adjacent to each other in the second axis direction Y are formed substantially in line symmetry with respect to a first virtual line in plan view, and the communication flow path 16*i* is preferably formed substantially in line symmetry with respect to the first virtual line. A first virtual line in the embodiment is the same as a line representing the nozzle row LNz in plan view.

According to the tenth embodiment, one first pressure chamber 221*a* and the other second pressure chamber 221*b* of the two chamber rows communicate with one nozzle Nz through the communication flow path 292*h*. In this way, as in the above-described first embodiment, it is possible to cause larger amount of liquid to be discharged from the nozzle while suppressing increase in volume of each pressure chamber 221. Further, according to the ninth embodiment, the same effect is achieved in terms of having the same configuration as those of the first embodiment to the tenth embodiment.

K. Eleventh Embodiments

Figure 37:
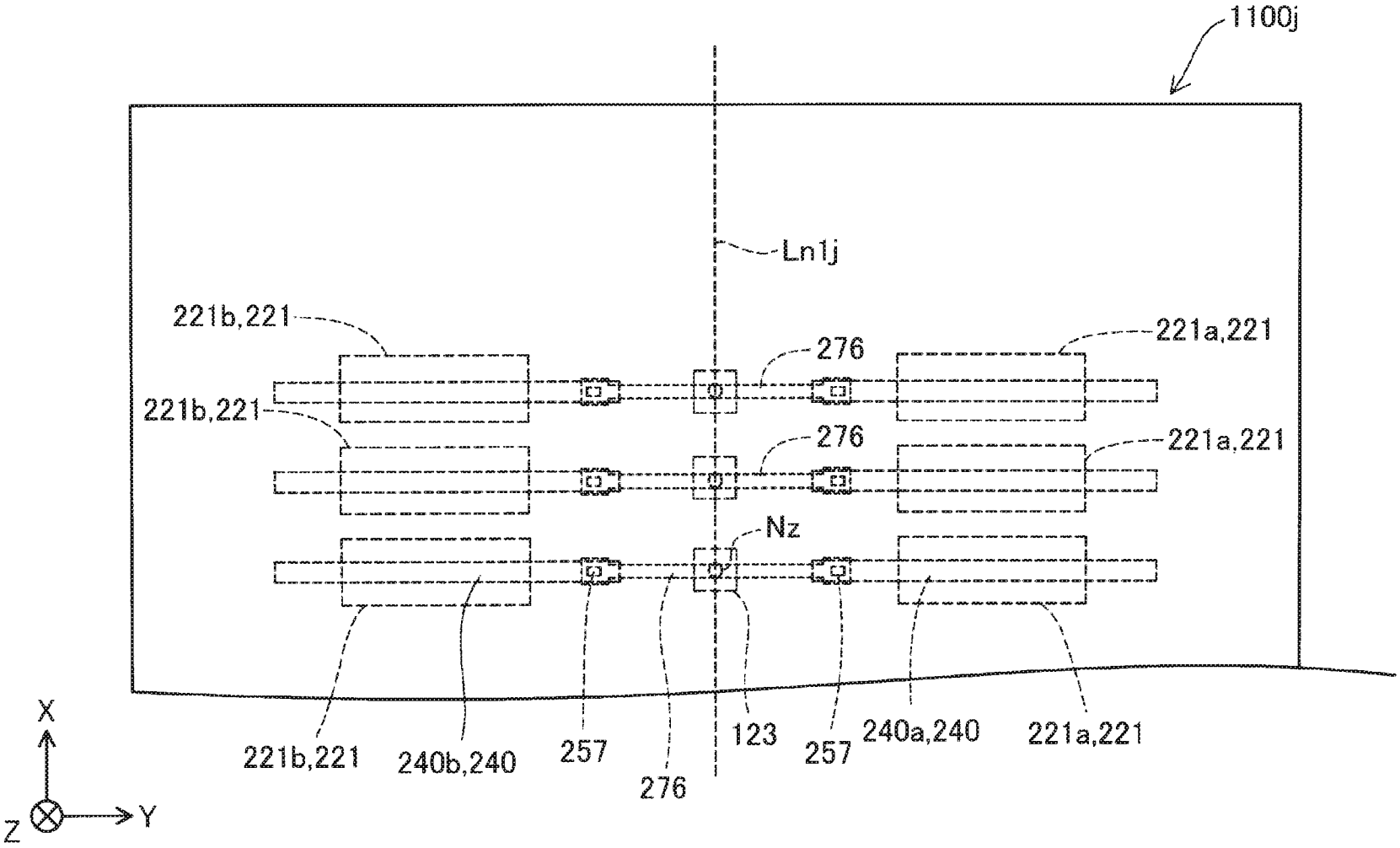
FIG. 37 is a diagram for explaining a preferred aspect of a liquid discharging head according to ninth and tenth embodiments.

FIG. 37 is a diagram for explaining a preferred aspect of liquid discharging heads 26*h* and 26*i* of ninth and tenth embodiments. FIG. 37 is a diagram showing an example of electric wiring of liquid discharging heads 26*h* and 26*i* in a ninth and tenth embodiments. The drive element 1100*j* can be used for the liquid discharging heads 26*h* and 26*i*. The drive element 1100*j* has the first segment electrode 240*a* and the second segment electrode 240*b*.

The first segment electrode 240*a* is formed so as to overlap the first pressure chamber 221*a* and not to overlap the second pressure chamber 221*b* in plan view. The second segment electrode 240*b* is formed so as to overlap the second pressure chamber 221*b* and not to overlap the first pressure chamber 221*a* in plan view. In the embodiment, the first segment electrode 240*a* and the second segment electrode 240*b* are arranged at an interval in the second axis direction Y. Further, the first segment electrode 240*a* and the second segment electrode 240*b* form a base layer as in the first embodiment shown in FIG. 12. The second lead electrode 276 extends along the second axis direction Y. One end of the second lead electrode 276 is coupled to the first segment electrode 240*a* in the opening 257. The other end of the second lead electrode 276 is coupled to the second segment electrode 240*b* at the opening 257. As described above, the first segment electrode 240*a* and the second segment electrode 240*b* provided in correspondence with one nozzle Nz are coupled to one common second lead electrode 276.

Each of the plurality of second lead electrodes 276 arranged in the first axis direction X is electrically coupled to corresponding terminal 123 such that the selected drive pulse COM is applied to the first segment electrode 240*a* and the second segment electrode 240*b*.

In the embodiment, the disclosure contents of the first to tenth embodiments may be adopted within the applicable range. For example, the first segment electrode 240*a* and the second segment electrode 240*b* may be formed substantially in line symmetry with respect to the first virtual line Ln1J in plan view. The first virtual line Ln1J is a line parallel to the first axis direction X.

According to the eleventh embodiment, the same effect is achieved in terms of having the same configuration as those of the first embodiment to the tenth embodiment. For example, wiring of the electric signals to the first segment electrode 240*a* and the second segment electrode 240*b* can be made common by the second lead electrode 276 located closer to the nozzle drive circuit 28. By this, in the drive element 1100*j*, variations between a wiring impedance from the nozzle drive circuit 28 to the first segment electrode 240*a* and a wiring impedance from the nozzle drive circuit 28 to the second segment electrode 240*b* can be reduced.

L. Twelfth Embodiment

In the first to eleventh embodiments, for example, as shown in FIG. 10, the first segment electrode 240*a* and the second segment electrode 240*b* are coupled to one common second lead electrode 276. However, the coupling mode of electric wiring for supplying the drive pulse COM common to the first segment electrode 240*a* and the second segment electrode 240*b* provided in correspondence with one nozzle Nz is not limited to this. Hereinafter, an example of the coupling mode of electric wiring which can be used instead of using the second lead electrode 276 in common will be described.

Figure 38:
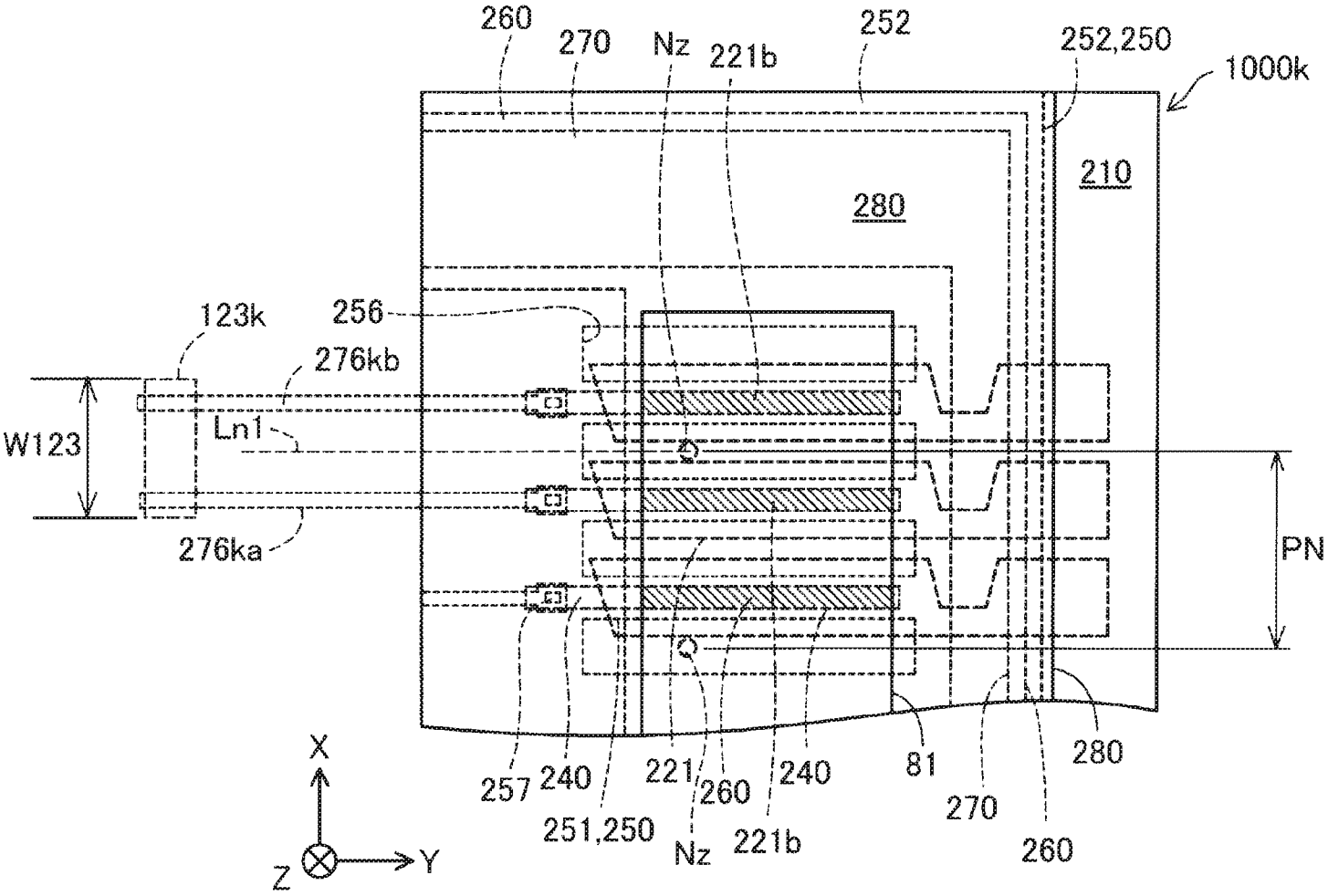
FIG. 38 is a diagram for explaining a twelfth embodiment.

FIG. 38 is a diagram for explaining a twelfth embodiment. FIG. 38 is a diagram equivalent to FIG. 10 of the first embodiment, and is different from the drive element 1100 of the first embodiment in that the second lead electrode 276*ka* and the second lead electrode 276*kb* forming a set are electrically coupled to one terminal 123*k*. Since the other configuration is the same as the configuration of the first embodiment, the same components are denoted by the same reference numerals and the description thereof is omitted.

A first individual lead electrode 276*ka* which is the second lead electrode is coupled to the first segment electrode 240*a* corresponding to the first pressure chamber 221*a* at the opening 257. The first individual lead electrode 276*ka* is drawn from the first segment electrode 240*a* of the first driver 220*a*. A second individual lead electrode 276*kb* which is the second lead electrode is coupled to the second segment electrode 240*b* corresponding to the second pressure chamber 221*b* at the opening 257. The second individual lead electrode 276*kb* is drawn from the second segment electrode 240*b* of the second driver 220*b*. A set of the first individual lead electrode 276*ka* and the second individual lead electrode 276*kb* extends in parallel along the second axis direction Y. A set of the first individual lead electrode 276*ka* and the second individual lead electrode 276*kb* is coupled in common to one terminal 123*k*. In the embodiment, one terminal 123*k* of the circuit substrate 29 overlaps to be coupled to the first individual lead electrode 276*ka* and the second individual lead electrode 276*kb* in plan view.

A maximum width W123 of one terminal 123*k* in the first axis direction X is preferably 50% to 80% of the nozzle pitch PN of the nozzle row. In this way, variations in current flowing in the one terminal 123*k* can be reduced. Further, in this way, the interval between the two adjacent terminals 123*k* can be sufficiently secured, the occurrence of short circuit can be suppressed.

As described above, wiring of the electric signals to the first segment electrode 240*a* and the second segment electrode 240*b* can be made common by the terminal 123*k* located closer to the nozzle drive circuit 28. By this, in the drive element 1100*k*, variations between a wiring impedance from the nozzle drive circuit 28 to the first segment electrode 240*a* and a wiring impedance from the nozzle drive circuit 28 to the second segment electrode 240*b* can be reduced. Accordingly, since the liquid can be supplied more uniformly to the nozzle from the first pressure chamber 221*a* and the second pressure chamber 221*b*, the possibility that the discharge characteristics of the nozzles Nz vary can be reduced.

Figure 39:
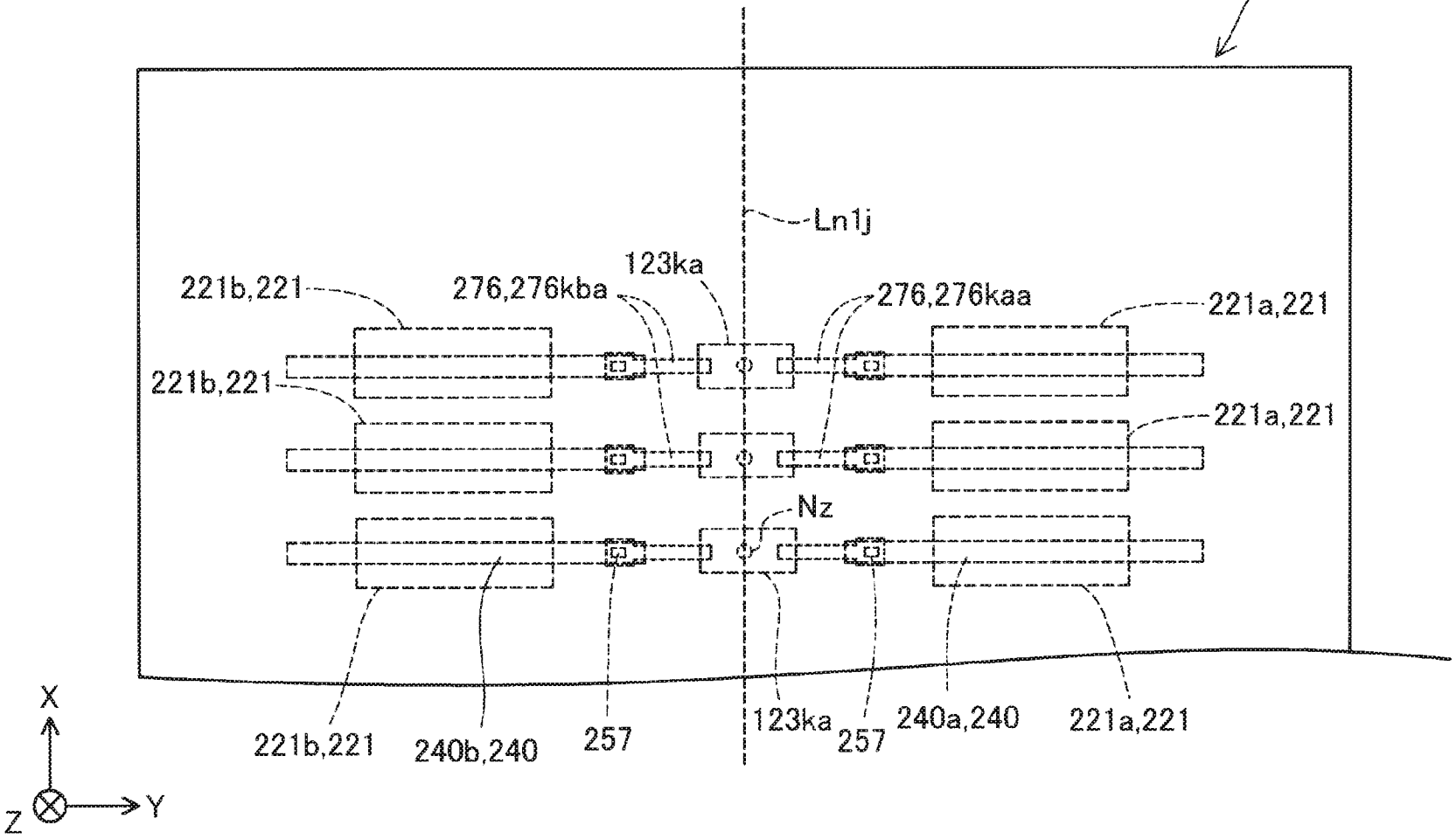
FIG. 39 is a diagram for explaining another mode of a twelfth embodiment.

The above-described twelfth embodiment has been described as the other aspect of the drive element 1100 of the first embodiment, but can also be applied as another aspect of the drive element 1100*j* shown in FIG. 37. Other aspects of the drive element 1100*j* will be described with reference to FIG. 39. FIG. 39 is a diagram for explaining another mode of the twelfth embodiment. FIG. 39 is a diagram equivalent to FIG. 37. In a drive element 1100*ka*, a second lead electrode 276 may include a first individual lead electrode 276*kaa* coupled to the first segment electrode 240*a* and a second individual lead electrode 276*kba* coupled to the second segment electrode 240*b* and formed to be spaced from the first individual lead electrode 276*kaa*. The first individual lead electrode 276*kaa* and the second individual lead electrode 276*kba* are coupled by one common terminal 123*ka*. Further, similarly to the drive element 1100*k*, the maximum width W of the one terminal 123*ka* in the first axis direction X is preferably 50% to 80% of the nozzle pitch PN of the nozzle row.

M. Thirteenth Embodiment

Figure 40:
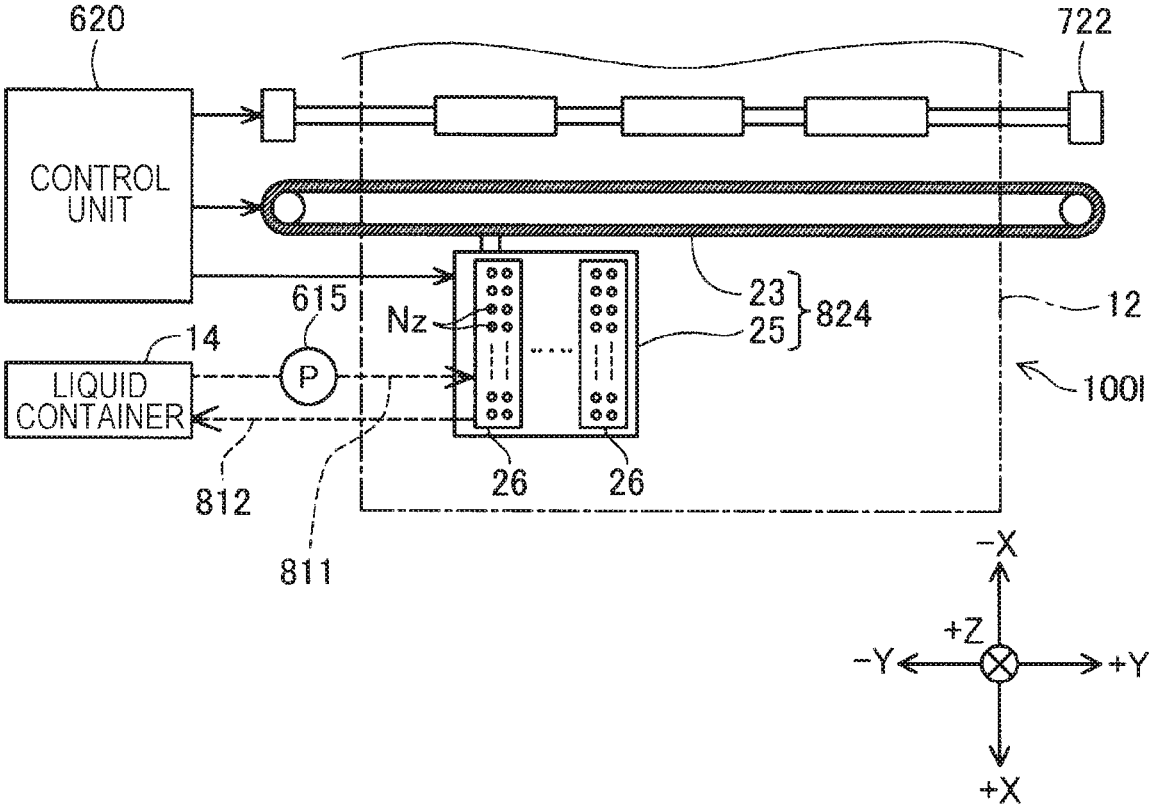
FIG. 40 is a diagram for explaining a liquid discharging apparatus according to a thirteenth embodiment.

In each of the above embodiments, although the first reservoirs 42*a* and 42*da* and the second reservoirs 42*b* and 42*db* are supply reservoirs that supply a liquid from the liquid container 14 that is a liquid supply source to the communication flow paths 16, 16*c*, 16*d*, 16*i*, 292, and 292*h*, it is not limited to this. FIG. 40 is a diagram for explaining a liquid discharging apparatus 100*j* according to a thirteenth embodiment. The difference between the above-described liquid discharging apparatuses 100 and 100*g* is that, in addition to a supply flow path 811 for supplying a liquid from the liquid container 14 to the liquid discharging head 26, a recovery flow path 812 for recovering a liquid from the liquid discharging head 26 to the liquid container 14 is provided. The supply flow path 811 is coupled to the first introduction holes 44*a* and 44*ha* communicating with the first reservoirs 42*a* and 42*da* shown in FIG. 4 and the like. The recovery flow path 812 is coupled to the second introduction holes 44*b* and 44*hb* shown in FIG. 4 and the like communicating with the second reservoirs 42*b* and 42*db*. That is, the first reservoirs 42*a* and 42*da* function as supply reservoirs for supplying a liquid to the communication flow paths 16, 16*c*, 16*d*, 16*i*, 292, and 292*h*. Further, the second reservoirs 42*b* and 42*db* function as recovery reservoirs for recovering a liquid from the communication flow paths 16, 16*c*, 16*d*, 16*i*, 292, and 292*h*. The flow mechanism 615 is controlled by the control unit 620 to move the liquid through the liquid discharging head 26. In the embodiment, the flow mechanism 615 circulates the liquid between the liquid container 14 and the liquid discharging head 26 through the supply flow path 811 and the recovery flow path 812. In this way, for example, the supply flow path 811 or the recovery flow path 812 or the flow mechanism 615 corresponds to a mechanism for supplying a liquid to the first reservoir 42*a* and recovering a liquid from the second reservoir 42*b*.

N. Other Aspects

The present disclosure is not limited to the above-described embodiments, and can be realized in various aspects within a range not departing from the spirit of the present disclosure. For example, the disclosure can be realized by the following aspects. The technical features in the embodiment corresponding to the technical features in each aspect described below can be replaced or combined as appropriate to solve some or all of the problems of the disclosure or to achieve some or all of the effects of the disclosure. Further, if the technical features are not described as essential in the present specification, they may be deleted as appropriate.

(1-1) According to one aspect of the disclosure, a liquid discharging head is provided. The liquid discharging head includes a nozzle plate having a first surface on which a nozzle that discharges a liquid is formed, and a second surface on a side opposite to the first surface, in which a communication flow path communicating with the nozzle is formed, and a chamber plate on which a plurality of pressure chambers communicating with the nozzle is formed, where the chamber plate is disposed on the second surface side of the nozzle plate, and a first pressure chamber and a second pressure chamber among the plurality of pressure chambers communicate with the nozzle through the one communication flow path.

According to this aspect, when the first pressure chamber and the second pressure chamber communicate with the nozzle, it is possible to cause larger amount of liquid to be discharged from the nozzle while suppressing increase in volume of the pressure chamber.

(1-2) In the above aspect, the communication flow path may be formed in a region larger than that of the nozzle in plan view.

According to this aspect, the communication flow path can be formed in a region larger than that of the nozzle in plan view.

(1-3) In the above aspect, the communication flow path may be formed such that at least a part of the communication flow path overlaps the first pressure chamber and the second pressure chamber in plan view.

According to this aspect, it is possible to suppress increase in size of the liquid discharging head in a horizontal direction.

(1-4) In the above aspect, a depth dimension of the communication flow path may be equal to or more than a depth dimension of a nozzle.

According to this aspect, by making the depth dimension of the communication flow path equal to or greater than the depth dimension of the nozzle, increase in an inertance of the communication flow path can be suppressed.

(1-5) In the above aspect, the depth dimension of the communication flow path may be twice the depth dimension of the nozzle or less.

According to this aspect, it is possible to suppress increase in manufacturing time when the communication flow path is formed by etching or the like. Further, according to this aspect, since a degree of manufacturing variations of a depth dimension of the communication flow path can be reduced, it is possible to reduce the possibility of variations in a discharge amount of a liquid from each nozzle Nz.

(1-6) In the above aspect, the first pressure chamber and the second pressure chamber may be formed substantially in line symmetry with respect to a first virtual line in plan view, and the communication flow path may be formed substantially in line symmetry with respect to the first virtual line in plan view.

According to this aspect, a deviation in magnitude between a pressure wave transmitted from the first pressure chamber to the communication flow path and a pressure wave transmitted from the second pressure chamber to the communication flow path can be suppressed. By this, an occurrence of a deviation between an amount of a liquid flowing into the communication flow path from the first pressure chamber and an amount of a liquid flowing into the communication flow path from the second pressure chamber can be suppressed.

(1-7) In the above aspect, the nozzle communicating with the first pressure chamber and the second pressure chamber may be disposed so as to overlap with the first virtual line in plan view.

According to this aspect, a deviation in magnitude between a pressure wave transmitted from the first pressure chamber to a nozzle and a pressure wave transmitted from the second pressure chamber to a nozzle can be suppressed. By this, an occurrence of a deviation between an amount of a liquid flowing into the nozzle from the first pressure chamber and an amount of a liquid flowing into the nozzle from the second pressure chamber can be further suppressed.

(1-8) In the above aspect, the liquid discharging head may further include an intermediate plate disposed between the nozzle plate and the chamber plate, and the intermediate plate may have a first through-hole and a second through-hole penetrating in a plan view direction, the first pressure chamber may communicate with the communication flow path through the first through-hole, and the second pressure chamber may communicate with the communication flow path through the second through-hole.

According to this aspect, the first pressure chamber and the second pressure chamber can be communicated with the communication flow path through the intermediate plate having the first through-hole and the second through-hole.

(1-9) In the above aspect, the liquid discharging head may further include a first reservoir and a second reservoir that commonly communicate with the plurality of pressure chambers, and the first pressure chamber may be coupled to the first reservoir, and the second pressure chamber may be coupled to the second reservoir.

According to this aspect, the first pressure chamber and the second pressure chamber can be coupled to different reservoirs.

(1-10) In the above aspect, the first reservoir may be a supply reservoir that supplies the liquid to the communication flow path, and the second reservoir may be a recovery reservoir that recovers the liquid from the communication flow path.

According to this aspect, it is possible to cause the first reservoir to function as a supply reservoir that supplies a liquid to the communication flow path, and cause the second reservoir to function as a recovery reservoir that recovers a liquid from the communication flow path.

(1-11) A liquid discharging apparatus including the liquid discharging head of the above-described aspect and a mechanism for supplying the liquid to the first reservoir and recovering the liquid from the second reservoir may be provided.

According to this aspect, the liquid can be supplied to the first reservoir and the liquid can be recovered from the second reservoir.

(1-12) A liquid discharging apparatus including the liquid discharging head of the above-described aspect and a mechanism for moving a medium that receives liquid discharged from the liquid discharging head relative to the liquid discharging head may be provided.

According to this aspect, the medium can be moved relatively to the liquid discharging head.

(2-1) According to another aspect of the disclosure, a liquid discharging head is provided. The liquid discharging head includes a nozzle that discharges a liquid, a chamber plate in which a plurality of pressure chambers are arranged side by side on a first surface side, and a flow path plate having a second surface bonded to the first surface of the chamber plate and formed with an opening of a communication flow path for causing the pressure chamber to communicate with the nozzle, where a first region of a partition wall between a first pressure chamber and a second pressure chamber adjacent to each other among the plurality of pressure chambers is constrained by being bonded to the second surface of the flow path plate, and the second region of the partition wall overlaps with the opening of the one communication flow path in plan view.

According to this aspect, when the first pressure chamber and the second pressure chamber communicate with the nozzle, it is possible to cause larger amount of liquid to be discharged from the nozzle while suppressing increase in volume of the pressure chamber. Further, according to this aspect, by forming the opening of the communication flow path so as to overlap with the second region of the partition wall, an inertance of the communication flow path can be reduced. That is, by forming the opening of the communication flow path so as to overlap with the second region of the partition wall, a cross-sectional area of the communication flow path can be made larger. By this, since the inertance of the communication flow path can be reduced, a liquid can be smoothly circulated from the pressure chamber to the nozzle through the communication flow path. Accordingly, a discharge efficiency of a liquid from the nozzle can be improved.

(2-2) In the above aspect, the first pressure chamber and the second pressure chamber are adjacent to each other along a first axis direction, the partition wall extends along a second axis direction orthogonal to the first axis direction, and a length of the second region in the second axis direction may be equal to or smaller than half of a length of the first region in the second axis direction.

Here, when the length of the second region in the second axis direction is longer than half of the length of the first region in the second axis direction, the first region becomes relatively small, and an influence of lowering a discharge efficiency due to increase in a compliance of the pressure chamber may be significant. According to this aspect, by setting the length of the second region in the second axis direction to be equal to or smaller than half of the length of the first region in the second axis direction, the discharge efficiency of a liquid from the nozzle can be improved.

(2-3) In the above aspect, the length of the second region in the second axis direction may be equal to or greater than a width of each of the first pressure chamber and the second pressure chamber in the first axis direction.

According to this aspect, a discharge efficiency of a liquid from the nozzle can be further improved.

(2-4) In the above aspect, the first pressure chamber and the second pressure chamber may be adjacent to each other along a first axis direction, the partition wall may extend along a second axis direction orthogonal to the first axis direction, and a length of the second region in the second axis direction may be equal to or greater than a width of each of the first pressure chamber and the second pressure chamber in the first axis direction.

According to this aspect, since it is possible to suppress a reduction in a cross-sectional area of the communication flow path, it is possible to further suppress an increase in an inertance of the communication flow path. Accordingly, a discharge efficiency of discharging a liquid from the nozzle can be prevented from being greatly reduced.

(2-5) In the above aspect, a base material of the flow path plate and a base material of the chamber plate may be the same.

According to this aspect, since a linear expansion coefficient between a chamber plate and a flow path plate can be made substantially the same, an occurrence of warpage or cracks due to heat, peeling, and the like can be suppressed.

(2-6) In the above aspect, the first pressure chamber and the second pressure chamber may be formed substantially in line symmetry with respect to a first virtual line in plan view, and the communication flow path may be formed substantially in line symmetry with respect to the first virtual line in plan view.

According to this aspect, a deviation in magnitude between a pressure wave transmitted from a first pressure chamber to the communication flow path and a pressure wave transmitted from a second pressure chamber to the communication flow path can be suppressed. By this, an occurrence of a deviation between an amount of a liquid flowing into the communication flow path from the first pressure chamber and an amount of a liquid flowing into the communication flow path from the second pressure chamber can be suppressed.

(2-7) In the above aspect, the nozzle communicating with the first pressure chamber and the second pressure chamber may be disposed so as to overlap with the first virtual line in plan view.

According to this aspect, a deviation in magnitude between a pressure wave transmitted from the first pressure chamber to the nozzle and a pressure wave transmitted from the second pressure chamber to the nozzle can be suppressed. By this, an occurrence of a deviation between an amount of a liquid flowing into the nozzle from the first pressure chamber via the communication flow path and an amount of a liquid flowing into the nozzle from the second pressure chamber via the communication flow path can be suppressed.

(2-8) In the above aspect, the liquid discharging head may further include a first reservoir and a second reservoir that commonly communicate with the plurality of pressure chambers, and the first pressure chamber may be coupled to the first reservoir, and the second pressure chamber may be coupled to the second reservoir.

According to this aspect, the first pressure chamber and the second pressure chamber can be coupled to different reservoirs.

(2-9) In the above aspect, the first reservoir may be a supply reservoir that supplies the liquid to the communication flow path, and the second reservoir may be a recovery reservoir that recovers the liquid from the communication flow path.

According to this aspect, it is possible to cause the first reservoir to function as a supply reservoir that supplies a liquid to the communication flow path, and cause the second reservoir to function as a recovery reservoir that recovers a liquid from the communication flow path.

(2-10) In the above aspect, the liquid discharging head may further include a drive element that varies a liquid pressure of the pressure chamber, and a first drive element which is the drive element corresponding to the first pressure chamber and a second drive element which is the drive element corresponding to the second pressure chamber may be driven independently of each other.

According to this aspect, by driving the first drive element and the second drive element independently of each other, generation of a crosstalk occurred between the first pressure chamber and the second pressure chamber through a second region can be reduced.

(2-11) A liquid discharging apparatus including the liquid discharging head of the above-described aspect and a mechanism for supplying the liquid to the first reservoir and recovering the liquid from the second reservoir may be provided.

According to this aspect, a liquid can be supplied to the first reservoir and a liquid can be recovered from the second reservoir.

(2-12) A liquid discharging apparatus may include the liquid discharging head of the above-described aspect, and a drive circuit that drives the first drive element and the second drive element, and the drive circuit may apply a first drive pulse to the first drive element and may apply a second drive pulse different from the first drive pulse to the second drive element.

According to this aspect, by applying the first drive pulse to the first drive element and applying the second drive pulse to the second drive element, generation of a crosstalk occurred between the first pressure chamber and the second pressure chamber through a second region can be reduced.

(2-13) A liquid discharging apparatus including the liquid discharging head of the above-described aspect and a mechanism for moving a medium that receives a liquid discharged from the liquid discharging head relative to the liquid discharging head may be provided.

According to this aspect, the medium can be moved relatively to the liquid discharging head.

(3-1) According to another aspect of the disclosure, a liquid discharging head is provided. The liquid discharging head includes a nozzle that discharges a liquid, a pressure chamber row in which a plurality of pressure chambers communicating with the nozzle are arranged side by side along a first axis direction, and a first reservoir and a second reservoir commonly communicating with the plurality of pressure chambers, where the pressure chamber row includes a first pressure chamber communicating with the first reservoir and a second pressure chamber communicating with the second reservoir, and the liquid discharging head further includes a communication flow path causing the first pressure chamber and the second pressure chamber to commonly communicate with the one nozzle.

According to this aspect, when the first pressure chamber and the second pressure chamber communicate with the nozzle, it is possible to cause larger amount of liquid to be discharged from the nozzle while suppressing an increase in volume of the pressure chamber.

(3-2) In the above aspect, a plurality of sets of the first pressure chamber, the second pressure chamber, the communication flow path, and the one nozzle may be provided, and the plurality of one nozzles corresponding to the sets may be arranged side by side along the first axis direction to form a nozzle row.

According to this aspect, the liquid can be discharged from a plurality of nozzles arranged side by side along the first axis direction.

(3-3) In the above aspect, when the liquid flows from the first pressure chamber to the second pressure chamber through the one communication flow path, directions of the liquid flowing through each communication flow path of each set may be the same.

Here, when the liquid flows from the first pressure chamber to the second pressure chamber through the communication flow path, the direction of the liquid discharged from the nozzle may be shifted with respect to a nozzle opening direction due to a flow near the nozzle. Thus, a degree of variations in the direction of a liquid discharged from each nozzle can be made small by aligning the direction of the flow of each communication flow path.

(3-4) In the above aspect, the first reservoir and the second reservoir may be provided such that at least a part of the first reservoir and the second reservoir overlap each other when viewed in plan in a liquid discharge direction.

According to this aspect, it is possible to suppress an increase in size of the liquid discharge head in a horizontal direction.

(3-5) In the above aspect, the liquid discharging head may further include a first coupling flow path coupling the first pressure chamber and the first reservoir, and a second coupling flow path coupling the second pressure chamber and the second reservoir, and a flow path length of the first coupling flow path may be shorter than a flow path length of the second coupling flow path.

According to this aspect, it is possible to provide a liquid discharging head of which the first coupling flow path is shorter than the second coupling flow path.

(3-6) In the above aspect, a flow path length from the one nozzle to the first pressure chamber may be shorter than a flow path length from the one nozzle to the second pressure chamber.

Here, an inertance on the coupling flow path side or the inertance on the nozzle side from the pressure chamber affects a discharge efficiency of a liquid from the pressure chamber to the nozzle. For example, when the inertance on the coupling flow path side becomes relatively large, the efficiency of the flow from the pressurized pressure chamber to the nozzle, that is, the discharge efficiency becomes relatively large. On the other hand, when the inertance on the nozzle side becomes relatively large, the discharge efficiency from the pressurized pressure chamber becomes relatively small. Therefore, the difference in inertance between the first coupling flow path and the second coupling flow path may cause an imbalance of the discharge efficiency from the nozzle between the first pressure chamber and the second pressure chamber. In order to compensate for or reduce such imbalance, it is preferable to adjust the inertance by making the flow path length from one nozzle to the first pressure chamber shorter than the flow path length from the one nozzle to the second pressure chamber as in the above-described aspect.

(3-7) In the above aspect, a first inertance between the one nozzle and the first pressure chamber may be smaller than a second inertance between the one nozzle and the second pressure chamber.

Here, the inertance on the coupling flow path side or the inertance on the nozzle side seen from the pressure chamber affects the discharge efficiency of a liquid from the pressure chamber to the nozzle. For example, when the inertance on the coupling flow path side becomes relatively large, the efficiency of the flow from the pressurized pressure chamber to the nozzle, that is, the discharge efficiency becomes relatively large. On the other hand, when the inertance on the nozzle side becomes relatively large, the discharge efficiency from the pressurized pressure chamber becomes relatively small. Therefore, the difference in inertance between the first coupling flow path and the second coupling flow path may cause an imbalance of the discharge efficiency from the nozzle between the first pressure chamber and the second pressure chamber. In order to compensate for or reduce such imbalance, it is preferable that a first inertance is smaller than a second inertance as the above-described aspect.

(3-8) In the above aspect, a flow path cross-sectional area of at least a part of the first coupling flow path may be smaller than a flow path cross-sectional area of the second coupling flow path.

According to this aspect, it is possible to suppress a large deviation between an inertance of the second coupling flow path and an inertance of the first coupling flow path.

(3-9) In the above aspect, the first reservoir may be a supply reservoir that supplies the liquid to the communication flow path, and the second reservoir may be a recovery reservoir that recovers the liquid from the communication flow path.

According to this aspect, it is possible to cause the first reservoir to function as a supply reservoir that supplies a liquid to the communication flow path, and cause the second reservoir to function as a recovery reservoir that recovers a liquid from the communication flow path.

(3-10) A liquid discharging apparatus including the liquid discharging head of the above-described aspect and a mechanism for supplying the liquid to the first reservoir and recovering the liquid from the second reservoir may be provided.

According to this aspect, a liquid can be supplied to the first reservoir and liquid can be recovered from the second reservoir.

(3-11) A liquid discharging apparatus including the liquid discharging head of the above-described aspect, and a mechanism for moving a medium that receives a liquid discharged from the liquid discharging head relative to the liquid discharging head may be provided.

According to this aspect, the medium can be moved relatively to the liquid discharging head.

(4-1) According to another aspect of the disclosure, a liquid discharging head is provided. The liquid discharging head includes a nozzle that discharges a liquid, a chamber plate having a plurality of pressure chambers, drive elements provided in correspondence with each pressure chamber, and a plurality of lead electrodes for supplying electric signals to the drive elements, and a circuit substrate having terminals coupled to the lead electrodes, where the plurality of pressure chambers include a first pressure chamber and a second pressure chamber, the chamber plate includes a first pressure chamber and a second pressure chamber commonly communicating with the one nozzle, and a first segment electrode and a second segment electrode constituting the drive element, the first segment electrode being formed so as to overlap the first pressure chamber and not to overlap the second pressure chamber in plan view, and the second segment electrode being formed so as to overlap the second pressure chamber and not to overlap the first pressure chamber in plan view, and the first segment electrode and the second segment electrode are coupled to one common lead electrode.

According to this aspect, when the first pressure chamber and the second pressure chamber communicate with one nozzle, it is possible to cause larger amount of liquid to be discharged from the nozzle while suppressing increase in volume of the pressure chamber. Further, according to this aspect, wiring of the electric signals to the first segment electrode and the second segment electrode can be made common by the lead electrode located closer to the drive element. By this, in the drive element, variations between a wiring impedance from the circuit substrate to the first segment electrode and a wiring impedance from the circuit substrate to the second segment electrode can be reduced. Therefore, since the liquid can be supplied to the nozzle more uniformly from the first pressure chamber and the second pressure chamber, the possibility that discharge characteristics of the nozzle vary can be reduced.

(4-2) In the above aspect, the first segment electrode and the second segment electrode may be formed as part of a common electrode layer.

According to this aspect, the first segment electrode and the second segment electrode can be formed using the common electrode layer.

(4-3) In the above aspect, the first segment electrode and the second segment electrode may be substantially in line symmetry with respect to a first virtual line in plan view, and the one lead electrode may be formed so as to straddle the first virtual line in the plan view.

According to this aspect, variations between a wiring impedance from the circuit substrate to the first segment electrode and a wiring impedance from the circuit substrate to the second segment electrode can be reduced.

(4-4) In the above aspect, the terminal and the lead electrode may be coupled at a position overlapping the first virtual line in the plan view.

According to this aspect, variations between a wiring impedance from the circuit substrate to the first segment electrode and a wiring impedance from the circuit substrate to the second segment electrode can be further reduced.

(4-5) In the above aspect, a plurality of sets of the first pressure chamber, the second pressure chamber, the one nozzle, and the one lead electrode may be provided, and a plurality of the one nozzles corresponding to the sets may be arranged side by side along a first axis direction to form a nozzle row.

According to this aspect, a plurality of one nozzles corresponding to each set can be arranged side by side along a first axis direction.

(4-6) In the above aspect, a maximum width of the one lead electrode in the first axis direction may be 50% to 80% of a nozzle pitch of the nozzle row.

According to this aspect, variations in current flowing in one lead electrode can be reduced. Further, according to this aspect, since an interval between two adjacent lead electrodes is easily secured sufficiently, an occurrence of short circuit can be suppressed.

(4-7) In the above aspect, the first pressure chamber and the second pressure chamber may be arranged side by side along the first axis direction.

According to this aspect, the first pressure chamber and the second pressure chamber arranged side by side along the first axis direction can be formed.

(4-8) In the above aspect, the first pressure chamber and the second pressure chamber may be arranged side by side along a second axis direction intersecting the first axis direction.

According to this aspect, a first pressure chamber and a second pressure chamber arranged side by side along the second axis direction can be formed.

(4-9) In the above aspect, the liquid discharging head may further include a first reservoir and a second reservoir that commonly communicate with the plurality of pressure chambers, and the first pressure chamber may be coupled to the first reservoir, and the second pressure chamber may be coupled to the second reservoir.

According to this aspect, the first pressure chamber and the second pressure chamber can be coupled to different reservoirs.

(4-10) In the above aspect, the liquid discharging head may further include a communication flow path causing the first pressure chamber and the second pressure chamber to communicate with the one nozzle, and the first reservoir may be a supply reservoir that supplies the liquid to the communication flow path and the second reservoir may be a recovery reservoir that recovers the liquid from the communication flow path.

According to this aspect, it is possible to cause the first reservoir to function as a supply reservoir that supplies a liquid to the communication flow path, and cause the second reservoir to function as a recovery reservoir that recovers a liquid from the communication flow path.

(4-11) A liquid discharging apparatus including the liquid discharging head of the above-described aspect, and a mechanism for supplying the liquid to the first reservoir and recovering the liquid from the second reservoir may be provided.

According to this aspect, a liquid can be supplied to the first reservoir and liquid can be recovered from the second reservoir.

(4-12) A liquid discharging apparatus including the liquid discharging head of the above-described aspect, and a mechanism for moving a medium that receives liquid discharged from the liquid discharging head relative to the liquid discharging head may be provided.

According to this aspect, the medium can be moved relatively to the liquid discharging head.

(5-1) According to another aspect of the disclosure, a liquid discharging head is provided. The liquid discharging head includes a nozzle that discharges a liquid, a chamber plate having a plurality of pressure chambers, drive elements provided in correspondence with each pressure chamber, and a plurality of lead electrodes for supplying electric signals to the drive elements, and a circuit substrate having terminals coupled to the lead electrodes, where the plurality of pressure chambers include a first pressure chamber and a second pressure chamber communicating with the one nozzle, the plurality of lead electrodes include a first individual lead electrode drawn from a first drive element that is the drive element corresponding to the first pressure chamber, and a second individual lead electrode drawn from a second drive element that is the drive element corresponding to the second pressure chamber, and the one terminal of the circuit substrate is coupled so as to overlap the first individual lead electrode and the second individual lead electrode in plan view.

According to this aspect, when the first pressure chamber and the second pressure chamber communicate with one nozzle, it is possible to cause larger amount of liquid to be discharged from the nozzle while suppressing increase in volume of the pressure chamber. Further, according to this aspect, wiring of the electric signals to the first segment electrode and the second segment electrode can be made common by the terminal located closer to the drive element. By this, in the drive element, variations between a wiring impedance from the circuit substrate to the first segment electrode and a wiring impedance from the circuit substrate to the second segment electrode can be reduced. Therefore, since the liquid can be supplied to the nozzle more uniformly from the first pressure chamber and the second pressure chamber, the possibility that discharge characteristics of the nozzle vary can be reduced.

(5-2) In the above aspect, a plurality of sets of the first pressure chamber, the second pressure chamber, the one nozzle, and the terminal are provided, and a plurality of the one nozzles corresponding to the sets may be arranged side by side along a first axis direction to form a nozzle row.

According to this aspect, it is possible to configure a nozzle row in which a plurality of nozzles are arranged side by side along the first axis direction.

(5-3) In the above aspect, a maximum width of the terminal in the first axis direction may be 50% to 80% of a nozzle pitch of the nozzle row.

According to this aspect, variations in current flowing in the terminal can be reduced. Further, according to this aspect, since an interval between two adjacent terminals is easily secured sufficiently, the occurrence of short circuit can be suppressed.

(5-4) In the above aspect, the first pressure chamber and the second pressure chamber may be arranged side by side along the first axis direction.

According to this aspect, the first pressure chamber and the second pressure chamber arranged side by side along the first axis direction can be provided.

(5-5) In the above aspect, the first pressure chamber and the second pressure chamber may be arranged side by side along a second axis direction intersecting the first axis direction.

According to this aspect, the first pressure chamber and the second pressure chamber arranged side by side along the second axis direction can be provided.

(5-6) In the above aspect, the liquid discharging head may further include a first reservoir and a second reservoir that commonly communicate with the plurality of pressure chambers, and the first pressure chamber may be coupled to the first reservoir, and the second pressure chamber may be coupled to the second reservoir.

According to this aspect, the first pressure chamber and the second pressure chamber can be coupled to different reservoirs.

(5-7) In the above aspect, the liquid discharging head may further include a communication flow path causing the first pressure chamber and the second pressure chamber to communicate with the one nozzle, and the first reservoir may be a supply reservoir that supplies the liquid to the communication flow path and the second reservoir may be a recovery reservoir that recovers the liquid from the communication flow path.

According to this aspect, it is possible to cause the first reservoir to function as a supply reservoir that supplies a liquid to the communication flow path, and cause the second reservoir to function as a recovery reservoir that recovers a liquid from the communication flow path.

(5-8) A liquid discharging apparatus including the liquid discharging head of the above-described aspect and a mechanism for supplying the liquid to the first reservoir and recovering the liquid from the second reservoir may be provided.

According to this aspect, a liquid can be supplied to the first reservoir and a liquid can be recovered from the second reservoir.

(5-9) A liquid discharging apparatus including the liquid discharging head of the above-described aspect, and a mechanism for moving a medium that receives a liquid discharged from the liquid discharging head relative to the liquid discharging head may be provided.

According to this aspect, the medium can be moved relatively to the liquid discharging head.

The disclosure can be realized in various forms other than a liquid discharging head and a liquid discharging apparatus. For example, a manufacturing method of a liquid discharging head and a liquid discharging apparatus, a control method of a liquid discharging apparatus, a program for executing a control method, and the like can be realized.

What is claimed is:

1. A liquid discharging head comprising:

a nozzle discharging a liquid;

a chamber plate having a plurality of pressure chambers, drive elements provided in correspondence with each pressure chamber, and a plurality of lead electrodes for supplying electric signals to the drive elements; and a circuit substrate having a terminal coupled to the lead electrode, wherein the plurality of pressure chambers include a first pressure chamber and a second pressure chamber communicating with the nozzle in common, the chamber plate includes a first segment electrode and a second segment electrode each constituting the drive element, the first segment electrode being formed so as to overlap the first pressure chamber and not to overlap the second pressure chamber in plan view, and the second segment electrode being formed so as to overlap the second pressure chamber and not to overlap the first pressure chamber in plan view, and the first segment electrode and the second segment electrode are coupled to the lead electrode in common.

2. The liquid discharging head according to claim 1, wherein the first segment electrode and the second segment electrode are formed as parts of a common electrode layer.

3. The liquid discharging head according to claim 1, wherein the first segment electrode and the second segment electrode are formed substantially in line symmetry with respect to a first virtual line in plan view, and the lead electrode is formed so as to straddle the first virtual line in the plan view.

4. The liquid discharging head according to claim 3, wherein the terminal and the lead electrode are coupled at a position overlapping the first virtual line in the plan view.

5. The liquid discharging head according to claim 1, wherein a plurality of sets of the first pressure chamber, the second pressure chamber, the nozzle, and the lead electrode are provided, and the sets of nozzles are arranged side by side along a first axis direction to configure a nozzle row.

6. The liquid discharging head according to claim 5, wherein a maximum width of the lead electrode in the first axis direction is 50% to 80% of a nozzle pitch of the nozzle row.

7. The liquid discharging head according to claim 5, wherein the first pressure chamber and the second pressure chamber are arranged side by side along the first axis direction.

8. The liquid discharging head according to claim 5, wherein the first pressure chamber and the second pressure chamber are arranged side by side along a second axis direction intersecting the first axis direction.

9. The liquid discharging head according to claim 1, further comprising:

a first reservoir and a second reservoir commonly communicating with the pressure chambers, wherein the first pressure chamber is coupled to the first reservoir, and the second pressure chamber is coupled to the second reservoir.

10. The liquid discharging head according to claim 9, further comprising:

a communication flow path causing the first pressure chamber and the second pressure chamber to communicate with the nozzle, wherein the first reservoir is a supply reservoir that supplies the liquid to the communication flow path, and the second reservoir is a recovery reservoir that recovers the liquid from the communication flow path.

11. A liquid discharging apparatus comprising:

the liquid discharging head according to claim 1; and a mechanism for supplying the liquid to the first reservoir and recovering the liquid from the second reservoir.

12. A liquid discharging apparatus comprising:

the liquid discharging head according to claim 1; and a mechanism for moving a medium that receives a liquid discharged from the liquid discharging head relative to the liquid discharging head.

* * * * *